US012313305B2

(12) United States Patent
Yun et al.

(10) Patent No.: US 12,313,305 B2
(45) Date of Patent: May 27, 2025

(54) REFRIGERATOR

(71) Applicant: LG ELECTRONICS INC., Seoul (KR)

(72) Inventors: Seokjun Yun, Seoul (KR); Hyoungkeun Lim, Seoul (KR); Seongmin Song, Seoul (KR); Junghun Lee, Seoul (KR); Hoyoun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 549 days.

(21) Appl. No.: 17/434,714

(22) PCT Filed: Feb. 13, 2020

(86) PCT No.: PCT/KR2020/002078
§ 371 (c)(1),
(2) Date: Mar. 15, 2022

(87) PCT Pub. No.: WO2020/175832
PCT Pub. Date: Sep. 3, 2020

(65) Prior Publication Data

US 2022/0235976 A1 Jul. 28, 2022

(30) Foreign Application Priority Data

Feb. 28, 2019 (KR) ..... 10-2019-0024360

(51) Int. Cl.
*F25B 21/02* (2006.01)
*F25D 11/02* (2006.01)

(52) U.S. Cl.
CPC ..... *F25B 21/02* (2013.01); *F25D 11/02* (2013.01)

(58) Field of Classification Search
CPC .. F25B 21/02; F25B 21/04; F25B 2321/0212; F25D 11/02
See application file for complete search history.

(56) References Cited

U.S. PATENT DOCUMENTS 5,987,892 A * 11/1999 Watanabe ..... A47G 29/141 62/434
6,038,865 A * 3/2000 Watanabe ..... A23L 3/365 62/3.6

(Continued)

FOREIGN PATENT DOCUMENTS

CN 101443612 A 5/2009
JP H0250054 A * 2/1990

(Continued)

OTHER PUBLICATIONS

Translation of KR100584274B1 named Translation—KR100584274B1 (Year: 2006).*

(Continued)

*Primary Examiner* — Paul Alvare
(74) *Attorney, Agent, or Firm* — Bryan Cave Leighton Paisner LLP

(57) ABSTRACT

A refrigerator includes a refrigerator chamber; a freezer chamber partitioned from the refrigerator chamber; a deep-freezing chamber accommodated inside the freezer chamber and partitioned from the freezer chamber; and a freezer evaporator chamber formed on the rear side of the deep-freezing chamber. The refrigerator may include a partition wall including a grill fan, which partitions the freezer evaporator chamber and the freezer chamber, and a shroud which is connected to the back surface of the grill fan and forms a flow path for supplying cold air of the freezer evaporator chamber to the freezer chamber.

20 Claims, 20 Drawing Sheets

(56) References Cited

U.S. PATENT DOCUMENTS

| | | | | |
|---|---|---|---|---|
| 7,934,385 | B2 | 5/2011 | Chen | |
| 9,328,951 | B2 * | 5/2016 | Shin | F25D 25/025 |
| 11,428,453 | B2 * | 8/2022 | Jung | F25D 23/12 |
| 2006/0144073 | A1 | 7/2006 | Lee et al. | |
| 2007/0193280 | A1 * | 8/2007 | Tuskiewicz | A47F 3/0404 62/3.6 |
| 2012/0047934 | A1 * | 3/2012 | Park | F25D 25/024 62/264 |
| 2012/0304667 | A1 * | 12/2012 | Shin | F25B 21/02 62/3.6 |
| 2013/0276465 | A1 * | 10/2013 | Shin | F25D 25/025 62/3.6 |
| 2014/0174100 | A1 * | 6/2014 | Biotti | F25B 21/02 62/3.4 |
| 2015/0121925 | A1 * | 5/2015 | Park | F25D 17/065 62/186 |
| 2016/0053797 | A1 * | 2/2016 | Chen | A47B 96/04 411/502 |
| 2018/0031297 | A1 * | 2/2018 | Kim | F25B 21/02 |
| 2018/0031298 | A1 * | 2/2018 | Kim | F25D 25/025 |
| 2018/0066883 | A1 * | 3/2018 | Oh | F25D 11/04 |
| 2018/0187944 | A1 | 7/2018 | Park et al. | |
| 2018/0224188 | A1 * | 8/2018 | Lee | F25D 17/045 |

FOREIGN PATENT DOCUMENTS

| | | | |
|---|---|---|---|
| JP | 2000065463 | A | 3/2000 |
| JP | 2000-199672 | A | 7/2000 |
| JP | 2003130538 | A | 5/2003 |
| JP | 2019-027649 | A | 2/2019 |
| KR | 10-2000-0019752 | A | 4/2000 |
| KR | 20010076101 | A | 8/2001 |
| KR | 100584274 | B1 * | 5/2006 |
| KR | 10-2006-0077396 | A | 7/2006 |
| KR | 100633149 | B1 | 10/2006 |
| KR | 10-2016-0097648 | A | 8/2016 |
| KR | 10-2018-0080651 | A | 7/2018 |
| KR | 10-2018-0080652 | A | 7/2018 |
| KR | 10-2018-0105572 | A | 9/2018 |
| KR | 10-2018-0124451 | A | 11/2018 |
| WO | 2018169328 | A1 | 9/2018 |

OTHER PUBLICATIONS

Translation of JPH0250054A named Translation—JPH0250054A (Year: 1990).*

International Search Report from PCT/KR2020/002078, dated May 27, 2020.

* cited by examiner (a)

(b)

(c)

REFRIGERATOR

This application is a National Stage Application of International Application No. PCT/KR2020/002078, filed on Feb. 13, 2020, which claims the benefit of and priority to Korean Application No. 10-2019-0024360, filed on Feb. 28, 2019, which are hereby incorporated by reference in their entirety for all purposes as if fully set forth herein.

TECHNICAL FIELD

The present invention relates to a refrigerator.

BACKGROUND ART

In general, a refrigerator is a home appliance for storing food at a low temperature, and includes a refrigerating compartment for storing food in a refrigerated state in a range of 3° C. and a freezing compartment for storing food in a frozen state in a range of −20° C.

However, when food such as meat or seafood is stored in the frozen state in the existing freezing compartment, moisture in cells of the meat or seafood are escaped out of the cells in the process of freezing the food at the temperature of −20° C., and thus, the cells are destroyed, and taste of the food is changed during an unfreezing process.

However, if a temperature condition of the storage compartment is set to a cryogenic state that is significantly lower than the current temperature of the freezing temperature. Thus, when the food quickly passes through a freezing point temperature range while the food is changed in the frozen state, the destruction of the cells may be minimized, and as a result, even after the unfreezing, the meat quality and the taste of the food may return to close to the state before the freezing. The cryogenic temperature may be understood to mean a temperature in a range of −45° C. to −50° C.

For this reason, in recent years, the demand for a refrigerator equipped with a deep freezing compartment that is maintained at a temperature lower than a temperature of the freezing compartment is increasing.

In order to satisfy the demand for the deep freezing compartment, there is a limit to the cooling using an existing refrigerant. Thus, an attempt is made to lower the temperature of the deep freezing compartment to a cryogenic temperature by using a thermoelectric module (TEM).

Korean Patent Publication No. 2018-0105572 (Sep. 28, 2018) (Prior Art 1) discloses a refrigerator having the form of a bedside table, in which a storage compartment has a temperature lower than the room temperature by using a thermoelectric module.

However, in the case of the refrigerator using the thermoelectric module disclosed in Prior Art 1, since a heat generation surface of the thermoelectric module is configured to be cooled by heat-exchanged with indoor air, there is a limitation in lowering a temperature of the heat absorption surface.

In detail, in the thermoelectric module, when supply current increases, a temperature difference between the heat absorption surface and the heat generation surface tends to increase to a certain level. However, due to characteristics of the thermoelectric element made of a semiconductor element, when the supply current increases, the semiconductor acts as resistance to increase in self-heat amount. Then, there is a problem that heat absorbed from the heat absorption surface is not transferred to the heat generation surface quickly.

In addition, if the heat generation surface of the thermoelectric element is not sufficiently cooled, a phenomenon in which the heat transferred to the heat generation surface flows back toward the heat absorption surface occurs, and a temperature of the heat absorption surface also rises.

In the case of the thermoelectric module disclosed in Prior Art 1, since the heat generation surface is cooled by the indoor air, there is a limit that the temperature of the heat generation surface is not lower than a room temperature.

In a state in which the temperature of the heat generation surface is substantially fixed, the supply current has to increase to lower the temperature of the heat absorption surface, and then efficiency of the thermoelectric module is deteriorated.

In addition, if the supply current increases, a temperature difference between the heat absorption surface and the heat generation surface increases, resulting in a decrease in the cooling capacity of the thermoelectric module.

Therefore, in the case of the refrigerator disclosed in Prior Art 1, it is impossible to lower the temperature of the storage compartment to a cryogenic temperature that is significantly lower than the temperature of the freezing compartment and may be said that it is only possible to maintain the temperature of the refrigerating compartment.

In addition, referring to the contents disclosed in Prior Art 1, since the storage compartment cooled by a thermoelectric module independently exists, when the temperature of the storage compartment reaches a satisfactory temperature, power supply to the thermoelectric module is cut off.

However, when the storage compartment is accommodated in a storage compartment having a different satisfactory temperature region such as a refrigerating compartment or a freezing compartment, factors to be considered in order to control the temperature of the two storage compartments increase.

Therefore, with only the control contents disclosed in Prior Art 1, it is impossible to control an output of the thermoelectric module and an output of a deep freezing compartment cooling fan in order to control the temperature of the deep freezing compartment in a structure in which the deep freezing compartment is accommodated in the freezing compartment or the refrigerating compartment.

In order to overcome limitations of the thermoelectric module and to lower the temperature of the storage compartment to a temperature lower than that of the freezing compartment by using the thermoelectric module, many experiments and studies have been conducted. As a result, in order to cool the heat generation surface of the thermoelectric module to a low temperature, an attempt has been made to attach an evaporator through which a refrigerant flows to the heat generation surface.

Korean Patent Publication No. 10-2016-097648 (Aug. 18, 2016) (Prior Art 2) discloses directly attaching a heat generation surface of a thermoelectric module to ab evaporator to cool the heat generation surface of the thermoelectric module.

However, Prior Art 2 still has problems.

In detail, in Prior Art 2, only structural contents of employing an evaporator through which a refrigerant passing through a freezing compartment expansion valve flows as a heat dissipation unit or heat sink for cooling the heat generation surface of the thermoelectric element are disclosed, and contents of how to control an output of the thermoelectric module according to operation states of the refrigerating compartment in addition to the freezing compartment are not disclosed at all.

For example, in the case of Prior Art 2, since the freezing compartment evaporator and the heat sink of the thermoelectric module are connected in parallel, the control method disclosed in Prior Art 2 is difficult to be applied to a system in which the freezing compartment evaporator and the heat sink are connected in series.

Particularly, in the case of Prior Art 2, since the heat sink and the freezing compartment evaporator are connected in parallel, the defrost operation of the thermoelectric module and the defrost operation of the freezing compartment evaporator may be independently performed. Thus, there is a problem in that the defrost operation control logic applied to Prior Art 2 may not be applied as it is to the structure in which the heat sink and the freezing compartment evaporator are connected in series.

In addition, in Prior Art 2, a specific method for how to solve the problem caused by vapor generated during the defrosting process in the deep freezing compartment and the freezing compartment is not disclosed.

As an example, there is no content on how to prevent or solve the problem, in which vapor generated in the defrost process is attached again to form frost on an inner wall of the deep freezing compartment, or a problem in which vapor is introduced into the freezing evaporation compartment and is attached to be concentrated onto one surface of the freezing compartment evaporator to form frost.

In addition, the contents of the structure or method for preventing the vapor generated during the defrost process of the freezing compartment from flowing into the deep freezing compartment or from being formed on the wall of the freezing evaporation compartment in contact with the deep freezing compartment are not disclosed at all.

DISCLOSURE OF THE INVENTION

Technical Problem

An object of the present invention is to provide a refrigerator having a refrigerant circulation system in which a heat sink and a freezing compartment evaporator are connected in series.

In more detail, an object of the present invention is to provide a refrigerator provided with a mean for preventing a phenomenon, in which vapor generated in a defrost process of a deep freezing compartment is attached to a surface of a defrost water drain hole, which connects a deep freezing compartment to a freezing compartment evaporation compartment, to interrupt drain of defrost water, from occurring.

Technical Solution

A refrigerator according to an embodiment of the present invention for achieving the above object includes: a refrigerating compartment; a freezing compartment partitioned from the refrigerating compartment; a deep freezing compartment accommodated in the freezing compartment and partitioned from the freezing compartment; and a freezing evaporation compartment provided behind the deep freezing compartment.

The refrigerator according to an embodiment of the present invention may further includes: a partition wall including a grille pan configured to partition the freezing evaporation compartment and the freezing compartment from each other and a shroud coupled to a rear surface of the grille pan to define a passage through which cold air of the freezing evaporation compartment is supplied to the freezing compartment.

The refrigerator according to an embodiment of the present invention may further includes: a freezing compartment evaporator accommodated in the freezing evaporation compartment to generate the cold air for cooling the freezing compartment; and a freezing compartment fan mounted on the shroud to supply the cold air of the freezing evaporation compartment to the freezing compartment.

The refrigerator according to an embodiment of the present invention may further includes: a thermoelectric module including: a thermoelectric element including a heat absorption surface facing the deep freezing compartment and a heat generation surface defined as an opposite surface of the heat absorption surface; a cold sink that is in contact with the heat absorption surface and disposed behind the deep freezing compartment; a heat sink that is in contact with the heat generation surface and connected in series to the freezing compartment evaporator; and a housing configured to accommodate the heat sink and having a rear surface exposed to the cold air of the freezing evaporation compartment.

The refrigerator according to an embodiment of the present invention may further includes: a deep freezing compartment fan disposed in front of the heat absorption surface to allow air within the deep freezing compartment to forcibly flow.

The refrigerator according to an embodiment of the present invention may further includes: a cold sink heater disposed under the cold sink.

The refrigerator according to an embodiment of the present invention may further includes: a back heater disposed at one side of a rear surface of the shroud.

Advantageous Effects

The refrigerator including the foregoing constitutions according to the embodiment of the present invention has following effects.

First, in the structure in which the heat sink and the freezing compartment evaporator are connected in series, and the deep freezing compartment is accommodated in the freezing compartment, there may be the advantage that the defrosting of the thermoelectric module and the defrosting of the freezing compartment evaporator may be effectively performed.

Second, there may be the effect capable of preventing the moisture contained in the cold air of the freezing evaporation compartment from being condensed on the defrosting water guide while the wet vapor generated in the deep freezing compartment defrost process is discharged to the freezing evaporation compartment through the defrost water guide. As a result, there may be the effect, in which the defrost water generated in the deep freezing compartment defrost process is quickly discharged and collected by the drain pan provided on the bottom of the freezing evaporation compartment or the bottom of the refrigerator machine room.

Third, with the start of defrosting in the deep freezing compartment and freezing compartment, the power may be applied to the back heater as well as the drain heater to prevent the formation of the frost on the defrost water guide from which the defrost water in the deep freezing compartment is discharged.

MODE FOR CARRYING OUT THE INVENTION

Figure 1:
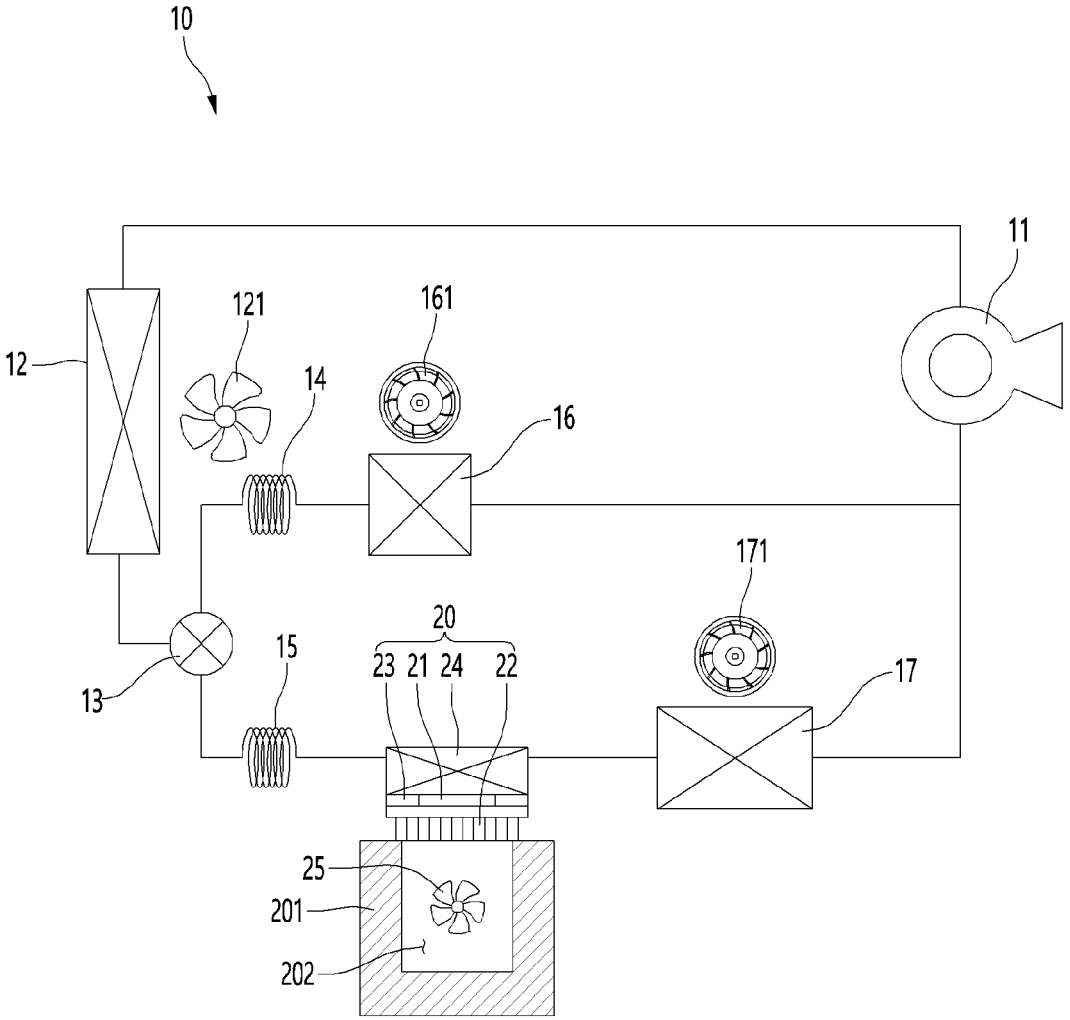
FIG. 1 is a view illustrating a refrigerant circulation system of a refrigerator according to an embodiment of the present invention.

Hereinafter, a method for controlling a refrigerator according to an embodiment of the present invention will be described in detail with reference to the accompanying drawings.

In the present invention, a storage compartment that is cooled by a first cooling device and controlled to a predetermined temperature may be defined as a first storage compartment.

In addition, a storage compartment that is cooled by a second cooling device and is controlled to a temperature lower than that of the first storage compartment may be defined as a second storage compartment.

In addition, a storage compartment that is cooled by the third cooling device and is controlled to a temperature lower than that of the second storage compartment may be defined as a third storage compartment.

The first cooling device for cooling the first storage compartment may include at least one of a first evaporator or a first thermoelectric module including a thermoelectric element. The first evaporator may include a refrigerating compartment evaporator to be described later.

The second cooling device for cooling the second storage compartment may include at least one of a second evaporator or a second thermoelectric module including a thermoelectric element. The second evaporator may include a freezing compartment evaporator to be described later.

The third cooling device for cooling the third storage compartment may include at least one of a third evaporator or a third thermoelectric module including a thermoelectric element.

In the embodiments in which the thermoelectric module is used as a cooling means in the present specification, it may be applied by replacing the thermoelectric module with an evaporator, for example, as follows.

(1) "Cold sink of thermoelectric module", "heat absorption surface of thermoelectric module" or "heat absorption side of thermoelectric module" may be interpreted as "evaporator or one side of the evaporator".

(2) "Heat absorption side of thermoelectric module" may be interpreted as the same meaning as "cold sink of thermoelectric module" or "heat absorption side of thermoelectric module".

(3) An electronic controller (processor) "applies or cuts off a constant voltage to the thermoelectric module" may be interpreted as the same meaning as being controlled to "supply or block a refrigerant to the evaporator", "control a switching valve to be opened or closed", or "control a compressor to be turned on or off".

(4) "Controlling the constant voltage applied to the thermoelectric module to increase or decrease" by the controller may be interpreted as the same meaning as "controlling an amount or flow rate of the refrigerant flowing in the evaporator to increase or decrease", "controlling allowing an opening degree of the switching valve to increase or decrease", or "controlling an output of the compressor to increase or decrease".

(5) "Controlling a reverse voltage applied to the thermoelectric module to increase or decrease" by the controller is interpreted as the same meaning as "controlling a voltage applied to the defrost heater adjacent to the evaporator to increase or decrease".

In the present specification, "storage compartment cooled by the thermoelectric module" is defined as a storage compartment A, and "fan located adjacent to the thermoelectric module so that air inside the storage compartment A is heat-exchanged with the heat absorption surface of the thermoelectric module" may be defined as "storage compartment fan A".

Also, a storage compartment cooled by the cooling device while constituting the refrigerator together with the storage compartment A may be defined as "storage compartment B".

In addition, a "cooling device compartment" may be defined as a space in which the cooling device is disposed, in a structure in which the fan for blowing cool air generated by the cooling device is added, the cooling device compartment may be defined as including a space in which the fan is accommodated, and in a structure in which a passage for guiding the cold air blown by the fan to the storage compartment or a passage through which defrost water is discharged is added may be defined as including the passages.

In addition, a defrost heater disposed at one side of the cold sink to remove frost or ice generated on or around the cold sink may be defined as a cold sink defrost heater.

In addition, a defrost heater disposed at one side of the heat sink to remove frost or ice generated on or around the heat sink may be defined as a heat sink defrost heater.

In addition, a defrost heater disposed at one side of the cooling device to remove frost or ice generated on or around the cooling device may be defined as a cooling device defrost heater.

In addition, a defrost heater disposed at one side of a wall surface forming the cooling device chamber to remove frost or ice generated on or around the wall surface forming the cooling device chamber may be defined as a cooling device chamber defrost heater.

In addition, a heater disposed at one side of the cold sink may be defined as a cold sink drain heater in order to minimize refreezing or re-implantation in the process of discharging defrost water or vapor melted in or around the cold sink.

In addition, a heater disposed at one side of the heat sink may be defined as a heat sink drain heater in order to minimize refreezing or re-implantation in the process of discharging defrost water or vapor melted in or around the heat sink.

In addition, a heater disposed at one side of the cooling device may be defined as a cooling device drain heater in order to minimize refreezing or re-implantation in the process of discharging defrost water or vapor melted in or around the cooling device.

In addition, in the process of discharging the defrost water or vapor melted from or around the wall forming the cooling device chamber, a heater disposed at one side of the wall forming the cooling device chamber may be defined as a cooling device chamber drain heater in order to minimize refreezing or re-implantation.

Also, a "cold sink heater" to be described below may be defined as a heater that performs at least one of a function of the cold sink defrost heater or a function of the cold sink drain heater.

In addition, the "heat sink heater" may be defined as a heater that performs at least one of a function of the heat sink defrost heater or a function of the heat sink drain heater.

In addition, the "cooling device heater" may be defined as a heater that performs at least one of a function of the cooling device defrost heater or a function of the cooling device drain heater.

In addition, a "back heater" to be described below may be defined as a heater that performs at least one of a function of the heat sink heater or a function of the cooling device chamber defrost heater. That is, the back heater may be defined as a heater that performs at least one function among the functions of the heat sink defrost heater, the heater sink drain heater, and the cooling device chamber defrost heater.

In the present invention, as an example, the first storage compartment may include a refrigerating compartment that is capable of being controlled to a zero temperature by the first cooling device.

In addition, the second storage compartment may include a freezing compartment that is capable of being controlled to a temperature sub-zero by the second cooling device.

In addition, the third storage compartment may include a deep freezing compartment that is capable of being maintained at a cryogenic temperature or an ultrafrezing temperature by the third cooling device.

In the present invention, a case in which all of the third to third storage compartments are controlled to a temperature sub-zero, a case in which all of the first to third storage compartments are controlled to a zero temperature, and a case in which the first and second storage compartments are controlled to the zero temperature, and the third storage compartment is controlled to the temperature sub-zero are not excluded.

In the present invention, an "operation" of the refrigerator may be defined as including four processes such as a process (I) of determining whether an operation start condition or an operation input condition is satisfied, a process (II) of performing a predetermined operation when the operation input condition is satisfied, a process (III) of determining whether an operation completion condition is satisfied, and a process (IV) of terminating the operation when the operation completion condition is satisfied.

In the present invention, an "operation" for cooling the storage compartment of the refrigerator may be defined by being divided into a normal operation and a special operation.

The normal operation may be referred to as a cooling operation performed when an internal temperature of the refrigerator naturally increases in a state in which the storage compartment door is not opened, or a load input condition due to food storage does not occur.

In detail, when the temperature of the storage compartment enters an unsatisfactory temperature region (described below in detail with reference to the drawings), and the operation input condition is satisfied, the controller controls the cold air to be supplied from the cooling device of the storage compartment so as to cool the storage compartment.

Specifically, the normal operation may include a refrigerating compartment cooling operation, a cooling operation of the freezing compartment, a cooling operation of the deep freezing compartment, and the like.

On the other hand, the special operation may mean an operation other than the operations defined as the normal operation.

In detail, the special operation may include a defrost operation controlled to supply heat to the cooling device so as to melt the frost or ice deposited on the cooling device after a defrost period of the storage compartment elapses.

In addition, the special operation may further include a load correspondence operation for controlling the cold air to be supplied from the cooling device to the storage compartment so as to remove a heat load penetrated into the storage compartment when a set time elapses from a time when a door of the storage compartment is opened and closed, or when a temperature of the storage compartment rises to a set temperature before the set time elapses.

In detail, the load correspondence operation includes a door load correspondence operation performed to remove a load penetrated into the storage compartment after opening and closing of the storage compartment door, and an initial cold start operation performed to remove a load correspondence operation performed to remove a load inside the storage compartment when power is first applied after installing the refrigerator.

For example, the defrost operation may include at least one of a refrigerating compartment defrost operation, a freezing compartment defrost operation, and a defrost operation of the deep freezing compartment.

Also, the door load correspondence operation may include at least one of a refrigerating compartment door load correspondence operation, a freezing compartment door load correspondence operation, and a deep freezing compartment load correspondence operation.

Here, the deep freezing compartment load correspondence operation may be interpreted as an operation for removing the deep freezing compartment load, which is performed when at least one condition of the deep freezing compartment door load correspondence input condition performed when the load increases due to the opening of the door of the deep freezing compartment, the initial cold start operation input condition preformed to remove the load within the deep freezing compartment when the deep freezing compartment is switched from an on state to an off state, or the operation input condition after the defrost that initially stats after the defrost operation of the deep freezing compartment is completed.

In detail, determining whether the operation input condition corresponding to the load of the deep freezing compartment door is satisfied may include determining whether at least one of a condition in which a predetermined amount of time elapses from at time point at which at least one of the freezing compartment door and the deep freezing compartment door is closed after being opened, or a condition in which a temperature of the deep freezing compartment rises to a set temperature within a predetermined time is satisfied.

In addition, determining whether the initial cold start operation input condition for the deep freezing compartment is satisfied may include determining whether the refrigerator is powered on, and the deep freezing compartment mode is switched from the off state to the on state.

In addition, determining whether the operation input condition is satisfied after the deep freezing compartment defrost may include determining at least one of stopping of the reverse voltage applied to the thermoelectric module for cold sink heater off, back heater off, cold sink defrost, stopping of the constant voltage applied to the thermoelectric module for the heat sink defrost after the reverse voltage is applied for the cold sink defrost, an increase of a temperature of a housing accommodating the heat sink to a set temperature, or ending of the defrost operation of the freezing compartment.

Thus, the operation of the storage compartment including at least one of the refrigerating compartment, the freezing compartment, or the deep freezing compartment may be summarized as including the normal storage compartment operation and the storage compartment special operation.

When two operations conflict with each other during the operation of the storage compartment described above, the controller may control one operation (operation A) to be performed preferentially and the other operation (operation B) to be paused.

In the present invention, the conflict of the operations may include i) a case in which an input condition for the operation A and an input condition for the operation B are satisfied at the same time to conflict with each other, a case in which the input condition for the operation B is satisfied while the input condition for the operation A is satisfied to perform the operation A to conflict with each other, and a case in which the input condition for operation A is satisfied while the input condition for the operation B is satisfied to perform the operation B to conflict with each other.

When the two operations conflict with each other, the controller determines the performance priority of the conflicting operations to perform a so-called "conflict control algorithm" to be executed in order to control the performance of the correspondence operation.

A case in which the operation A is performed first, and the operation B is stopped will be described as an example.

In detail, in the present invention, the paused operation B may be controlled to follow at least one of the three cases of the following example after the completion of the operation A.

a. Termination of Operation B

When the operation A is completed, the performance of the operation B may be released to terminate the conflict control algorithm and return to the previous operation process.

Here, the "release" does not determine whether the paused operation B is not performed any more, and whether the input condition for the operation B is satisfied. That is, it is seen that the determination information on the input condition for the operation B is initialized.

b. Redetermination of Input Condition for Operation B

When the firstly performed operation A is completed, the controller may return to the process of determining again whether the input condition for the paused operation B is satisfied, and determine whether the operation B restarts.

For example, if the operation B is an operation in which the fan is driven for 10 minutes, and the operation is stopped when 3 minutes elapses after the start of the operation due to the conflict with the operation A, it is determined again whether the input condition for the operation B is satisfied at a time point at which the operation A is completed, and if it is determined to be satisfied, the fan is driven again for 10 minutes.

c. Continuation of Operation B

When the firstly performed operation A is completed, the controller may allow the paused operation B to be continued. Here, "continuation" means not to start over from the beginning, but to continue the paused operation.

For example, if the operation B is an operation in which the fan is driven for 10 minutes, and the operation is paused after 3 minutes elapses after the start of the operation due to the conflict with operation A, the compressor is further driven for the remaining time of 7 minutes immediately after the operation A is completed.

In the present invention, the priority of the operations may be determined as follows.

First, when the normal operation and the special operation conflict with each other, it is possible to control the special operation to be performed preferentially.

Second, when the conflict between the normal operations occurs, the priority of the operations may be determined as follows.

I. When the refrigerating compartment cooling operation and the cooling operation of the freezing compartment conflict with each other, the refrigerating compartment cooling operation may be performed preferentially.

II. When the refrigerating compartment (or freezing compartment) cooling operation and the cooling operation of the deep freezing compartment conflict with each other, the refrigerating compartment (or freezing compartment) cooling operation may be performed preferentially. Here, in order to prevent the deep freezing compartment temperature from rising excessively, cooling capacity having a level lower than that of maximum cooling capacity of the deep freezing compartment cooling device may be supplied from the deep freezing compartment cooling device to the deep freezing compartment.

The cooling capacity may mean at least one of cooling capacity of the cooling device itself and an airflow amount of the cooling fan disposed adjacent to the cooling device. For example, when the cooling device of the deep freezing compartment is the thermoelectric module, the controller may perform the refrigerating compartment (or freezing compartment) cooling operation by priority when the refrigerating compartment (or freezing compartment) cooling operation and the cooling operation of the deep freezing compartment conflict with each other. Here, a voltage lower than a maximum voltage that is capable of being applied to the thermoelectric module may be input into the thermoelectric module.

Third, when the conflict between special operations occurs, the priority of the operations may be determined as follows.

I. When a refrigerating compartment door load correspondence operation conflicts with a freezing compartment door load correspondence operation, the controller may control the refrigerating compartment door load correspondence operation to be performed by priority.

II. When the freezing compartment door load correspondence operation conflicts with the deep freezing compartment door load correspondence operation, the controller may control the deep freezing compartment door load correspondence operation to be performed by priority.

III. If the refrigerating compartment operation and the deep freezing compartment door load correspondence operation conflict with each other, the controller may control the refrigerating compartment operation and the deep freezing compartment door load correspondence operation so as to be performed at the same time. Then, when the temperature of the refrigerating compartment reaches a specific temperature a, the controller may control the deep freezing compartment door load correspondence operation so as to be performed exclusively. When the refrigerating compartment temperature rises again to reach a specific temperature b ($a<b$) while the deep freezing compartment door load correspondence operation is performed independently, the controller may control the refrigerating compartment operation and the deep freezing compartment door load correspondence operation so as to be performed at the same time. Thereafter, an operation switching process between the simultaneous operation of the deep freezing compartment and the refrigerating compartment and the exclusive operation of the deep freezing compartment may be controlled to be repeatedly performed according to the temperature of the refrigerating compartment.

As an extended modified example, when the operation input condition for the deep freezing compartment load correspondence operation is satisfied, the controller may control the operation to be performed in the same manner as when the refrigerating compartment operation and the deep freezing compartment door load correspondence operation conflict with each other.

Hereinafter, as an example, the description is limited to the case in which the first storage compartment is the refrigerating compartment, the second storage compartment is the freezing compartment, and the third storage compartment is the deep freezing compartment.

FIG. 1 is a view illustrating a refrigerant circulation system of a refrigerator according to an embodiment of the present invention.

Referring to FIG. 1, a refrigerant circulation system according to an embodiment of the present invention includes a compressor 11 that compresses a refrigerant into a high-temperature and high-pressure gaseous refrigerant, a condenser 12 that condenses the refrigerant discharged from the compressor 11 into a high-temperature and high-pressure liquid refrigerant, an expansion valve that expands the refrigerant discharged from the condenser 12 into a low-temperature and low-pressure two-phase refrigerant, and an evaporator that evaporates the refrigerant passing through the expansion valve into a low-temperature and low-pressure gaseous refrigerant. The refrigerant discharged from the evaporator flows into the compressor 11. The above components are connected to each other by a refrigerant pipe to constitute a closed circuit.

In detail, the expansion valve may include a refrigerating compartment expansion valve 14 and a freezing compartment expansion valve 15. The refrigerant pipe is divided into two branches at an outlet side of the condenser 12, and the refrigerating compartment expansion valve 14 and the freezing compartment expansion valve 15 are respectively connected to the refrigerant pipe that is divided into the two branches. That is, the refrigerating compartment expansion valve 14 and the freezing compartment expansion valve 15 are connected in parallel at the outlet of the condenser 12.

A switching valve 13 is mounted at a point at which the refrigerant pipe is divided into the two branches at the outlet side of the condenser 12. The refrigerant passing through the condenser 12 may flow through only one of the refrigerating compartment expansion valve 14 and the freezing compartment expansion valve 15 by an operation of adjusting an opening degree of the switching valve 13 or may flow to be divided into both sides.

The switching valve 13 may be a three-way valve, and a flow direction of the refrigerant is determined according to an operation mode. Here, one switching valve such as the three-way valve may be mounted at an outlet of the condenser to control the flow direction of the refrigerant, or alternatively, the switching valves are mounted at inlet sides of a refrigerating compartment expansion valve 14 and a freezing compartment expansion valve 15, respectively.

As a first example of an evaporator arrangement manner, the evaporator may include a refrigerating compartment evaporator 16 connected to an outlet side of the refrigerating compartment expansion valve 14 and a heat sink and a freezing compartment evaporator 17, which are connected in series to an outlet side of the freezing compartment expansion valve 15. The heat sink 24 and the freezing compartment evaporator 17 are connected in series, and the refrigerant passing through the freezing compartment expansion valve passes through the heat sink 24 and then flows into the freezing compartment evaporator 17.

As a second example, the heat sink 24 may be disposed at an outlet side of the freezing compartment evaporator 17 so that the refrigerant passing through the freezing compartment evaporator 17 flows into the heat sink 24.

As a third example, a structure in which the heat sink 24 and the freezing compartment evaporator 17 are connected in parallel at an outlet end of the freezing compartment expansion valve 15 is not excluded.

Although the heat sink 24 is the evaporator, it is provided for the purpose of cooling a heat generation surface of the thermoelectric module to be described later, not for the purpose of heat-exchange with the cold air of the deep freezing compartment.

In each of the three examples described above with respect to the arrangement manner of the evaporator, a complex system of a first refrigerant circulation system, in which the switching valve 13, the refrigerating compartment expansion valve 14, and the refrigerating compartment evaporator 16 are removed, and a second refrigerant circulation system constituted by the refrigerating compartment cooling evaporator, the refrigerating compartment cooling expansion valve, the refrigerating compartment cooling condenser, and a refrigerating compartment cooling compressor is also possible. Here, the condenser constituting the first refrigerant circulation system and the condenser constituting the second refrigerant circulation system may be independently provided, and a complex condenser which is provided as a single body and in which the refrigerant is not mixed may be provided.

The refrigerant circulation system of the refrigerator having the two storage compartments including the deep freezing compartment may be configured only with the first refrigerant circulation system.

Hereinafter, as an example, the description will be limited to a structure in which the heat sink and the freezing compartment evaporator 17 are connected in series.

A condensing fan 121 is mounted adjacent to the condenser 12, a refrigerating compartment fan 161 is mounted adjacent to the refrigerating compartment evaporator 16, and a freezing compartment fan 171 is mounted adjacent to the freezing compartment evaporator 17.

A refrigerating compartment maintained at a refrigerating temperature by cold air generated by the refrigerating compartment evaporator 16, a freezing compartment maintained at a freezing temperature by cold air generated by the freezing compartment evaporator 16, and a deep freezing compartment 202 maintained at a cryogenic or ultrafrezing temperature by a thermoelectric module to be described later are formed inside the refrigerator provided with the refrigerant circulation system according to the embodiment of the present invention. The refrigerating compartment and the freezing compartment may be disposed adjacent to each other in a vertical direction or horizontal direction and are partitioned from each other by a partition wall. The deep freezing compartment may be provided at one side of the inside of the freezing compartment, but the present invention includes the deep freezing compartment provided at one side of the outside of the freezing compartment. In order to block the heat exchange between the cold air of the deep freezing compartment and the cold air of the freezing compartment, the deep freezing compartment 202 may be partitioned from the freezing compartment by a deep freezing case 201 having the high thermal insulation performance.

In addition, the thermoelectric module includes a thermoelectric element 21 having one side through which heat is absorbed and the other side through which heat is released when power is supplied, a cold sink 22 mounted on the heat absorption surface of the thermoelectric element 21, a heat sink mounted on the heat generation surface of the thermoelectric element 21, and an insulator 23 that blocks heat exchange between the cold sink 22 and the heat sink.

Here, the heat sink 24 is an evaporator that is in contact with the heat generation surface of the thermoelectric element 21. That is, the heat transferred to the heat generation surface of the thermoelectric element 21 is heat-exchanged with the refrigerant flowing inside the heat sink 24. The refrigerant flowing along the inside of the heat sink 24 and absorbing heat from the heat generation surface of the thermoelectric element 21 is introduced into the freezing compartment evaporator 17.

In addition, a cooling fan may be provided in front of the cold sink 22, and the cooling fan may be defined as the deep freezing compartment fan 25 because the fan is disposed behind the inside of the deep freezing compartment.

The cold sink 22 is disposed behind the inside of the deep freezing compartment 202 and configured to be exposed to the cold air of the deep freezing compartment 202. Thus, when the deep freezing compartment fan 25 is driven to forcibly circulate cold air in the deep freezing compartment 202, the cold sink 22 absorbs heat through heat-exchange with the cold air in the deep freezing compartment and then is transferred to the heat absorption surface of the thermoelectric element 21. The heat transferred to the heat absorption surface is transferred to the heat generation surface of the thermoelectric element 21.

The heat sink 24 functions to absorb the heat absorbed from the heat absorption surface of the thermoelectric element 21 and transferred to the heat generation surface of the thermoelectric element 21 again to release the heat to the outside of the thermoelectric module 20.

Figure 2:
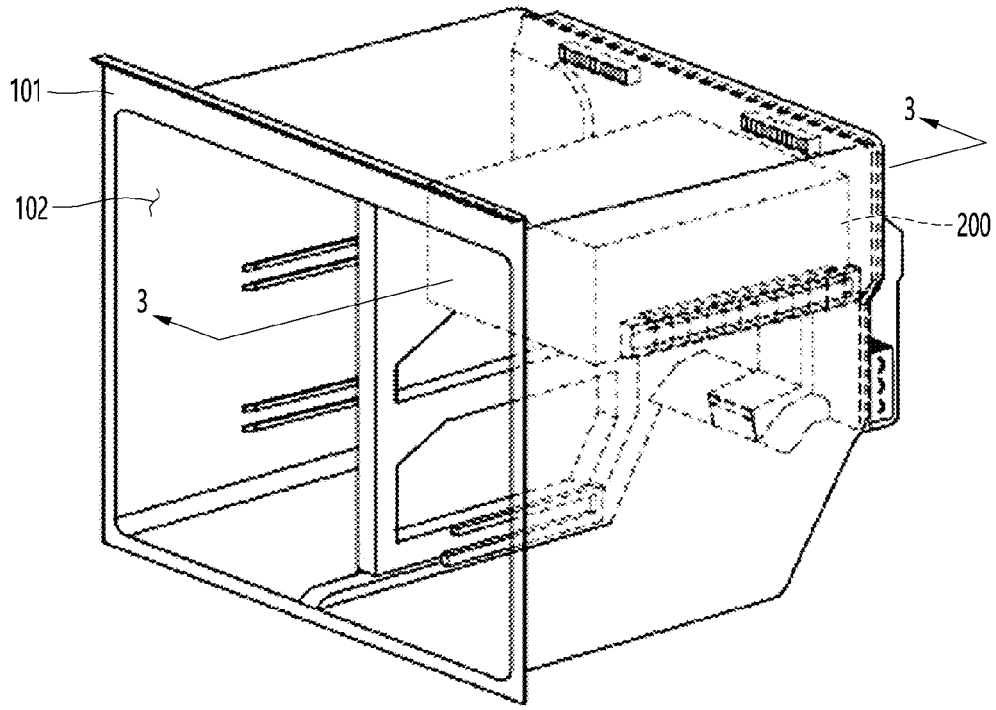
FIG. 2 is a perspective view illustrating structures of a freezing compartment and a deep freezing compartment of the refrigerator according to an embodiment of the present invention.
Figure 3:
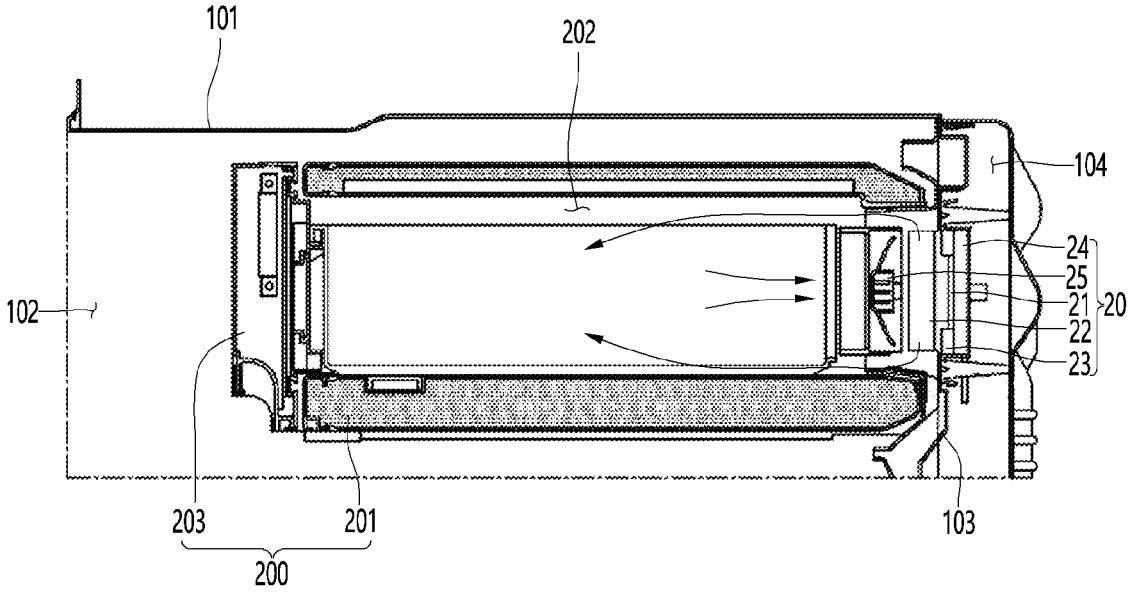
FIG. 3 is a longitudinal cross-sectional view taken along line 3-3 of FIG. 2.

FIG. 2 is a perspective view illustrating structures of the freezing compartment and the deep freezing compartment of the refrigerator according to an embodiment of the present invention, and FIG. 3 is a longitudinal cross-sectional view taken along line 3-3 of FIG. 2.

Referring to FIGS. 2 and 3, the refrigerator according to an embodiment of the present invention includes an inner case 101 defining the freezing compartment 102 and a deep freezing unit 200 mounted at one side of the inside of the freezing compartment 102.

In detail, the inside of the refrigerating compartment is maintained to a temperature of about 3° C., and the inside of the freezing compartment 102 is maintained to a temperature of about −18° C., whereas a temperature inside the deep freezing unit 200, i.e., an internal temperature of the deep freezing compartment 202 has to be maintained to about −50° C. Therefore, in order to maintain the internal temperature of the deep freezing compartment 202 at a cryogenic temperature of −50° C., an additional freezing means such as the thermoelectric module 20 is required in addition to the freezing compartment evaporator.

In more detail, the deep freezing unit 200 includes a deep freezing case 201 that forms a deep freezing compartment 202 therein, a deep freezing compartment drawer 203 slidably inserted into the deep freezing case 201, and a thermoelectric module 20 mounted on a rear surface of the deep freezing case 201.

Instead of applying the deep freezing compartment drawer 203, a structure in which a deep freezing compartment door is connected to one side of the front side of the deep freezing case 201, and the entire inside of the deep freezing compartment 201 is configured as a food storage space is also possible.

In addition, the rear surface of the inner case 101 is stepped backward to form a freezing evaporation compartment 104 in which the freezing compartment evaporator 17 is accommodated. In addition, an inner space of the inner case 101 is divided into the freezing evaporation compartment 104 and the freezing compartment 102 by the partition wall 103. The thermoelectric module 20 is fixedly mounted on a front surface of the partition wall 103, and a portion of the thermoelectric module 20 passes through the deep freezing case 201 and is accommodated in the deep freezing compartment 202.

In detail, the heat sink 24 constituting the thermoelectric module 20 may be an evaporator connected to the freezing compartment expansion valve 15 as described above. A space in which the heat sink 24 is accommodated may be formed in the partition wall 103.

Since the two-phase refrigerant cooled to a temperature of about −18° C. to −20° C. while passing through the freezing compartment expansion valve 15 flows inside the heat sink 24, a surface temperature of the heat sink 24 may be maintained to a temperature of −18° C. to −20° C. Here, it is noted that a temperature and pressure of the refrigerant passing through the freezing compartment expansion valve 15 may vary depending on the freezing compartment temperature condition.

When a rear surface of the thermoelectric element 21 is in contact with a front surface of the heat sink 24, and power is applied to the thermoelectric element 21, the rear surface of the thermoelectric element 21 becomes a heat generation surface.

When the cold sink 22 is in contact with a front surface of the thermoelectric element, and power is applied to the thermoelectric element 21, the front surface of the thermoelectric element 21 becomes a heat absorption surface.

The cold sink 22 may include a heat conduction plate made of an aluminum material and a plurality of heat exchange fins extending from a front surface of the heat conduction plate. Here, the plurality of heat exchange fins extend vertically and are disposed to be spaced apart from each other in a horizontal direction.

Here, when a housing surrounding or accommodating at least a portion of a heat conductor constituted by the heat conduction plate and the heat exchange fin is provided, the cold sink 22 has to be interpreted as a heat transfer member including the housing as well as the heat conductor. This is equally applied to the heat sink 22, and the heat sink 22 has be interpreted not only as the heat conductor constituted by the heat conduction plate and the heat exchange fin, but also as the heat transfer member including the housing when a housing is provided.

The deep freezing compartment fan 25 is disposed in front of the cold sink 22 to forcibly circulate air inside the deep freezing compartment 202.

Hereinafter, efficiency and cooling capacity of the thermoelectric element will be described.

The efficiency of the thermoelectric module 20 may be defined as a coefficient of performance (COP), and an efficiency equation is as follows.

$$COP = \frac{Q_c}{P_e}$$

Qc: Cooling Capacity (ability to absorb heat)

Pe: Input Power (power supplied to thermoelectric element)

$P_e = V \times i$

In addition, the cooling capacity of the thermoelectric module 20 may be defined as follows.

$$Q_c = \alpha T_c i - \frac{1}{2}\frac{\rho L}{A} i^2 - \frac{kA}{L}(T_h - T_c)$$

<Semiconductor Material Property Coefficient>

α: Seebeck Coefficient [V/K]

ρ: Specific Resistance [Ωm-1]

k: Thermal conductivity [Ωm-1]

<Semiconductor Structure Characteristics>

L: Thickness of thermoelectric element: Distance between heat absorption surface and heat generation surface A: Area of thermoelectric element <System Use Condition> i: Current

V: Voltage

Th: Temperature of heat generation surface of thermoelectric element

Tc: Temperature of heat absorption surface of thermoelectric module

In the above cooling capacity equation, a first item at the right may be defined as a Peltier Effect and may be defined as an amount of heat transferred between both ends of the heat absorption surface and the heat generation surface by a voltage difference. The Peltier effect increases in proportional to supply current as a function of current.

In the formula V=iR, since a semiconductor constituting the thermoelectric module acts as resistance, and the resistance may be regarded as a constant, it may be said that a voltage and current have a proportional relationship. That is, when the voltage applied to the thermoelectric module 21 increases, the current also increases. Accordingly, the Peltier effect may be seen as a current function or as a voltage function.

The cooling capacity may also be seen as a current function or a voltage function. The Peltier effect acts as a positive effect of increasing in cooling capacity. That is, as the supply voltage increases, the Peltier effect increases to increase in cooling capacity.

The second item in the cooling capacity equation is defined as a Joule Effect.

The Joule effect means an effect in which heat is generated when current is applied to a resistor. In other words, since heat is generated when power is supplied to the thermoelectric module, this acts as a negative effect of reducing the cooling capacity. Therefore, when the voltage supplied to the thermoelectric module increases, the Joule effect increases, resulting in lowering of the cooling capacity of the thermoelectric module.

The third item in the cooling capacity equation is defined as a Fourier effect.

The Fourier effect means an effect in which heat is transferred by heat conduction when a temperature difference occurs on both surfaces of the thermoelectric module.

In detail, the thermoelectric module includes a heat absorption surface and a heat generation surface, each of which is provided as a ceramic substrate, and a semiconductor disposed between the heat absorption surface and the heat generation surface. When a voltage is applied to the thermoelectric module, a temperature difference is generated between the heat absorption surface and the heat generation surface. The heat absorbed through the heat absorption surface passes through the semiconductor and is transferred to the heat generation surface. However, when the temperature difference between the heat absorption surface and the heat absorption surface occurs, a phenomenon in which heat flows backward from the heat generation surface to the heat absorption surface by heat conduction occurs, which is referred to as the Fourier effect.

Like the Joule effect, the Fourier effect acts as a negative effect of lowering the cooling capacity. In other words, when the supply current increases, the temperature difference (Th−Tc) between the heat generation surface and the heat absorption surface of the thermoelectric module, i.e., a value ΔT, increases, resulting in lowering of the cooling capacity.

Figure 4:
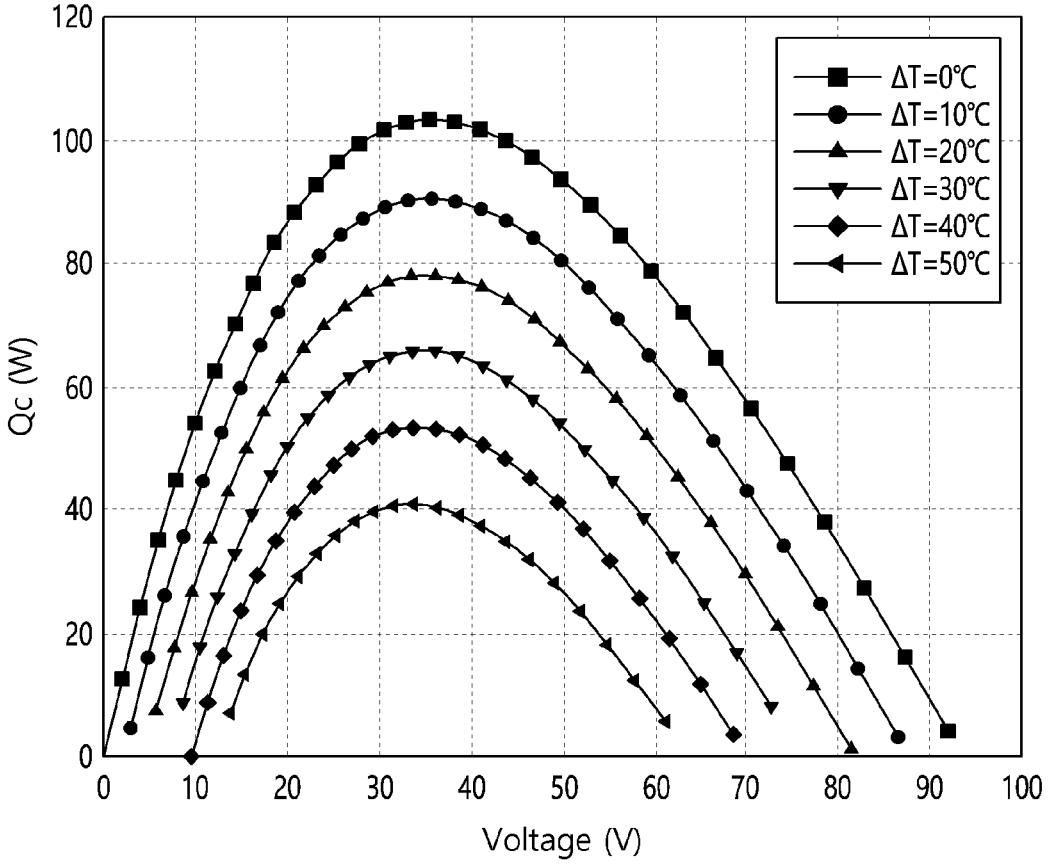
FIG. 4 is a graph illustrating a relationship of cooling capacity with respect to an input voltage and a Fourier effect.

FIG. 4 is a graph illustrating a relationship of cooling capacity with respect to the input voltage and the Fourier effect.

Referring to FIG. 4, the Fourier effect may be defined as a function of the temperature difference between the heat absorption surface and the heat generation surface, that is, a value ΔT.

In detail, when specifications of the thermoelectric module are determined, values k, A, and L in the item of the Fourier effect in the above cooling capacity equation become constant values, and thus, the Fourier effect may be seen as a function with the value ΔT as a variable.

Therefore, as the value ΔT increases, the value of the Fourier effect increases, but the Fourier effect acts as a negative effect on the cooling capacity, and thus the cooling capacity decreases.

As shown in the graph of FIG. 4, it is seen that the greater the value ΔT under the constant voltage condition, the less the cooling capacity.

In addition, when the value ΔT is fixed, for example, when ΔT is 30° C., a change in cooling capacity according to a change of the voltage is observed. As the voltage value increases, the cooling capacity increases and has a maximum value at a certain point and then decreases again.

Here, since the voltage and current have a proportional relationship, it should be noted that it is no matter to view the current described in the cooling capacity equation as the voltage and be interpreted in the same manner.

In detail, the cooling capacity increases as the supply voltage (or current) increases, which may be explained by the above cooling capacity equation. First, since the value ΔT is fixed, the value ΔT becomes a constant. Since the ΔT value for each standard of the thermoelectric module is determined, an appropriate standard of the thermoelectric module may be set according to the required value ΔT.

Since the value ΔT is fixed, the Fourier effect may be seen as a constant, and the cooling capacity may be simplified into a function of the Peltier effect, which is seen as a first-order function of the voltage (or current), and the Joule effect, which is seen as a second-order function of the voltage (or current).

As the voltage value gradually increases, an amount of increase in Peltier effect, which is the first-order function of the voltage, is larger than that of increase in Joule effect, which is the second-order function, of voltage, and consequently, the cooling capacity increases. In other words, until the cooling capacity is maximized, the function of the Joule effect is close to a constant, so that the cooling capacity approaches the first-order function of the voltage.

As the voltage further increases, it is seen that a reversal phenomenon, in which a self-heat generation amount due to the Joule effect is greater than a transfer heat amount due to the Peltier effect, occurs, and as a result, the cooling capacity decreases again. This may be more clearly understood from the functional relationship between the Peltier effect, which is the first-order function of the voltage (or current), and the Joule effect, which is the second-order function of the voltage (or current). That is, when the cooling capacity decreases, the cooling capacity is close to the second-order function of the voltage.

In the graph of FIG. 4, it is confirmed that the cooling capacity is maximum when the supply voltage is in a range of about 30 V to about 40 V, more specifically, about 35 V. Therefore, if only the cooling capacity is considered, it is said that it is preferable to generate a voltage difference within a range of 30 V to 40V in the thermoelectric module.

Figure 5:
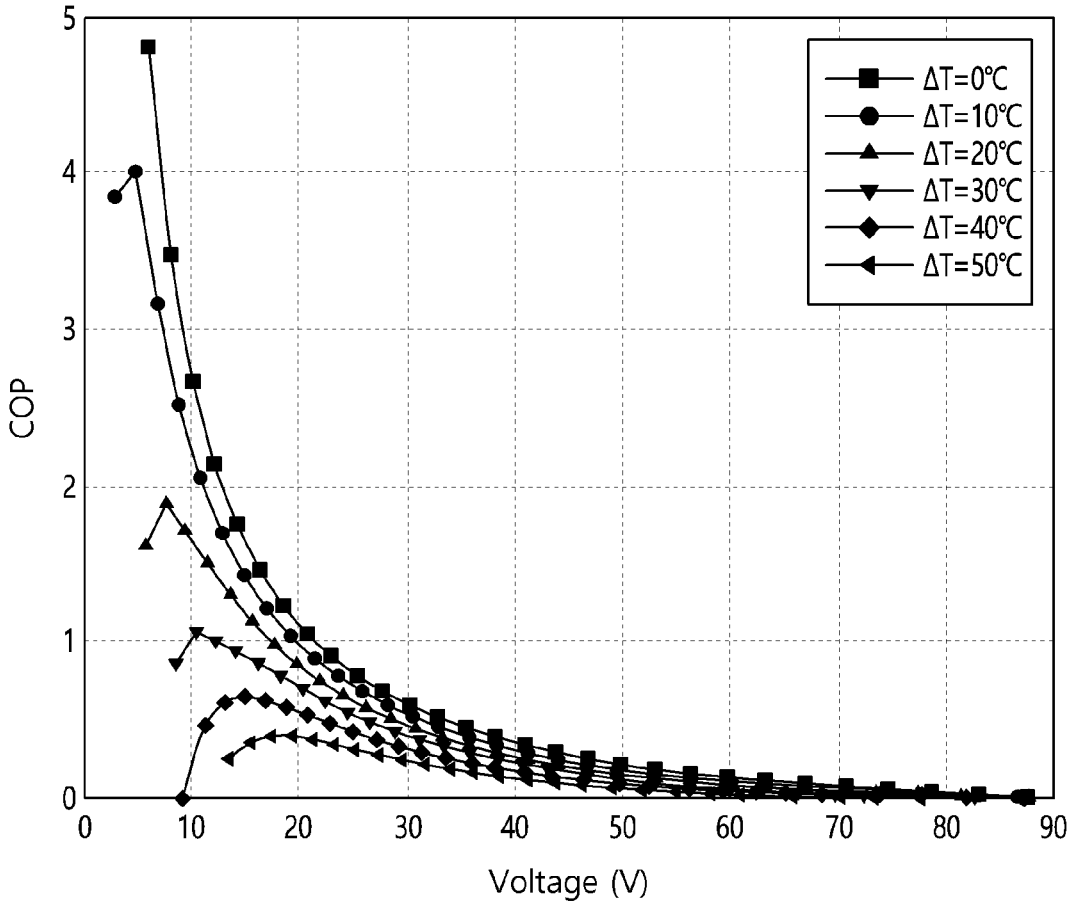
FIG. 5 is a graph illustrating a relationship of efficiency with respect to an input voltage and a Fourier effect.

FIG. 5 is a graph illustrating a relationship of efficiency with respect to the input voltage and the Fourier effect.

Referring to FIG. 5, it is seen that the higher the value ΔT, the lower the efficiency at the same voltage. This will be noted as a natural result because the efficiency is proportional to the cooling capacity.

In addition, when the value ΔT is fixed, for example, when the value ΔT is limited to 30° C. and the change in efficiency according to the change in voltage is observed, the efficiency increases as the supply voltage increases, and the efficiency decreases after a certain time point elapses. This is said to be similar to the graph of the cooling capacity according to the change of the voltage.

Here, the efficiency (COP) is a function of input power as well as cooling capacity, and the input Pe becomes a function of $V^2$ when the resistance of the thermoelectric module 21 is considered as the constant. If the cooling capacity is divided by $V^2$, the efficiency may be expressed as Peltier effect−Peltier effect/$V^2$. Therefore, it is seen that the graph of the efficiency has a shape as illustrated in FIG. 5.

It is seen from the graph of FIG. 5, in which a point at which the efficiency is maximum appears in a region in which the voltage difference (or supply voltage) applied to the thermoelectric module is less than about 20 V. Therefore, when the required value ΔT is determined, it is good to apply an appropriate voltage according to the value to maximize the efficiency. That is, when a temperature of the heat sink and a set temperature of the deep freezing compartment 202 are determined, the value ΔT is determined, and accordingly, an optimal difference of the voltage applied to the thermoelectric module may be determined.

Figure 6:
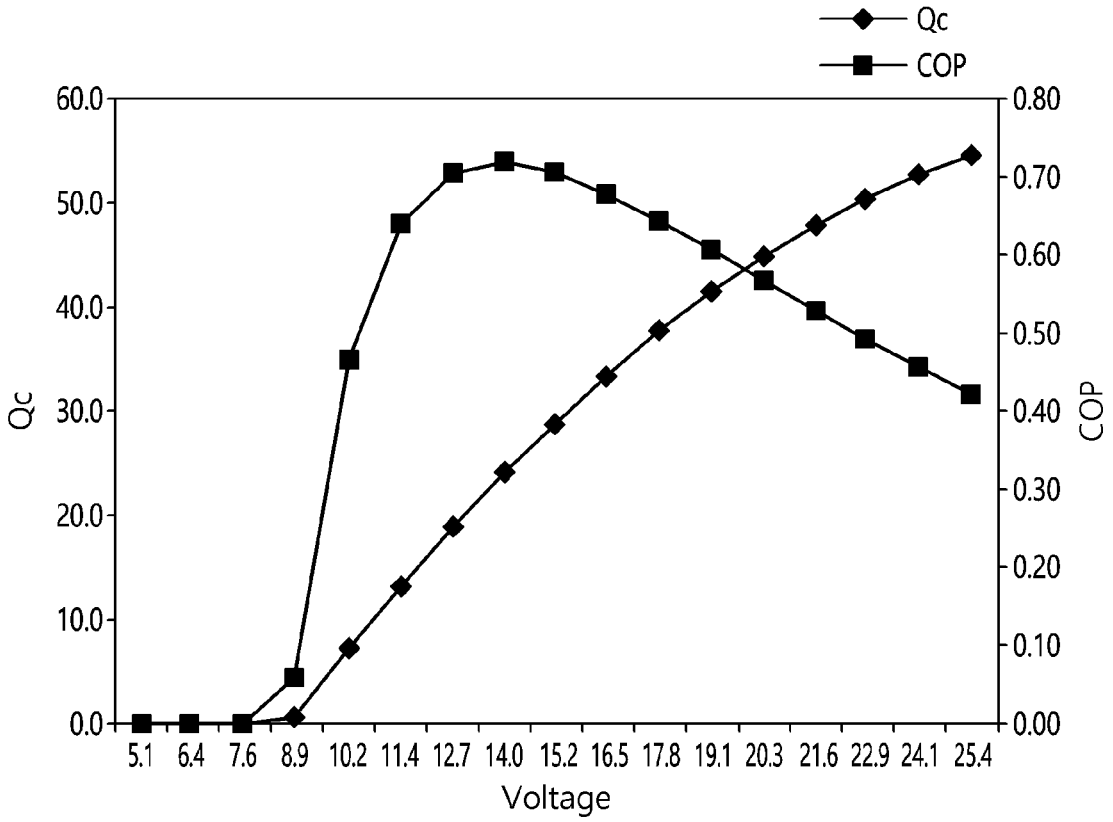
FIG. 6 is a graph illustrating a relationship of cooling capacity and efficiency according to a voltage.

FIG. 6 is a graph illustrating a relationship of the cooling capacity and the efficiency according to a voltage.

Referring to FIG. 6, as described above, as the voltage difference increases, both the cooling capacity and efficiency increase and then decrease.

In detail, it is seen that the voltage value at which the cooling capacity is maximized and the voltage value at which the efficiency is maximized are different from each other. This is seen that the voltage is the first-order function, and the efficiency is the second-order function until the cooling capacity is maximized.

As illustrated in FIG. 6, as an example, in the case of the thermoelectric module having ΔT of 30° C., it is confirmed that the thermoelectric module has the highest efficiency within a range of approximately 12 V to 17 V of the voltage applied to the thermoelectric module. Within the above voltage range, the cooling capacity continues to increase. Therefore, it is seen that a voltage difference of at least 12 V is required in consideration of the cooling capacity, and the efficiency is maximum when the voltage difference is 14 V.

Figure 7:
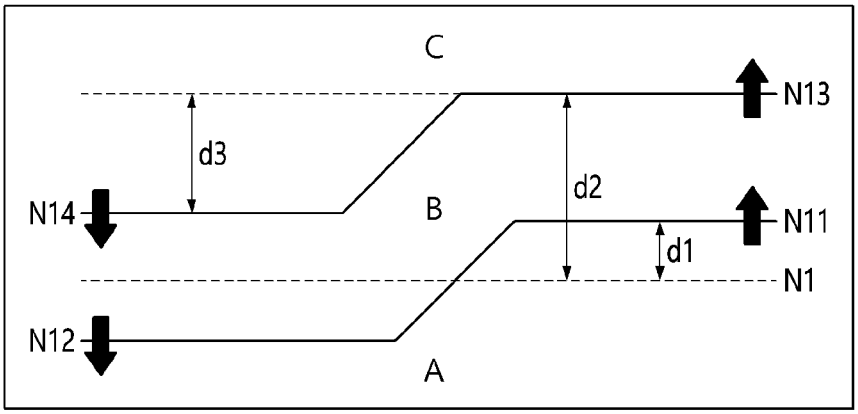
FIG. 7 is a view illustrating a reference temperature line for controlling a refrigerator according to a change in load inside the refrigerator.
Figure 7:
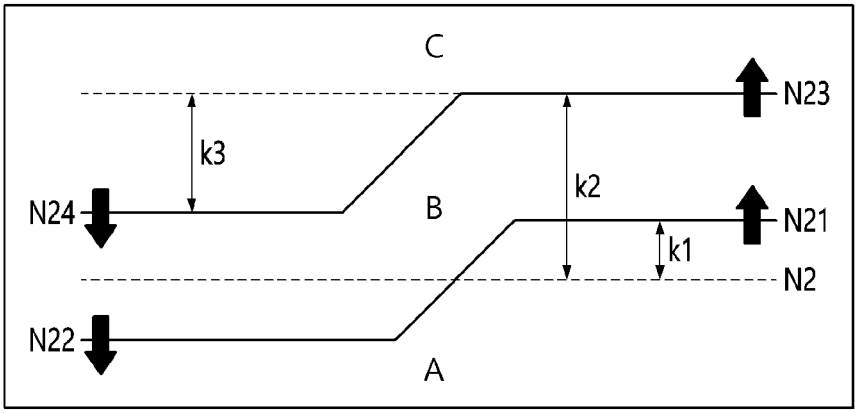
Figure 7:
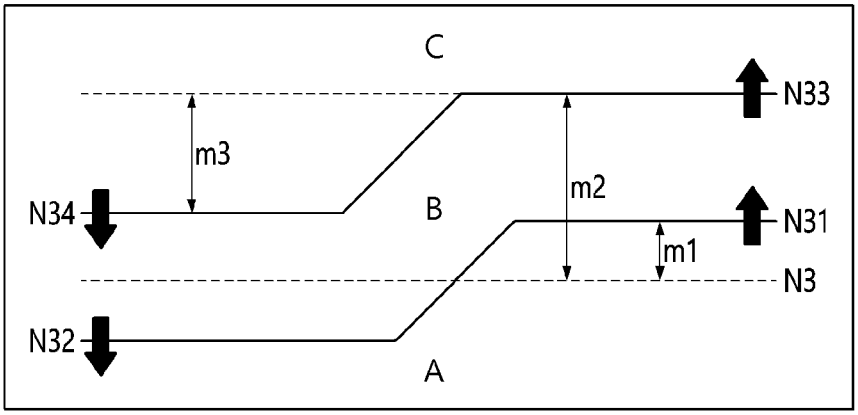

FIG. 7 is a view illustrating a reference temperature line for controlling the refrigerator according to a change in load inside the refrigerator.

Hereinafter, a set temperature of each storage compartment will be described by being defined as a notch temperature. The reference temperature line may be expressed as a critical temperature line.

A lower reference temperature line in the graph is a reference temperature line by which a satisfactory temperature region and a unsatisfactory temperature region are divided. Thus, a region A below the lower reference temperature line may be defined as a satisfactory section or a satisfactory region, and a region B above the lower reference temperature line may be defined as a dissatisfied section or a dissatisfied region.

In addition, an upper reference temperature line is a reference temperature line by which an unsatisfactory temperature region and an upper limit temperature region are divided. Thus, a region C above the upper reference temperature line may be defined as an upper limit region or an upper limit section and may be seen as a special operation region.

When defining the satisfactory/unsatisfactory/upper limit temperature regions for controlling the refrigerator, the lower reference temperature line may be defined as either a case of being included in the satisfactory temperature region or a case of being included in the unsatisfactory temperature region. In addition, the upper reference temperature line may be defined as one of a case of being included in the unsatisfactory temperature region and a case of being included in the upper limit temperature region.

When the internal temperature of the refrigerator is within the satisfactory region A, the compressor is not driven, and when the internal temperature of the refrigerator is in the unsatisfactory region B, the compressor is driven so that the internal temperature of the refrigerator is within the satisfactory region.

In addition, when the internal temperature of the refrigerator is in the upper limit region C, it is considered that food having a high temperature is put into the refrigerator, or the door of the storage compartment is opened to rapidly increase in load within the refrigerator. Thus, a special operation algorithm including a load correspondence operation is performed.

(a) of FIG. 7 is a view illustrating a reference temperature line for controlling the refrigerator according to a change in temperature of the refrigerating compartment.

A notch temperature N1 of the refrigerating compartment is set to a temperature above zero. In order to allow the temperature of the refrigerating compartment to be maintained to the notch temperature N1, when the temperature of the refrigerating compartment rises to a first satisfactory critical temperature N11 higher than the notch temperature N1 by a first temperature difference d1, the compressor is controlled to be driven, and after the compressor is driven, the compressor is controlled to be stopped when the temperature is lowered to a second satisfactory critical temperature N12 lower than the notch temperature N1 by the first temperature difference d1.

The first temperature difference d1 is a temperature value that increases or decreases from the notch temperature N1 of the refrigerating compartment, and the temperature of the refrigerating compartment may be defined as a control differential or a control differential temperature, which defines a temperature section in which the temperature of the refrigerating compartment is considered as being maintained to the notch temperature N1, i.e., approximately 1.5° C.

In addition, when it is determined that the refrigerating compartment temperature rises from the notch temperature N1 to a first unsatisfactory critical temperature N13 which is higher by the second temperature difference d2, the special operation algorithm is controlled to be executed. The second temperature difference d2 may be 4.5° C. The first unsatisfactory critical temperature may be defined as an upper limit input temperature.

After the special driving algorithm is executed, if the internal temperature of the refrigerator is lowered to a second unsatisfactory temperature N14 lower than the first unsatisfactory critical temperature by a third temperature difference d3, the operation of the special driving algorithm is ended. The second unsatisfactory temperature N14 may be lower than the first unsatisfactory temperature N13, and the third temperature difference d3 may be 3.0° C. The second unsatisfactory critical temperature N14 may be defined as an upper limit release temperature.

After the special operation algorithm is completed, the cooling capacity of the compressor is adjusted so that the internal temperature of the refrigerator reaches the second satisfactory critical temperature N12, and then the operation of the compressor is stopped.

(b) of FIG. 7 is a view illustrating a reference temperature line for controlling the refrigerator according to a change in temperature of the freezing compartment.

A reference temperature line for controlling the temperature of the freezing compartment have the same temperature as the reference temperature line for controlling the temperature of the refrigerating compartment, but the notch temperature N2 and temperature variations k1, k2, and k3 increasing or decreasing from the notch temperature N2 are only different from the notch temperature N1 and temperature variations d1, d2, and d3.

The freezing compartment notch temperature N2 may be −18° C. as described above, but is not limited thereto. The control differential temperature k1 defining a temperature section in which the freezing compartment temperature is considered to be maintained to the notch temperature N2 that is the set temperature may be 2° C.

Thus, when the freezing compartment temperature increases to the first satisfactory critical temperature N21, which increases by the first temperature difference k1 from the notch temperature N2, the compressor is driven, and when the freezing compartment temperature is the unsatisfactory critical temperature (upper limit input temperature) N23, which increases by the second temperature difference k2 than the notch temperature N2, the special operation algorithm is performed.

In addition, when the freezing compartment temperature is lowered to the second satisfactory critical temperature N22 lower than the notch temperature N2 by the first temperature difference k1 after the compressor is driven, the driving of the compressor is stopped.

After the special operation algorithm is performed, if the freezing compartment temperature is lowered to the second unsatisfactory critical temperature (upper limit release temperature) N24 lower by the third temperature difference k3 than the first unsatisfactory temperature N23, the special operation algorithm is ended. The temperature of the freezing compartment is lowered to the second satisfactory critical temperature N22 through the control of the compressor cooling capacity.

Even in the state that the deep freezing compartment mode is turned off, it is necessary to intermittently control the temperature of the deep freezing compartment with a certain period to prevent the deep freezing compartment temperature from excessively increasing. Thus, the temperature control of the deep freezing compartment in a state in which the deep freezing compartment mode is turned off follows the temperature reference line for controlling the temperature of the freezing compartment disclosed in (b) FIG. 7.

As described above, the reason why the reference temperature line for controlling the temperature of the freezing compartment is applied in the state in which the deep freezing compartment mode is turned off is because the deep freezing compartment is disposed inside the freezing compartment.

That is, even when the deep freezing compartment mode is turned off, and the deep freezing compartment is not used, the internal temperature of the deep freezing compartment has to be maintained at least at the same level as the freezing compartment temperature to prevent the load of the freezing compartment from increasing.

Therefore, in the state that the deep freezing compartment mode is turned off, the deep freezing compartment notch temperature is set equal to the freezing compartment notch temperature N2, and thus the first and second satisfactory critical temperatures and the first and second unsatisfactory critical temperatures are also set equal to the critical temperatures N21, N22, N23, and N24 for controlling the freezing compartment temperature.

(c) of FIG. 7 is a view illustrating a reference temperature line for controlling the refrigerator according to a change in temperature of the deep freezing compartment in a state in which the deep freezing compartment mode is turned on.

In the state in which the deep freezing compartment mode is turned on, that is, in the state in which the deep freezing compartment is on, the deep freezing compartment notch temperature N3 is set to a temperature significantly lower than the freezing compartment notch temperature N2, i.e., is in a range of about −45° C. to about −55° C., preferably −55° C. In this case, it is said that the deep freezing compartment notch temperature N3 corresponds to a heat absorption surface temperature of the thermoelectric module 21, and the freezing compartment notch temperature N2 corresponds to a heat generation surface temperature of the thermoelectric module 21.

Since the refrigerant passing through the freezing compartment expansion valve 15 passes through the heat sink 24, the temperature of the heat generation surface of the thermoelectric module 21 that is in contact with the heat sink 24 is maintained to a temperature corresponding to the temperature of the refrigerant passing through at least the freezing compartment expansion valve. Therefore, a temperature difference between the heat absorption surface and the heat generation surface of the thermoelectric module, that is, $\Delta T$ is 32° C.

The control differential temperature m1, that is, the deep freezing compartment control differential temperature that defines a temperature section considered to be maintained to the notch temperature N3, which is the set temperature, is set higher than the freezing compartment control differential temperature k1, for example, 3° C.

Therefore, it is said that the set temperature maintenance consideration section defined as a section between the first satisfactory critical temperature N31 and the second satisfactory critical temperature N32 of the deep freezing compartment is wider than the set temperature maintenance consideration section of the freezing compartment.

In addition, when the deep freezing compartment temperature rises to the first unsatisfactory critical temperature N33, which is higher than the notch temperature N3 by the second temperature difference m2, the special operation algorithm is performed, and after the special operation algorithm is performed, when the deep freezing compartment temperature is lowered to the second unsatisfactory critical temperature N34 lower than the first unsatisfactory critical temperature N33 by the third temperature difference m3, the special operation algorithm is ended. The second temperature difference m2 may be 5° C.

Here, the second temperature difference m2 of the deep freezing compartment is set higher than the second temperature difference k2 of the freezing compartment. In other words, an interval between the first unsatisfactory critical temperature N33 and the deep freezing compartment notch temperature N3 for controlling the deep freezing compartment temperature is set larger than that between the first unsatisfactory critical temperature N23 and the freezing compartment notch temperature N2 for controlling the freezing compartment temperature.

This is because the internal space of the deep freezing compartment is narrower than that of the freezing compartment, and the thermal insulation performance of the deep freezing case 201 is excellent, and thus, a small amount of the load input into the deep freezing compartment is discharged to the outside. In addition, since the temperature of the deep freezing compartment is significantly lower than the temperature of the freezing compartment, when a heat load such as food is penetrated into the inside of the deep freezing compartment, reaction sensitivity to the heat load is very high.

For this reason, when the second temperature difference m2 of the deep freezing compartment is set to be the same as the second temperature difference k2 of the freezing compartment, frequency of performance of the special operation algorithm such as a load correspondence operation may be excessively high. Therefore, in order to reduce power consumption by lowering the frequency of performance of the special operation algorithm, it is preferable to set the second temperature difference m2 of the deep freezing compartment to be larger than the second temperature difference k2 of the freezing compartment.

A method for controlling the refrigerator according to an embodiment of the present invention will be described below.

Hereinafter, the content that a specific process is performed when at least one of a plurality of conditions is satisfied should be construed to include the meaning that any one, some, or all of a plurality of conditions have to be satisfied to perform a particular process in addition to the meaning of performing the specific process if any one of the plurality of conditions is satisfied at a time point of determination by the controller.

Figure 8:
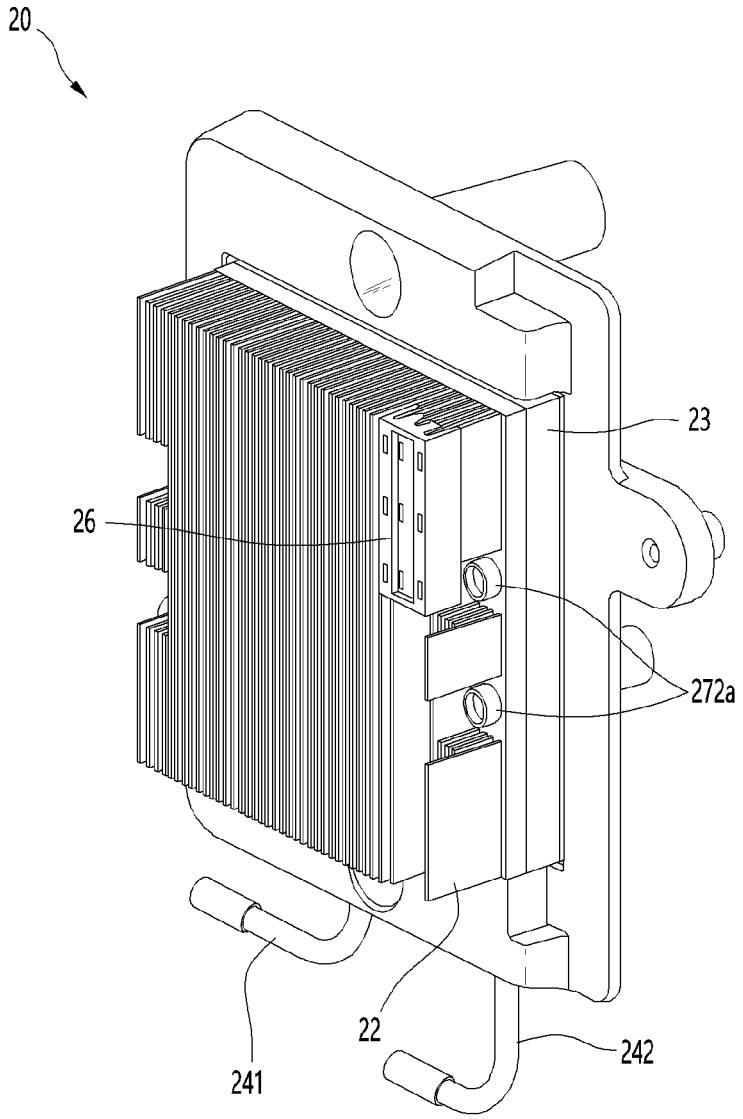
FIG. 8 is a perspective view of a thermoelectric module according to an embodiment of the present invention.
Figure 9:
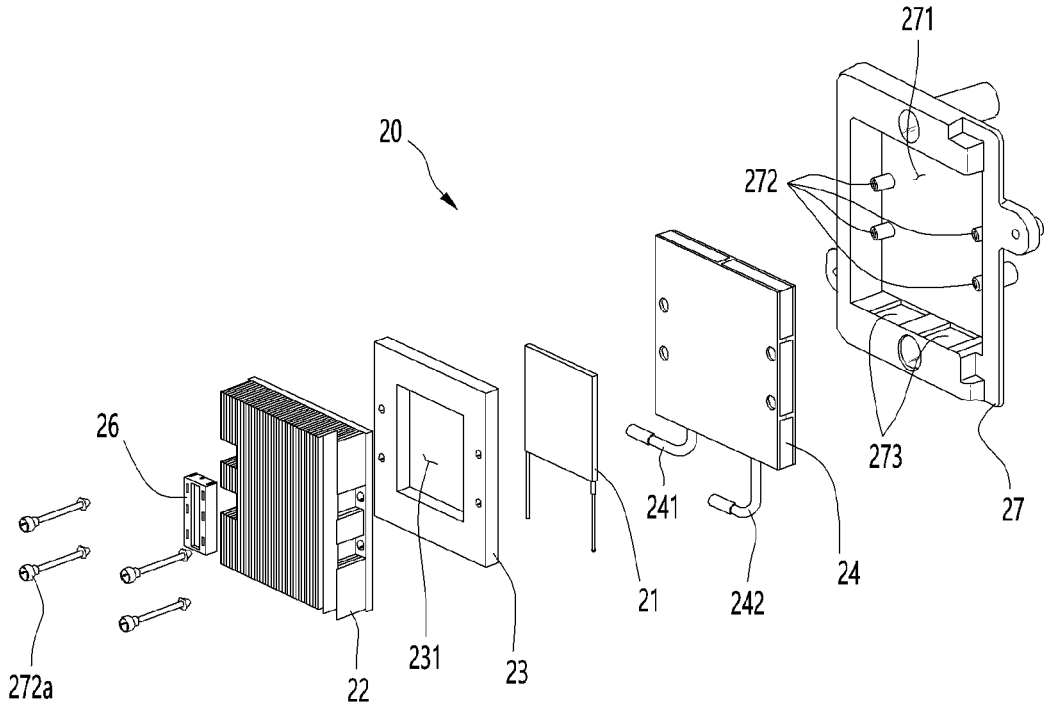
FIG. 9 is an exploded perspective view of the thermoelectric module.

FIG. 8 is a perspective view of the thermoelectric module according to an embodiment of the present invention, and FIG. 9 is an exploded perspective view of the thermoelectric module.

Referring to FIGS. 8 and 9, as described above, the thermoelectric module 20 according to an embodiment of the present invention may include the thermoelectric element 21, the cold sink 22 that is in contact with the heat absorption surface of the thermoelectric element 21, the heat sink 24 that is in contact with the heat generation surface of the thermoelectric element 21, and an insulator 23 for blocking heat transfer between the cold sink 22 and the heat sink 24.

The thermoelectric module 20 may further include a deep freezing compartment fan 25 disposed in front of the cold sink 22.

In addition, the thermoelectric module 20 may further include a defrost sensor 26 mounted on the heat exchange fin of the cold sink 22 to detect a temperature of the cold sink 22. The defrost sensor 26 detects a surface temperature of the cold sink 22 during a defrosting process to transmit the detected temperature information to the controller, thereby determining a defrost completion time point. The controller may also determine whether the defrost is defective based on the temperature value transmitted from the defrost sensor 26.

In addition, the thermoelectric module 20 may further include a housing 27 accommodating the heat sink 24. The housing 27 may be made of a material having thermal insulation performance lower than the deep freezing case 201.

As described above, in the structure in which the housing 27 accommodating the heat conductor constituted by the heat conduction plate and the heat exchange fin is provided, the heat sink 24 may be interpreted as having a structure including the heat conductor and the housing 27.

A heat sink accommodation portion 271 having a size corresponding to a thickness and area of the heat sink 245 may be recessed in the housing 27. A plurality of coupling bosses 272 may protrude from left and right edges of the heat sink accommodation portion 271. Since a coupling member 272*a* passes through both sides of the cold sink 22 and is inserted into the coupling boss 272, the components constituting the thermoelectric module 20 are assembled as a single body.

In addition, since the evaporator connected in series to the freezing compartment evaporator 17 serves as the heat sink 24, an inflow pipe 241 through which the refrigerant is introduced and a discharge pipe 242 through which the refrigerant is discharged are provided at an edge of a side surface of the heat sink 24 to extend. A pipe through-hole 273 through which the inflow pipe 241 and the discharge pipe 242 pass may be formed in the housing 27.

In addition, a thermoelectric element accommodation hole 231 corresponding to the size of the thermoelectric element 21 is formed in a center of the insulator 23. The insulator 23 may have a thickness greater than that of the thermoelectric element 21, and a rear portion of the cold sink 22 may be inserted into the thermoelectric element accommodation hole 231.

On the other hand, since the cold sink 22 and the heat sink 24 constituting the thermoelectric module 20 are maintained at a temperature sub-zero, frost or ice may be grown on the surface to cause a deterioration in heat exchange performance. Particularly, the heat sink 24 functions as a radiator for cooling the heat generation surface of the thermoelectric element 21, but since the refrigerant flowing therein is maintained at a temperature of around −20° C., icing also occurs on the surface of the heat sink 24

For this reason, it is necessary to periodically remove ice formed on the surfaces of the cold sink 22 and the heat sink 24 through the defrost operation. Hereinafter, the operation of melting ice or frost generated in the thermoelectric module is defined as a defrost operation of a deep freezing compartment, and the defrost operation of the deep freezing compartment is defined as including cold sink defrosting and heat sink defrosting.

Figure 10:
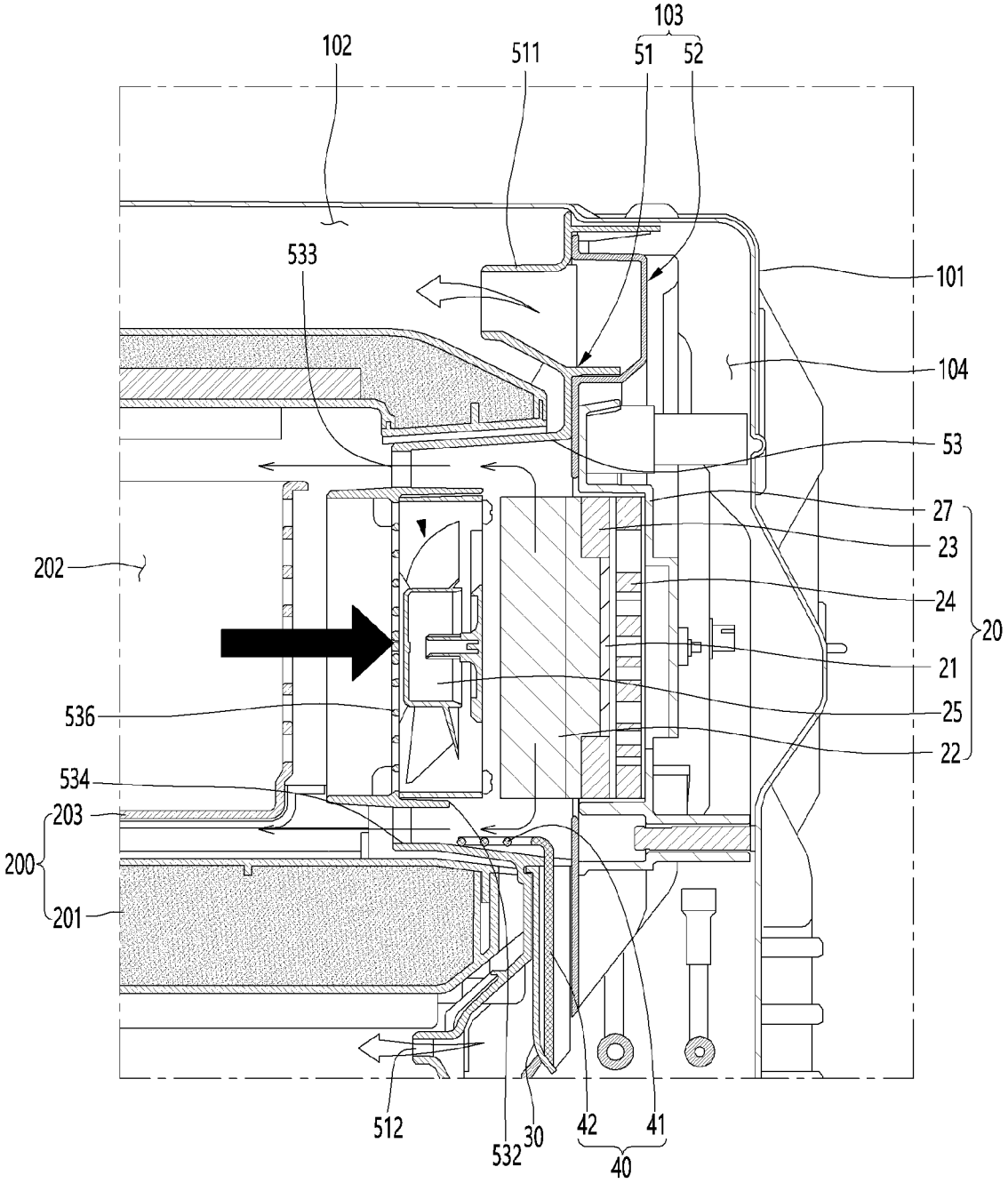
FIG. 10 is an enlarged cross-section view illustrating a structure of a rear end of a deep freezing compartment in which a thermoelectric module is provided.
Figure 11:
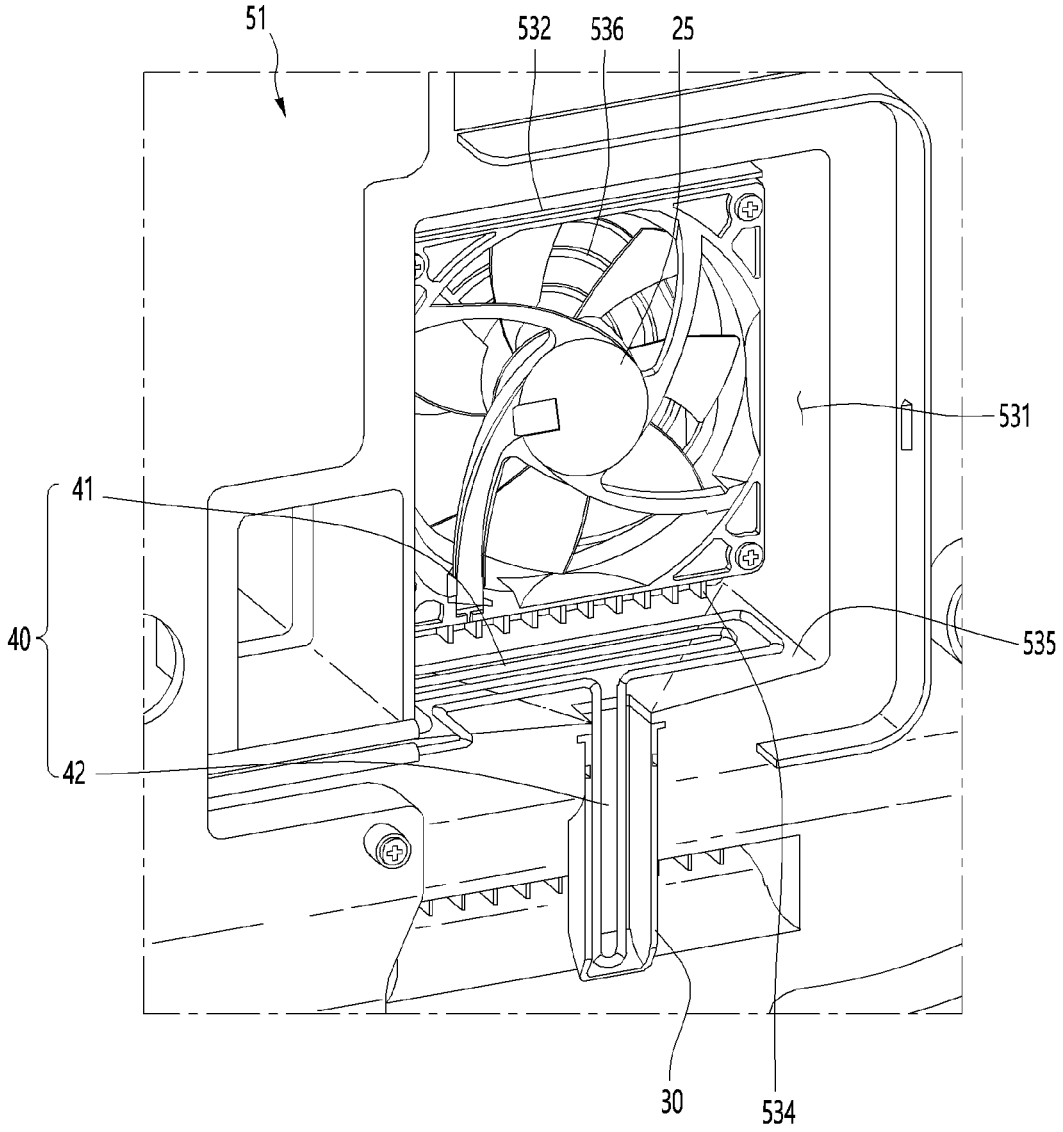
FIG. 11 is an enlarged perspective view illustrating a shape of a thermoelectric module accommodation space when viewed from a side of a freezing evaporation compartment.

FIG. 10 is an enlarged cross-section view illustrating a structure of a rear end of the deep freezing compartment in which the thermoelectric module is provided and FIG. 11 is an enlarged perspective view illustrating a shape of the thermoelectric module accommodation space when viewed from a side of the freezing evaporation compartment.

Referring to FIGS. 10 and 11, the freezing compartment 102 and the freezing evaporation compartment 104 are partitioned by a partition wall 103, and the rear surface of the deep freezing case 202 constituting the deep freezing refrigeration unit 200 is in close contact with the front surface of the partition wall 103.

In detail, the partition wall 103 may include a grille pan 51 exposed to cold air in the freezing compartment, and a shroud 52 attached to a rear surface of the grille pan 51.

Freezing compartment-side discharge grilles 511 and 512 are disposed to protrude from a front surface of the grille pan 51 so as to be vertically spaced apart from each other, and a module sleeve 53 protrudes from the front surface of the grille pan 51 corresponding between the freezing compartment-side discharge grilles 511 and 512. A thermoelectric module accommodation portion 531 in which the thermoelectric module 20 is accommodated is formed in the module sleeve 53.

In more detail, a flow guide 532 may be provided in a cylindrical or polygonal cylindrical shape inside the module sleeve 53, and the inside of the flow guide 532 may be divided into a front space and a rear space by a fan grille part 536. A plurality of air through-holes may be formed in the fan grille part 536.

Also, deep freezing compartment-side discharge grilles 533 and 534 may be formed between the module sleeve 53 and the flow guide 532, i.e., an upper side and a lower side of the flow guide 532, respectively.

The deep freezing compartment fan 25 may be accommodated inside the flow guide 532 corresponding to the rear side of the fan grille part 536. A portion of the flow guide 532, which corresponds to a front space of the fan grille part 536 serves to guide a flow of cool air so that the cool air in the deep freezing compartment is suctioned into the deep freezing compartment fan 25. That is, the cold air introduced into the inner space of the flow guide 532 to pass through the fan grille part 536 is discharged in a radial direction of the deep freezing compartment fan 25 and is heat-exchanged with the cold sink 22. The cold air that is cooled while being heat-exchanged with the cold sink 22 to flow in a vertical direction is discharged again to the deep freezing compartment through the deep freezing compartment-side discharge grills 533 and 534.

The thermoelectric module accommodation portion 531 may be defined as a space between a rear end of the flow guide 532 (or a rear end of the deep freezing compartment fan 25) and a rear surface of the grille pan 51.

Here, the housing 27 accommodating the heat sink 24 protrudes backward from a rear surface of the partition wall 103 and is placed in the freezing evaporation compartment 104. Thus, a rear surface of the housing 27 is exposed to the cold air of the freezing evaporation compartment 104, and thus, a surface temperature of the housing 27 is substantially maintained at the same or similar level to the temperature of the cold air in the freezing evaporation compartment.

The cold sink 22 may be accommodated in the thermoelectric module accommodation portion 531, and the insulator 23, the thermoelectric element 21, and the heat sink 24 are accommodated in the housing 27.

A bottom portion 535 of the thermoelectric module accommodation portion 531 may be designed to be inclined downward toward one side, and the one side may be a central portion of the bottom portion 535, but is not limited thereto. A recess portion for mounting a defrost water guide 30 may be formed at the lowest point on the bottom portion 535. The defrost water guide 30 is inserted into the recess portion to serve as a drain hole that guides the defrost water generated during the defrost operation of the deep freezing compartment to flow down to the floor of the freezing evaporation compartment 104.

On the other hand, an ice mass separated from the cold sink 22 to fall down to the bottom portion 535 during the defrost operation process of the deep freezing compartment is quickly melted to be discharged outside the thermoelectric module accommodation portion 531 along the defrost water guide 30.

However, a separate heating means is required to melt the ice falling to the bottom portion 535 before the defrost operation is ended. For this reason, a cold sink heater 40 may be arranged inside the bottom portion 535 and the defrost water guide 30.

In detail, the cold sink heater 40 includes a main heater 41 bent several times on the bottom portion 535 and arranged in a meandering shape and a guide heater 42 inserted into the defrost water guide 30. The main heater 41 and the guide heater 42 may be formed by bending one heater several times, but it is not excluded that separate heaters are provided respectively.

When the defrosting of the deep freezing compartment and the defrosting of the freezing compartment are performed, the deep freezing compartment temperature and the freezing evaporation compartment temperature increase rather than the deep freezing compartment temperature and the freezing evaporation compartment temperature in a normal state. However, even if the temperature increases, the internal temperature of the deep freezing compartment and the temperature of the freezing evaporation compartment are still maintained at a temperature significantly lower than the freezing temperature.

Particularly, the internal temperature of the deep freezing compartment is maintained at a temperature lower than the freezing evaporation compartment temperature, i.e., a subzero temperature. In this state, when the defrosting of the deep freezing compartment defrost (the defrosting of the thermoelectric module) and the defrosting of the freezing compartment (the defrosting of the freezing compartment evaporator) are performed, the wet vapor floating in the deep freezing compartment may be introduced into the freezing evaporation compartment through the defrost water guide.

Here, the wet vapor flowing into the freezing evaporation compartment may be in contact with the cold air of the freezing evaporation compartment and be attached on the defrost water guide as the temperature drops. If the attachment phenomenon continues, the defrost water guide may be blocked by ice. Therefore, a means for preventing the blocking of the defrost water drain hole due to such the freezing is required.

Figure 12:
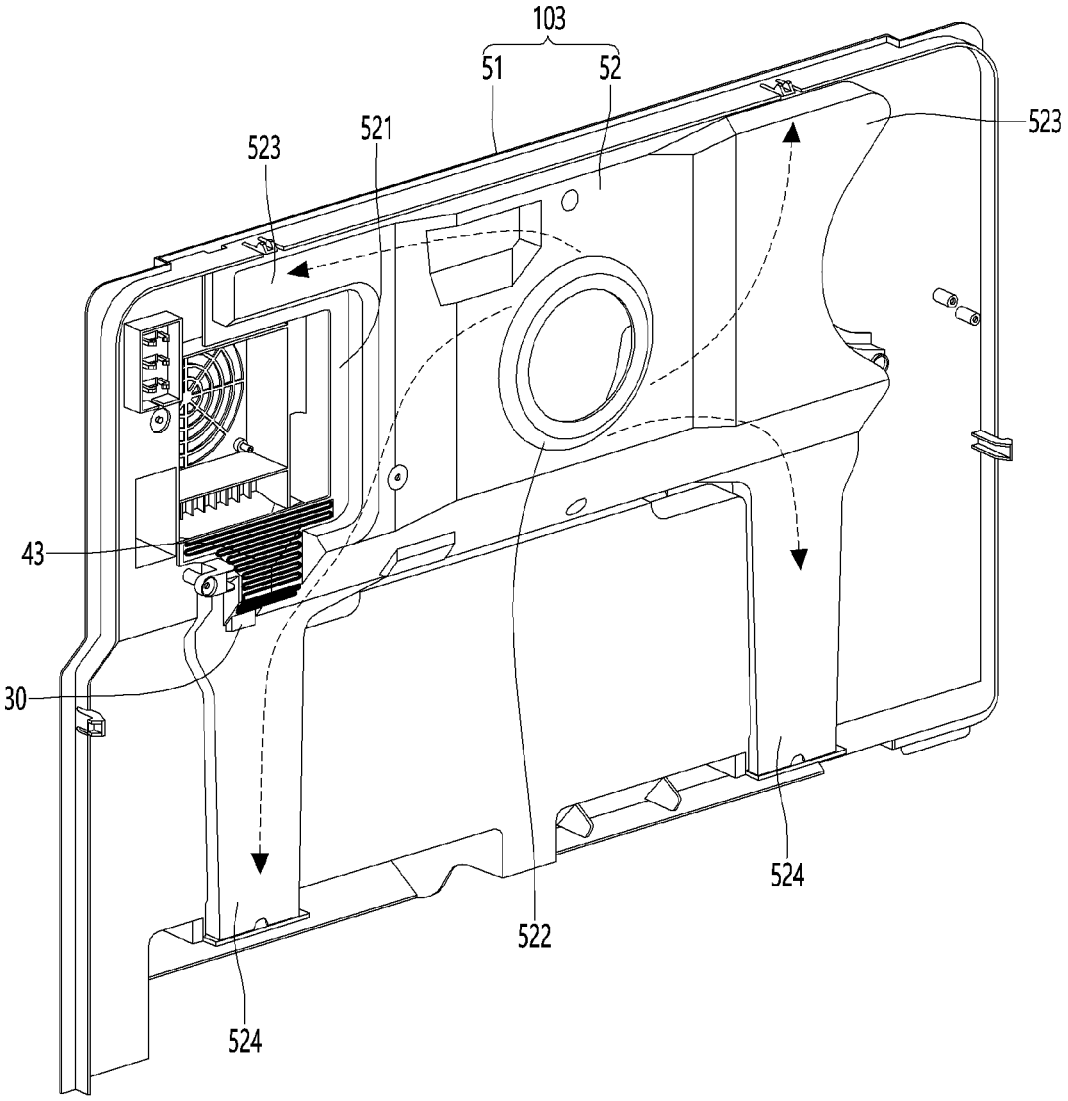
FIG. 12 is a rear perspective view of a partition portion provided with a defrost water drain hole blocking portion according to an embodiment of the present invention.
Figure 13:
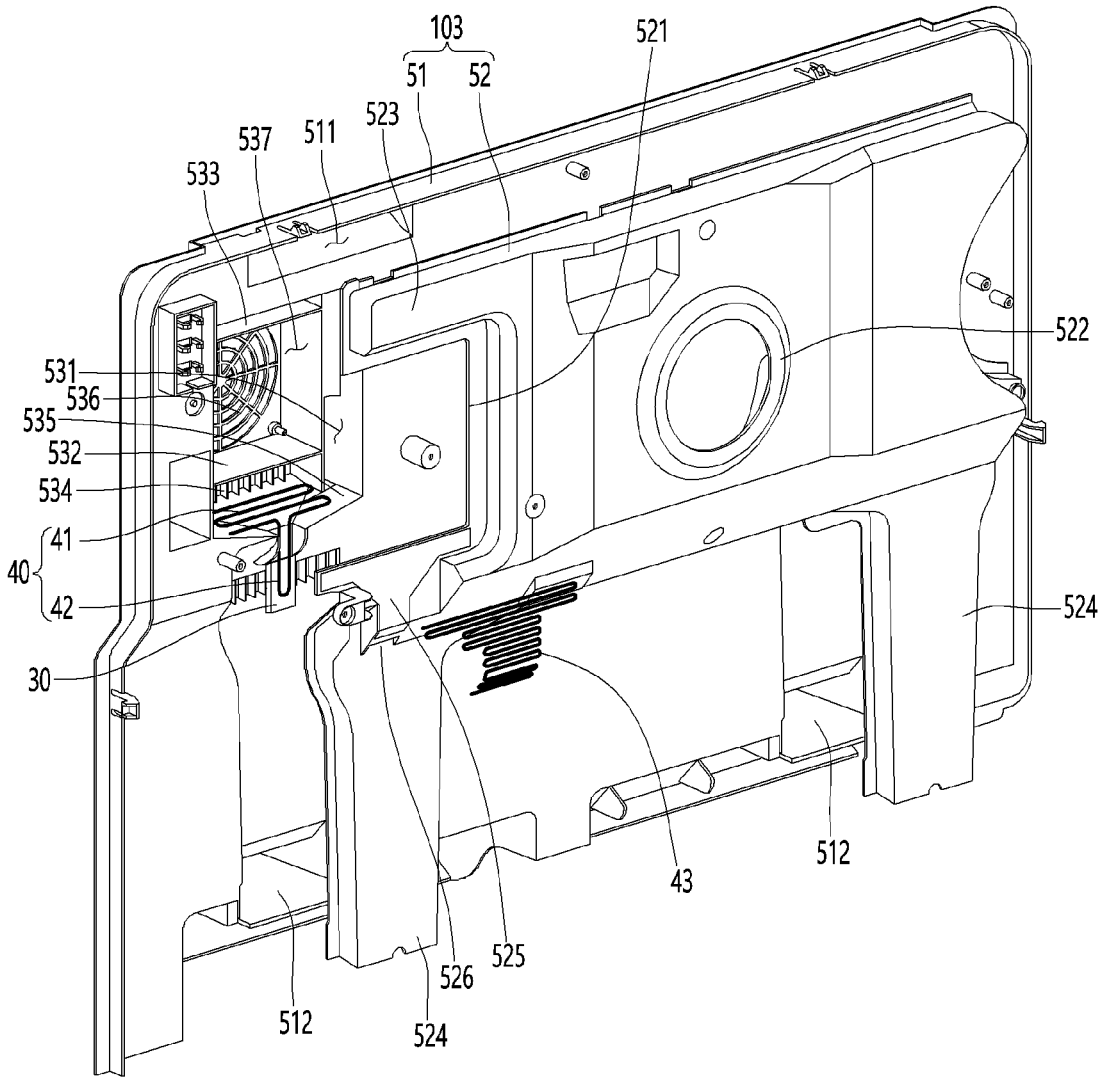
FIG. 13 is an exploded perspective view of a partition portion provided with the defrost water drain hole blocking portion.

FIG. 12 is a rear perspective view of a partition portion provided with the defrost water drain hole blocking portion according to an embodiment of the present invention, and FIG. 13 is an exploded perspective view of the partition portion provided with the defrost water drain hole blocking portion.

Referring to FIGS. 12 and 13, the partition wall according to an embodiment of the present invention may include a grille pan 51 and a shroud 52 as described above.

It may be understood that the grille pan 51 substantially functions as a partition member that partitions the freezing compartment 102 from the freezing evaporation compartment 104, and the shroud 52 functions as a duct member forming a cold air passage through which the cold air generated in the freezing evaporation compartment 104 is supplied to the freezing compartment 102.

In detail, the shroud 52 may be coupled to a rear surface of the grille pan 51, and a freezing compartment fan mounting hole 522 may be formed in a substantially central portion thereof. A freezing compartment fan 171 (see FIG. 1) is mounted in the freezing compartment fan mounting hole 522 to suction the cold air in the freezing evaporation compartment 104.

In addition, the shroud 52 may include an upper discharge guide 523 and a lower discharge guide 524.

Ends of the upper discharge guide 523 and the lower discharge guide 524 are connected to the freezing compartment-side discharge grilles 511 and 512 formed on the grille pan 51 when the shroud 52 is coupled to the rear surface of the grille pan 51. Thus, the cold air discharged from the freezing compartment fan 171 flows along the upper discharge guide 523 and the lower discharge guide 524 and is supplied to the freezing compartment 102.

A housing accommodation hole 521 into which the housing 27 constituting the thermoelectric module 20 is inserted may be formed at one side of the shroud 52. The housing accommodation hole 521 may be understood as a cutout portion for preventing an interference with the thermoelectric module 20.

In addition, in a state in which the shroud 52 is coupled to the grille pan 51, a back heater seating portion 525 may be formed at a portion corresponding to an area that shields the bottom portion 535 of the thermoelectric module accommodation portion 531 and the defrost water guide 30.

The back heater seating portion 525 may be formed at a lower end of the housing accommodation hole 52. The back heater seating portion 525 may be defined as a surface that protrudes backward rather than the lower discharge guide 524. A guide through-hole 526 may be formed in a stepped portion formed between the back heater seating portion 525 and the rear surface of the lower discharge guide 525.

The defrost water guide 30 passes through the guide through-hole 526 and is connected to the freezing evaporation compartment 104. Thus, the defrost water falling along the defrost water guide 30 flows down along the rear surface of the lower discharge guide 524.

In addition, the back heater 43 may be seated on the back heater seating portion 525. When power is applied to the back heater 43, the back heater seating portion 525 is heated. When the back heater seating portion 525 is heated, frost does not form on the back heater seating portion 525 and a rear surface of the shroud 52, which corresponds around the back heater seating portion 525.

The back heater 43 and the cold sink heater 40 may be independent heaters that are different from each other and may be designed to enable independent on-off control by a controller. However, although the back heater 43 and the cold sink heater 40 are the independent heaters, the back heater 43 and the cold sink heater 40 may be controlled to be turned on or off at the same time.

Figure 14:
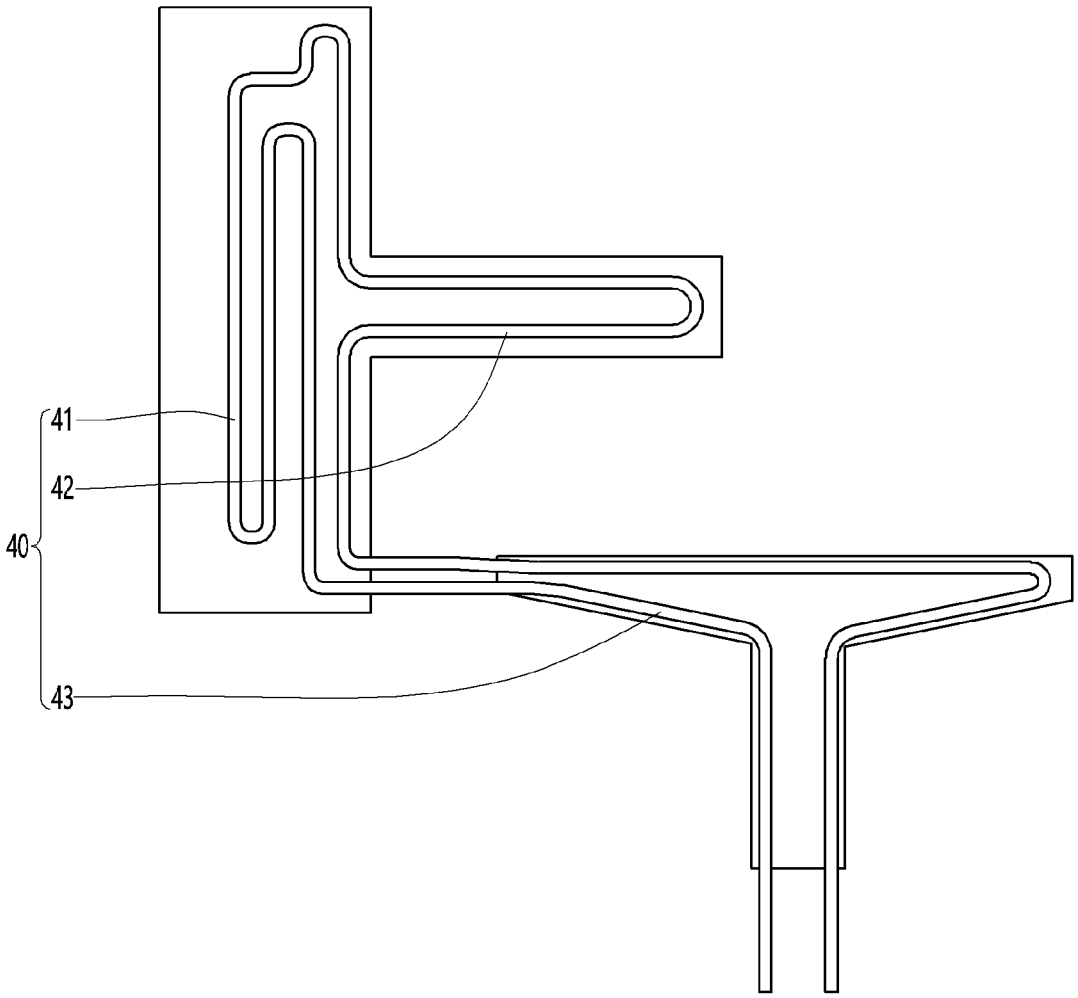
FIG. 14 is a perspective view illustrating a structure of a cold sink and a back heater according to another embodiment of the present invention.

FIG. 14 is a perspective view illustrating a structure of a cold sink and a back heater according to another embodiment of the present invention.

Referring to FIG. 14, the back heater 43 according to an embodiment of the present invention may have a structure coupled to the defrost heater 40 or a structure connected to the defrost heater 40, or may be provided in one body.

In detail, the back heater 43 coupled to the cold sink heater 40 may be divided into a main heater 41, a guide heater 42, and a back heater 43 because a single heater is bent several times. That is, the cold sink heater 40 may be divided into a main heater portion, a guide heater portion, and a back heater portion.

The cold sink heater 40 and the back heater 43 having such a structure may be controlled to be turned on and off at the same time. However, the present invention is not limited thereto and may be independently controlled to be turned on or off.

Hereinafter, a method for controlling the defrost operation for each storage compartment of the refrigerator will be described.

As an embodiment of the present invention, a method for controlling the defrost operation in a structure in which the heat sink and the freezing compartment evaporator are connected in series, and the refrigerating compartment evaporator is connected in parallel with the heat sink based on the refrigerant circulation system will be described.

First, a defrost operation of the refrigerator compartment for removing ice formed on the surface of the refrigerator compartment evaporator will be described. When the defrost operation of the refrigerating compartment starts, a refrigerating compartment valve is closed to stop supply of a refrigerant to the refrigerating compartment evaporator. As a method of stopping the supply of the refrigerant to the evaporator of the refrigerating compartment, there may be mentioned a method of stopping the supply by adjusting an opening degree of a refrigerant valve or a method of stopping an operation of the compressor to enter a cooling cycle itself into a rest period.

Figure 15:
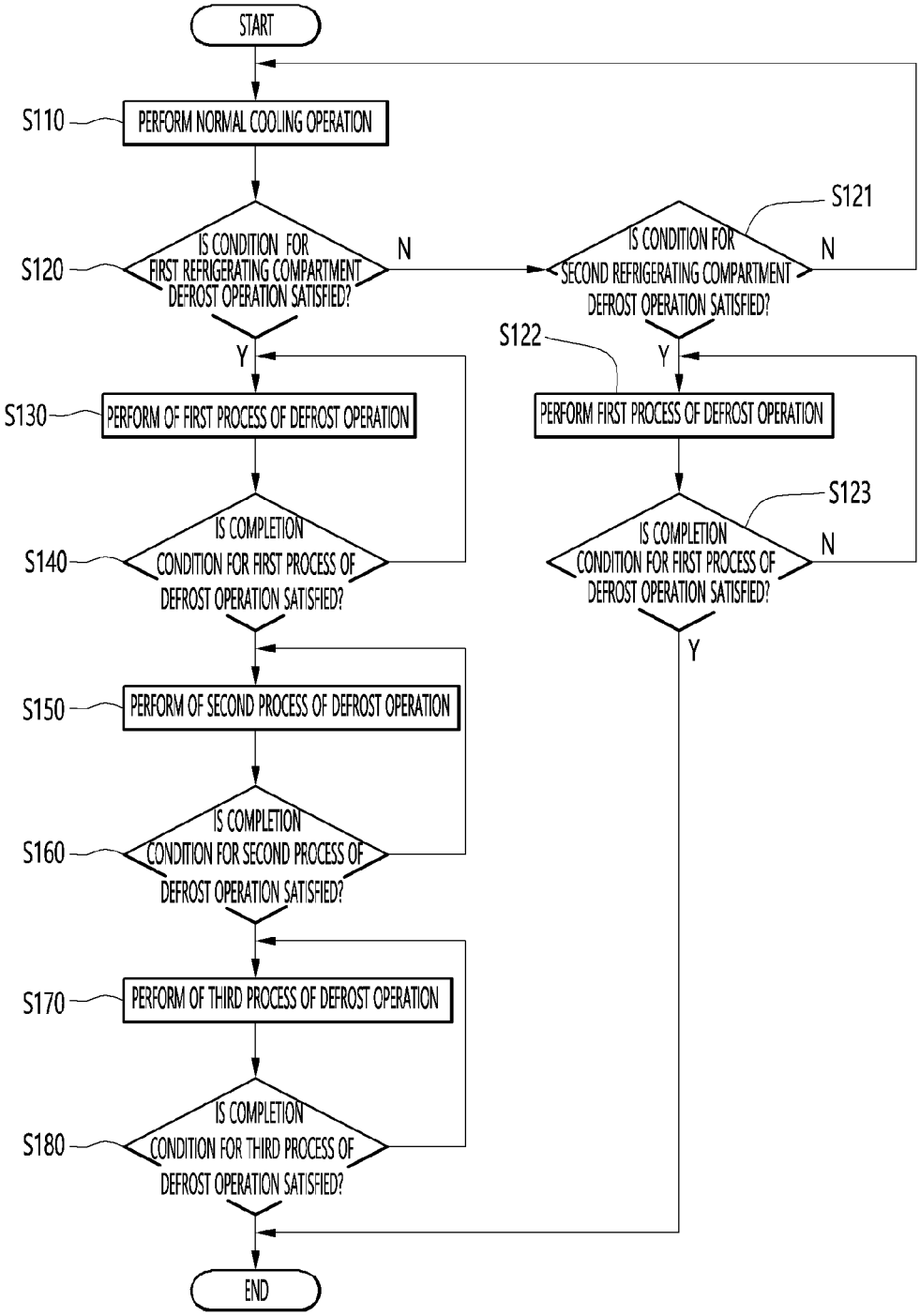
FIG. 15 is a flowchart illustrating a method for controlling a defrost operation of a refrigerating compartment according to an embodiment.

FIG. 15 is a flowchart illustrating a method for controlling the defrost operation of the refrigerating compartment according to an embodiment.

Referring to FIG. 15, while performing a normal cooling operation (S110), the controller determines whether the defrost operation condition for the first refrigerating compartment is satisfied (S120).

Unlike the defrost operation of other evaporators that operate the defrost heater, the defrost operation of the refrigerating compartment applies a natural defrosting method in which the refrigerating compartment fan rotates at a low speed without driving the defrost heater. This may be explained because the temperature of the refrigerant passing through the refrigerating compartment evaporator is relatively higher than the refrigerant temperature of the freezing compartment evaporator, an amount of frost or ice attached to the surface of the evaporator is small, and a temperature of the ice is within a freezing temperature range. A method of driving the defrost heater for defrosting the refrigerator compartment is not excluded.

In detail, a defrost operation condition for the first refrigerating compartment (or a first natural defrost mode) may be defined as a condition for determining whether a normal defrost operation situation occurs.

For example, when a defrost start condition for the freezing compartment is satisfied, and a defrost operation of the freezing compartment starts, the defrost operation condition for the first refrigerating compartment may be set to be satisfied.

When the defrost operation condition for the first refrigerating compartment is satisfied, the first defrost operation process is performed (S130). In the first process of the defrost operation, the refrigerating compartment fan is driven at a low speed, and the speed of the refrigerating compartment fan may be set to a speed lower than that of the refrigerating compartment fan applied in a normal cooling operation mode of the refrigerating compartment.

While the first process of the defrost operation is being performed, the controller determines whether a completion condition for the first process of the defrost operation is satisfied (S140) In detail, when at least one of a case in which a temperature detected by a refrigerating compartment defrost sensor attached to the refrigerating compartment evaporator is equal to or higher than a set temperature $T_{dr1}$, a case in which a defrost operation completion condition for the freezing compartment is satisfied, and a case in which a set time $t_{da}$ elapses from the start of the first process of the defrost operation is satisfied, a completion condition for the first process of the defrost operation may be set to be satisfied. The set temperature $T_{dr1}$ may be 3 degrees, and the set time $t_{da}$ may be 8 hours, but is not limited thereto.

In addition, when it is determined that the first process of the defrost operation is satisfied, the controller causes the second process of the defrost operation to be performed immediately (S150). In the second process of the defrost operation, the driving of the refrigerating compartment fan is stopped so that the natural defrosting itself enters a rest period, and a normal operation for cooling the refrigerating compartment is performed.

In addition, the controller determines whether a completion condition for the second process of the defrost operation is satisfied (S160). In detail, when it is determined that the temperature of the refrigerating compartment enters a satisfactory temperature region A illustrated in (a) of FIG. 7.

In addition, when the second process of the defrost operation is completed, the controller causes a third process of the defrost operation to be performed immediately (S170).

In detail, in the third process of the defrost operation, the refrigerator compartment fan is controlled to be driven at a low speed under the same condition as in the first process of the defrost operation. While the third process of the defrost operation is being performed, the controller determines whether a completion condition for the third process of the defrost operation is satisfied (S180).

Specifically, when at least one of a case in which a temperature detected by a refrigerating compartment defrost sensor is equal to or higher than a set temperature $T_{dr2}$, a case in which a defrost operation completion condition for the freezing compartment is satisfied, and a case in which a set time tab elapses from the start of the third process of the defrost operation is satisfied, a completion condition for the third process of the defrost operation may be set to be satisfied. The set temperature $T_{dr2}$ may be 5° C., and the set time tab may be 8 hours, but is not limited thereto.

When the third process of the defrost operation is completed, all of the defrost operations of the first refrigerating compartment are completed, and the defrosting of the refrigerating compartment is ended.

Meanwhile, when it is determined that the defrost operation condition for the first refrigerating compartment is not satisfied, it is determined whether the defrost operation condition for the second refrigerating compartment (or a second natural defrosting mode) is satisfied (S121). The defrost operation condition for the second refrigerating compartment may be defined as a condition for determining whether the defrost is not normally performed due to a defrost sensor failure, etc. In this case, the defrost operation is forcibly performed.

For example, when the refrigerating compartment defrost sensor attached to the refrigerating compartment evaporator is detected to be less than the set temperature Td, for the set time td, or longer during the normal cooling operation, the defrost operation condition for the second refrigerating compartment may be set to be satisfied. The set time td, may be 4 hours, and the set temperature Tar may be −5° C., but is not limited thereto.

When the defrost operation condition for the second refrigerating compartment is satisfied, only the first process of the defrost operation performed in the defrost operation process of the first refrigerating compartment is performed (S122), and when the completion condition for the first process of the defrost operation is satisfied (S123), the defrost operation is immediately ended.

Figure 16:
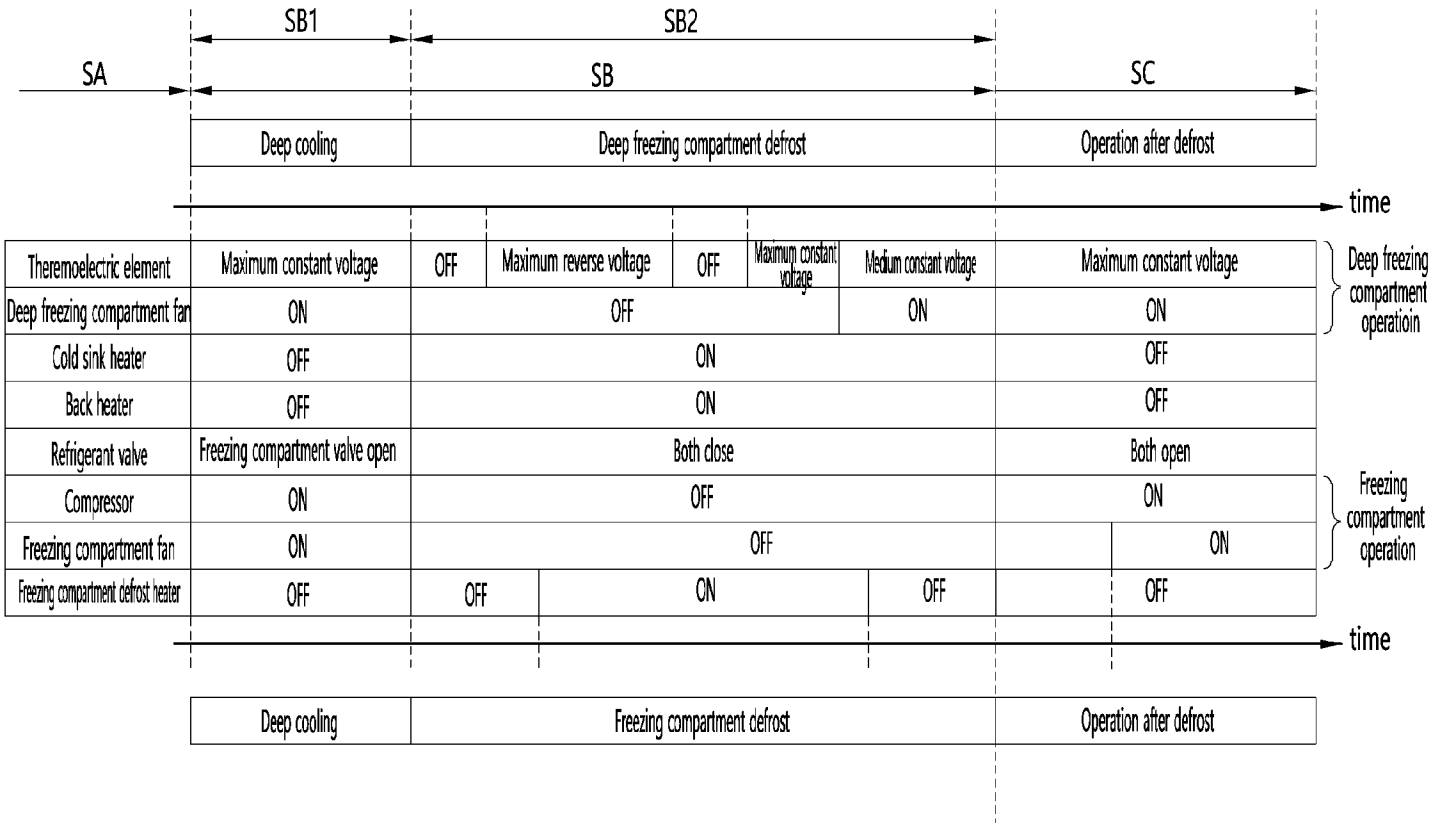
FIG. 16 is a view illustrating a state in which components constituting a refrigeration cycle as time elapses when defrosting of a deep freezing compartment and a freezing compartment is performed.
Figure 17:
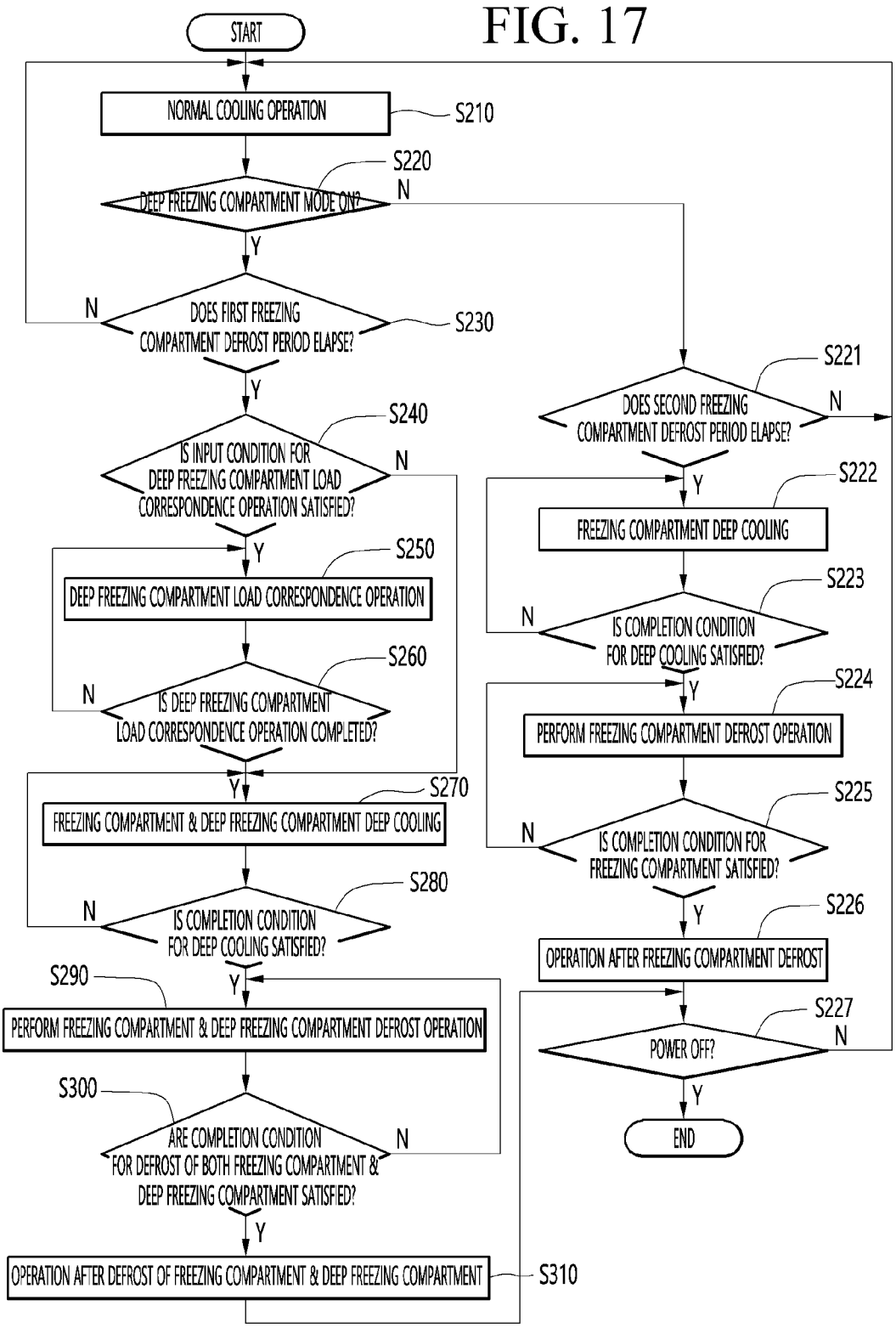
FIG. 17 is a flowchart illustrating a method for controlling a defrost operation of the freezing compartment and the deep freezing compartment of the refrigerator according to an embodiment of the present invention.

Referring to FIGS. 16 and 17, which will be described later, the present invention is characterized in that the controller of the refrigerator controls the defrost operation so that a "defrost operation of the storage compartment A" for defrosting the thermoelectric module of a storage compartment A and a "defrost operation of the storage compartment B" for defrosting the cooling device of a storage compartment B overlap each other in at least partial section.

Particularly, in the following refrigerant circulation system or refrigerator structure, "the defrost operation of the storage compartment A" and "the defrost operation of the storage compartment B" may be performed to overlap each other, and in other refrigerant circulation systems or structures, the two defrost operations may not overlap each other.

First, in a system in which the thermoelectric module of the storage compartment A and the cooling device of the storage compartment B are connected in series (hereinafter, referred to as "series system"), the controller controls the defrost operation so that "the defrost operation of the storage compartment A" and "the defrost operation of the storage compartment B" overlap each other in at least partial section.

The reason is that, while the temperature of the cold sink of the thermoelectric module increases by applying a reverse voltage to the thermoelectric module for "storage compartment A defrost operation", when refrigerant flows into the cooling device of the storage compartment B, a heat loss may occur in a cooling device chamber to reduce defrosting efficiency of the thermoelectric module.

In addition to this reason, a problem in which the efficiency of the refrigerant circulation cycle for cooling the storage compartment B is lowered may also occur.

Second, in a "cold sink communication type structure" or "cold sink non-communication type structure", "the defrost operation of the storage compartment A" and "the defrost operation of the storage compartment B" may be controlled to overlap each other in at least partial section.

The "cold sink communication type structure" means a structure, in which at least one of the cold sink of the storage compartment A (including the heat conductor itself or the heat transfer member in which the heat conductor and the housing are coupled to each other) and the defrost water guide of the storage compartment A communicates with the cooling device chamber of the storage compartment B (for example: the refrigerating evaporation compartment) or is exposed to cold air within the cooling device chamber of the storage compartment B.

The "cold sink non-communication structure" means a structure that is adjacent to a wall forming the cooling device chamber of the storage compartment B, but not sufficiently insulated from the wall forming the cooling device chamber of the storage compartment B.

The reason is that, in the cold sink communication type or non-communication type structure, while the temperature of the cold sink of the thermoelectric module increases by applying the reverse voltage to the thermoelectric module for "storage compartment A defrost operation", when refrigerant flows into the cooling device of the storage compartment B, which is not sufficiently insulated with the cold sink, the heat loss may occur in the cooling device chamber to reduce defrosting efficiency of the thermoelectric module.

In addition to this reason, in this structure, a problem in which the efficiency of the refrigerant circulation cycle for cooling the storage compartment B is lowered may also occur.

In addition, the defrost water guide may be frozen and clogged.

The "structure that is not sufficiently insulated" means a structure having lower thermal insulation performance than that of a thermal insulation wall (e.g., the deep freezing case) partitioning the inside of the storage compartment A from the storage compartment B.

On the other hand, in the "cold sink communication type structure", vapor generated during "the defrost operation of the storage compartment A" flows into the cooling device chamber of the storage compartment B to cause severe frosting only at one side of the cooling device of the storage compartment B, and the vapor generated during "the defrost operation of the storage compartment B" flows into the thermoelectric module in the storage compartment A may cause severe frosting on the thermoelectric module and the inner wall of the storage compartment A.

The present invention may be applied to at least one of the "serial system", the "cold sink communication type structure", and the "cold sink non-communication type structure".

Hereinafter, the description will be limited to the case in which the storage compartment A is the deep freezing compartment.

Hereinafter, a method for controlling the defrost operation of the deep freezing compartment and the freezing compartment for defrosting the thermoelectric module and the freezing compartment evaporator will be described.

The thermoelectric module provided for cooling the deep freezing compartment includes a cold sink 22 and heat sink 24, and in particular, the heat sink 24, which is provided in the form of an evaporator, and the freezing compartment evaporator 17 are connected in series by a refrigerant pipe.

The refrigerant flowing along the heat sink 24 and the freezing compartment evaporator 17 is a two-phase refrigerant in a low-temperature and low-pressure state in the range of −30° C. to −20° C. When power is applied to the thermoelectric element, the temperature of the cold sink 22 drops to −50° C. or less, and the heat sink 24 has a temperature difference from the cold sink 22 by ΔT determined by the specification of the thermoelectric element. For example, if ΔT of the used thermoelectric element is 30° C., the heat sink 24 is maintained at a temperature of about −20° C.

Thus, the heat sink 24 functions as a radiator that receives heat from the heat generation surface of the thermoelectric element and transfers the received heat to the refrigerant, but is maintained at a temperature significantly lower than the freezing temperature.

Thus, as an operation time of the thermoelectric module increases, frost or ice may form on the heat sink as well as the cold sink, resulting in deterioration of performance of the thermoelectric module.

In addition, since the heat sink 24 and the freezing compartment evaporator 17 are connected in series, and the defrost water guide described above functions as a passage connecting the deep freezing compartment to the freezing evaporation compartment, several problems may occur if the defrost operation of the deep freezing compartment and the defrost operation of the freezing compartment are not performed at the same time.

Here, the meaning of "simultaneous" should be interpreted as that while either one of the defrost operation of the deep freezing compartment and the defrost operation of the freezing compartment are being performed, the other has be performed, and it does not mean that the two defrost operations have to start at the same time.

In other words, when any one of the two defrost operations starts, the other defrost operation also starts regardless of the start time, which means that there is a section in which the two defrost operations overlap each other.

The problem that occurs when the defrost operation of the deep freezing compartment and the defrost operation of the freezing compartment are not performed together has been described above, but an additional problem will be described.

First, it is assumed that only the defrost operation of the freezing compartment is performed and the defrost operation of the deep freezing compartment is not performed.

Specifically, in order to cool the deep freezing compartment, a temperature difference ΔT between the heat absorption surface and the heat generation surface of the thermoelectric element has to be maintained at a predetermined level or less by allowing the heat to be rapidly released from the heat generation surface of the thermoelectric element to the outside. For this, the compressor has to be driven so that the heat transferred to the heat generation surface of the thermoelectric element is rapidly discharged through the refrigerant of the heat sink.

However, if the refrigerant is blocked from flowing to the heat sink for defrosting the freezing compartment, heat is not properly dissipated from the heat generation surface of the thermoelectric element, and thus, the temperature of the heat generation surface rises rapidly. Then, due to the characteristics in which the temperature of the thermoelectric element does not increase when ΔT increases to a certain level, if the temperature of the heat generation surface excessively increases, a temperature of the heat absorption surface also increases, resulting in a rather increasing load in the deep freezing compartment.

In this situation, if the power supplied to the thermoelectric element increases to prevent the temperature of the heat absorption surface from rising, both the cooling capacity QC and the efficiency COP of the thermoelectric element are reduced.

Second, it is assumed that only the defrost operation of the deep freezing compartment is performed, and the defrost operation of the freezing compartment is not performed.

When the defrost operation of the deep freezing compartment is performed, since the heat generation surface of the thermoelectric element functions as a heat absorption surface, heat is released from the heat sink to the thermoelectric element, and the refrigerant flowing in the heat sink is supercooled. Then, a portion of the refrigerant passing through the freezing compartment evaporator may be introduced into the compressor as a liquid refrigerant without being vaporized to cause deterioration of compressor performance or malfunction of the compressor.

On the other hand, the wet vapor flowing into the freezing evaporation compartment from the deep freezing compartment may cause a localized formation of frost that is attached only on one side of the freezing compartment evaporator. If a localized frost formation phenomenon occurs in the freezing compartment evaporator, the defrost sensor of the freezing compartment evaporator may not properly detect this phenomenon. Then, the defrost operation may not be performed in spite of the need for the defrost operation of the freezing compartment, so that the heat absorption function of the freezing compartment evaporator is lowered, and as a result, the freezing compartment cooling may be delayed.

In addition, if the reverse voltage is applied to the thermoelectric element for defrosting the deep freezing compartment, the temperature of the heat absorption surface increases to a zero temperature, and the ice attached to the cold sink of the thermoelectric element is melted. Here, in order to maintain the temperature difference ΔT determined by the specification of the thermoelectric element, the temperature of the heat generation surface of the thermoelectric element to which the heat sink is attached has to also rise.

However, since a refrigerant having a temperature of about −30° C. to −20° C. flows in the heat sink, the temperature of the heat generation surface does not increase above the heat sink temperature, and as a result, the temperature difference ΔT between the heat generation surface and the heat absorption surface increases. As a result, the cooling capacity and efficiency of the thermoelectric element may decrease at the same time.

In order to prevent the above problem from occurring, it is advantageous to perform the freezing compartment defrost and the deep freezing compartment defrost together.

FIG. 16 is a view illustrating a state in which components constituting a refrigeration cycle as time elapses when the defrosting of the deep freezing compartment and the freezing compartment is performed, and FIG. 17 is a flowchart illustrating a method for controlling the defrost operation of the freezing compartment and the deep freezing compartment of the refrigerator according to an embodiment of the present invention.

Referring to FIGS. 16 and 17, first, an operation of the refrigerator according to the present invention may be largely divided into three sections according to elapsing of time.

That is, a normal cooling operation section SA in which the defrost operation period does not elapse, a section SB in which the defrost operation is performed after the defrost operation period elapses, and a post-defrost operation section SC performed after the defrost operation is completed. After the defrost operation, a normal cooling operation is performed.

In addition, the defrost operation section SB may be more specifically divided into a deep cooling section SB1 in which deep cooling is performed and a defrosting section SB2 in which a full-scale defrost operation is performed.

Hereinafter, the description will be limited to a structure of a refrigerant circulation system or a refrigerator in which the above-described "the defrost operation of the storage compartment A" and "the defrost operation of the storage compartment B" overlap each other in at least partial section.

In detail, the controller determines whether a defrost period (POD: period of defrost) elapses while the normal cooling operation is performed (S210). Prior to determining whether the defrosting period elapses, the controller determines whether the deep freezing compartment mode is in an on state (S220). This is because the defrosting period of the freezing compartment is set differently according to the on/off state of the deep freezing compartment mode.

In more detail, when it is determined that the deep freezing compartment mode is in the on state, the controller determines whether a first freezing compartment defrost period elapses (S230), and when it is determined that the deep freezing compartment mode is in an off state, it is determined that the defrost period of the second freezing compartment elapses (S221).

Here, it is determined whether the defrosting period of the freezing compartment elapses because the defrost operation of the deep freezing compartment and the defrost operation of the freezing compartment overlap each other in a partial section. In other words, when the freezing compartment defrost period elapses, this is because not only the defrost operation of the freezing compartment but also the defrost operation of the deep freezing compartment is performed.

Here, in the refrigerant circulation system or refrigerator structure in which "the defrost operation of the storage compartment A" and "the defrost operation of the storage compartment B" do not overlap each other, in addition to determining whether the defrost period of the storage compartment B elapses, the process of determining whether the defrost period of the storage compartment A elapses may be performed separately.

Alternatively, the process of determining whether the defrost period of the storage compartment B elapses may be replaced with the process of determining whether the defrost period of the storage compartment A elapses.

The defrost period of the freezing compartment is determined as follows.

$$POD=P_i+P_g+P_v,$$

$P_i$=Initial defrost period (min)

$P_g$=Normal defrost period (min)

$P_v$=Variable defrost period (min)

Here, the initial defrost period may refer to a defrost period given to a situation in which a refrigerator is installed and turned on for a first time, or a deep freezing compartment mode is switched from an off state to an on state.

That is, when a refrigerator is installed and turned on for the first time or when the deep freezing compartment mode is switched from the off state to the on state, a time determined by the initial defrost period value has to elapse before a portion of the defrost operation start requirement (or input requirement) is considered to be satisfied.

The normal defrost period is a defrost period value given for a situation in which the refrigerator operates in the normal cooling mode. In a situation in which the refrigerator operates in the normal cooling mode, since at least the time obtained by adding the normal defrost period to the initial defrost period has to elapse before defrosting, a portion of the driving start requirements are considered to be satisfied.

The initial defrost period and the normal defrost period are fixed values in which the initially set value is not changed, whereas the variable defrost period is a value capable of being reduced or canceled depending on the operating conditions of the refrigerator.

The variable defrost period refers to a period of time that is reduced (shortened) or released according to a certain rule whenever a change such as opening or closing of the freezing compartment door or the load into the refrigerator occurs.

When the variable defrost period is released, it means that the variable defrost period value is not applied to the defrost period time. This means that the variable defrost period becomes zero.

If, after installing the refrigerator and turning on the power, it is assumed that a factor that reduces or releases the variable defrost period does not occur, the defrost operation is performed only when the total time of the initial defrost period plus the normal defrost period and the variable defrost period elapses.

On the other hand, when a variable defrost period reduction factor or release factor occurs, the defrost period value decreases, and thus, the defrost operation cycle is shortened.

On the other hand, when the deep freezing compartment mode is in the off state, only the defrost operation of the freezing compartment is performed, and when the deep freezing compartment mode is in the on state, the defrost operation of the freezing compartment and the defrost operation of the deep freezing compartment are performed at the same time.

The reduction or shortening condition of the variable defrost period may be set so that the variable defrost period is reduced in proportion to an open holding time of the freezing compartment door. For example, if the freezing compartment door is maintained to be opened for a certain period of time, a variable defrost period value that is reduced per unit time (second) may be set.

As a specific example, if the variable defrost period is set to be reduced by 7 minutes per unit time of the opening of the freezing compartment, when the freezing compartment is maintained to be opened for 5 minutes, the variable defrost period value is reduced by 35 minutes from the initial set value. That is, as the freezing compartment opening time becomes longer, the defrost operation period becomes shorter, which means that the defrost operation is performed more frequently than the initially set period.

In addition, the variable defrost period release condition may be set as follows Condition 1. Simultaneous operation of the refrigerator and freezing compartments The above condition means that both the refrigerating compartment valve and the freezing compartment valve are opened Condition 2. After opening and closing the refrigerator door, if the refrigerator temperature rises more than the set temperature (e.g., 8° C.) from a control temperature within the set time (e.g., 20 minutes)

The set time of 20 minutes is only an example and may be set to another value. The control temperature may mean any one of the notch temperature N1, the first satisfaction critical temperature N11, and the second satisfaction critical temperature N12 illustrated in (a) of FIG. 7.

The set temperature of 8° C. is only an example and may be set to another value.

Condition 3. When the refrigerator compartment temperature rises above the set temperature (e.g., 3° C.) within the set time (e.g., 3 minutes) after opening and closing the refrigerator door The set time of 3 minutes and the set temperature of 3° C. are merely examples, and may be set to different values.

Condition 4. When the refrigerator compartment temperature rises above the set temperature (e.g., 5° C.) within the set time (e.g., 3 minutes) after opening and closing the freezing compartment door The set time of 3 minutes and the set temperature of 5° C. are only examples, and may be set to different values.

Condition 5. When the compressor continuous operation time elapses the set time (e.g., 2 hours), the freezing compartment temperature is within the upper limit temperature range, and the refrigerator compartment temperature is within the unsatisfactory temperature or upper limit temperature range The set time of 2 hours is only an example and may be set to another value.

Condition 6. When the compressor continuous operation time elapses the set time (e.g., 2 hours), the refrigerator compartment temperature is within the upper limit temperature range, and the freezing compartment temperature is within the unsatisfactory temperature or upper limit temperature range The set time of 2 hours is only an example and may be set to another value.

Condition 7. Within the set time (e.g., 5 minutes) after opening and closing the freezing compartment door, when at least one of the case where the deep freezing compartment temperature enters the upper limit temperature range and the case where the temperature rises above the set temperature (e.g., 5° C.) is satisfied The condition 7 is the same as the input condition for the deep freezing compartment load correspondence operation (or the deep freezing compartment load removal operation), and the set time 5 minutes and the set temperature 5° C. may be set to different values.

Condition 8. When the indoor temperature zone (RT zone) is greater than or equal to the setting region (e.g., Z7)

The setting region RT zone 7 is only an example and may be set to a different value.

The controller may store a lookup table divided into a plurality of room temperature zones (RT zones) according to a range of the room temperature. As an example, as shown in Table 1 below, it may be subdivided into eight room temperature zones (RT zones) according to the range of the room temperature. However, the present invention is not limited thereto.

TABLE 1

| High temperature region | | Medium temperature region | | | Low temperature region | | |
|---|---|---|---|---|---|---|---|
| RT Zone 1 | RT Zone 2 | RT Zone 3 | RT Zone 4 | RT Zone 5 | RT Zone 6 | RT Zone 7 | RT Zone 8 |
| T = 38° C. | 34° C. < T < 38° C. | 27° C. < T < 34° C. | 22° C. < T < 27° C. | 18° C. < T < 22° C. | 12° C. < T < 18° C. | 8° C. < T < 12° C. | T < 8° C. |

In more detail, a zone of the temperature range with the highest room temperature may be defined as an RT zone 1 (or Z1), and a zone of the temperature range with the lowest room temperature may be defined as an RT zone 8 (or Z8). Here, Z1 may be mainly seen as the indoor state in midsummer, and Z8 may be seen as an indoor state in the middle of winter.

Furthermore, the room temperature zones may be grouped into a large category, a medium category, and a small category. For example, as shown in Table 1, the room temperature zone may be defined as a low temperature zone, a medium temperature zone (or a comfortable zone), and a high temperature zone according to the temperature range. The case in which the time at which the condition 7 is satisfied and the time point at which the defrost period elapses are the same will be described.

In detail, the input condition for the deep freezing compartment load operation is a variable defrost period release condition and is not added to the final defrost period calculation. That is, the defrost period finally calculated is shorter than the defrost period that is set initially.

A situation may occur in which a time point at which a defrosting period finally calculated in consideration of the deep freezing compartment load corresponding operation input condition elapses coincides with a time point at which the input condition for the deep freezing compartment load correspondence operation is satisfied.

This situation corresponds to a case where the deep freezing compartment load correspondence operation and the freezing compartment/deep freezing compartment defrost operation conflict with each other at the same time.

When these two situations conflict with each other, the deep freezing compartment load correspondence operation may be performed by priority, and when the deep freezing compartment load correspondence operation is ended, the freezing compartment/deep freezing compartment defrost operation may be subsequently performed.

The reason for this is that the fact that the input condition for the deep freezing compartment load operation is satisfied means that a heat load such as food has penetrated into the deep freezing compartment and also means that frost may form on the surface of the cold sink of the thermoelectric module, and an amount of frost or ice that is forming is likely to increase. Therefore, since there is a great need to shorten the final defrost period (POD), the variable defrost period is released.

If the timing at which the input condition for the deep freezing compartment load operation is satisfied is different from the time point at which the input condition for the defrost operation is satisfied after the finally calculated defrost period elapses, the time point at which the input condition for the defrost operation is satisfied may be performed by priority from the earliest operation.

When the defrosting period does not yet elapse at the time point at which the deep freezing compartment load correspondence operation is completed, the defrost operation may be performed after the defrosting period elapses.

The initial defrost period included in the defrost period may be the same. As an example, the initial defrost period may be 4 hours, but is not limited thereto.

A normal defrost period included in the defrost period of the first freezing compartment may be set to be shorter than the normal defrost period included in the defrost period of the second freezing compartment. For example, the normal defrost period included in the defrost period of the first freezing compartment may be set to 5 hours, and the normal defrost period included in the defrost period of the second freezing compartment may be set to 7 hours, but is not limited thereto.

The variable defrost period included in the defrost period of the first freezing compartment may also be set shorter than the variable defrost period included in the defrost period of the second freezing compartment. For example, the variable defrost period included in the defrost period of the first freezing compartment may be set to 10 hours (the time shortened when the freezing compartment door is opened for about 85 seconds), and the variable defrost period included in the defrost period of the second freezing compartment may be set to 36 hours (the time shortened when the freezing compartment door is opened for about 308 seconds), but is not limited thereto.

In addition, the condition for shortening (reducing) the variable defrost period included in the defrost period of the first freezing compartment and the condition for shortening (reducing) the variable defrost period included in the defrost period of the second freezing compartment may be the same or set differently.

In addition, the condition for releasing the variable defrost period included in the defrost period of the first freezing compartment may include the conditions 1 to 7, and the condition for releasing the variable defrost period included in the defrost period of the second freezing compartment includes the conditions 1 to 4 and 8.

Here, the reason that the condition 8 is not included in the defrost period of the first freezing compartment is to prevent an increase in power consumption due to too often the defrost operation in a low temperature region.

The calculation condition of the defrost period of the first freezing compartment and the calculation condition of the defrost period of the second freezing compartment described above may be summarized as shown in Table 2 below.

TABLE 2

| Item | | First freezing compartment defrost period | Second freezing compartment defrost period |
|---|---|---|---|
| Initial defrost period | | 4 hours | 4 hours |
| Normal defrost period | | 5 hours | 7 hours |
| Variable defrost period | | 10 hours | 36 hours |
| Variable defrost period Shortening condition | | Reduced by 7 minutes per second when freezing compartment door is opened | Reduced by 7 minutes per second when freezing compartment door is opened |
| Variable defrost period release condition (satisfied if at least one is included) | Condition 1 | Including | Including |
| | Condition 2 | Including | Including |
| | Condition 3 | Including | Including |
| | Condition 4 | Including | Including |
| | Condition 5 | Including | non-including |
| | Condition 6 | Including | non-including |
| | Condition 7 | Including | non-including |
| | Condition 8 | non-including | Including |

According to the above example, it is seen that the defrost period of the first freezing compartment may be a maximum of 19 hours and a minimum of 9 hours, and the defrost period of the second freezing compartment may be a maximum of 47 hours and a minimum of 11 hours. However, the defrost period may be appropriately adjusted and set according to the situation.

If it is determined that the deep freezing compartment mode is in the on state, and the defrost period of the first freezing compartment elapses, the controller determines whether the input condition for the deep freezing compartment load correspondence operation is satisfied (S240).

As already described above, when it is determined that the input condition for the defrost operation is satisfied after the defrost period elapses, the input condition for the deep freezing compartment load correspondence operation is also satisfied, the deep freezing compartment load correspondence operation may be performed first (S250).

After the deep freezing compartment load correspondence operation is completed (S260), the defrost operations of the freezing compartment and the deep freezing compartment are performed.

On the other hand, when the input condition for the deep freezing compartment load operation is not satisfied, the defrost operations of the freezing compartment and the deep freezing compartment are immediately performed.

However, the spirit of the present invention is not limited to necessarily perform the operation S240 in a state in which the defrost period of the first freezing compartment elapses. In other words, even if the input condition for the deep freezing compartment load operation is satisfied, it is possible to ignore this and allow the defrost operation to be performed immediately. That is, a control algorithm in which the operations S240 to S260 are omitted (or deleted) is also possible.

In detail, when the defrost period of the first freezing compartment elapses or the deep freezing compartment load correspondence operation is completed, a deep cooling operation for cooling the freezing compartment and the deep freezing compartment is performed (S270).

In order to end the deep cooling operation, temperatures inside the freezing compartment and the deep freezing compartment or a deep cooling operation execution time may be set as conditions.

For example, when at least one of the freezing compartment and the deep freezing compartment is cooled to a temperature lower than the control temperature by a set temperature, the deep cooling operation may be ended. The control temperature may include a second satisfied critical temperature N22 or N32 illustrated in FIG. 7. It should be noted that the set temperature may be 3° C., but is not limited thereto.

The reason for performing the deep cooling operation before the defrost operation is to sufficiently cool the freezing compartment and the defrost compartment to a temperature lower than the satisfactory temperature through the deep cooling operation, thereby preventing a rapid increase in load in the freezing compartment and the deep freezing compartment during the defrost operation. It is seen as a so-called supercooling operation of the freezing compartment and the deep freezing compartment, which is performed before the defrost operation.

While the deep cooling operation is being performed, the controller determines whether the completion condition for the deep cooling operation is satisfied (S280), and when it is determined that the deep cooling completion condition is satisfied, the defrost operation of the freezing compartment and the deep freezing compartment may be performed in earnest (S290).

When the defrost operations of the freezing compartment and the deep freezing compartment start, both the cold sink heater 40 and the back heater 43 are turned on, and the cold sink heater 40 and the back heater 43 may be maintained in the on state until both the defrost operation of the freezing compartment and the deep freezing compartment are completed.

During the defrost operation of the freezing compartment and the defrost operation of the deep freezing compartment, the frost or ice formed on the surface of the freezing compartment evaporator, the surface of the cold sink of the thermoelectric module, the rear surface of the housing accommodating the heat sink of the thermoelectric module may be melted to from defrost water, and the defrost water may be collected by a drain pan with the freezing evaporation compartment installed on the floor.

Here, there is no limitation in priority of the defrost operation of the deep freezing compartment and the defrost operation of the freezing compartment. In other words, a start time of the defrost operation of the deep freezing compartment and a start time of the defrost operation of the freezing compartment may be set differently or may be set to the same time.

More specifically, when the deep cooling operation is completed, both the deep freezing compartment defrost and the freezing compartment defrost are performed, and the two defrost operations may start with a time difference or may start simultaneously.

The specific contents of the defrost operation of the freezing compartment and the defrost operation of the deep freezing compartment will be described in more detail below.

In addition, the controller determines whether both the defrost operation of the freezing compartment and the defrost operation of the deep freezing compartment are completed (S300). If either one of the defrost operation of the freezing compartment and the defrost operation of the deep freezing compartment is not completed, the processes after the defrost operation are not performed until both the defrost operations are completed.

When it is determined that both the freezing compartment defrost and the deep freezing compartment defrost are completed, the defrost period of the first freezing compartment is initialized, the cold sink heater 40 and the back heater 43 are turned off, and the operation after the defrosting is performed (S310). The operation after the defrosting may include an operation after the defrosting in the deep freezing compartment and operation after the defrosting in the freezing compartment.

In more detail, the operation after defrosting in the deep freezing compartment may include the above-described deep freezing compartment load correspondence operation. In detail, the input condition for the deep freezing compartment load correspondence operation are as follows.

First, when the deep freezing compartment mode is switched from the off state to the on state.

Second, when the deep freezing compartment mode is switched from the off state to the on state in the state in which the refrigerator power is turned off.

Third, when the input condition for the deep freezing compartment load operation is satisfied.

Fourth, when the first refrigeration cycle operation is performed after the defrost operation of the deep freezing compartment.

When the deep freezing compartment load correspondence operation starts, the deep freezing compartment fan may be driven, and a constant voltage may be applied to the thermoelectric element. At the same time, the compressor is driven, and the simultaneous operation in which both the refrigerator compartment valve and the freezing compartment valve are opened is performed.

In addition, in the operation process after the freezing compartment defrost is performed after the freezing compartment defrost is completed, the freezing compartment fan is maintained in a stopped state for a set time (e.g., 10 minutes) after the compressor is driven, and when the set time elapses, the freezing compartment fan rotates to perform the cooling of the freezing compartment.

Here, in the operation process after defrosting the freezing compartment, the reason for driving the freezing compartment fan after a predetermined time elapses from the time of driving the compressor is as follows.

In detail, when the defrost operation of the freezing compartment is finished, the temperature of the freezing compartment evaporator is in a state of rising, and the compressor is driven to lower the temperature of the refrigerant passing through the freezing compartment expansion valve to a normal temperature (e.g., approximately −30° C.). Here, it takes a predetermined time to allow the refrigerant flowing through the freezing compartment evaporator to drop to the normal temperature (e.g., about −20° C.).

In other words, if the freezing compartment fan is driven before the freezing compartment evaporator temperature drops to the normal temperature, it may result in an increase in freezing compartment load. Therefore, the freezing compartment fan rotates after the set time elapses after the compressor is driven so as to be cooled to the normal cooling of the freezing compartment.

When the operation after defrosting is completed, and the deep freezing compartment and the freezing compartment enter the satisfactory temperature range, the process returns to the operation S210 in which the normal cooling operation is performed while the refrigerator is powered on (S227).

If it is determined that the defrost period of the second freezing compartment elapses in the deep freezing compartment mode in the off state, the cooling of the deep freezing compartment is performed (S222), and when the deep cooling completion condition for freezing compartment is satisfied (S223), the defrost operation of the freezing compartment is performed (S224).

When the completion condition for the freezing compartment defrost operation is satisfied (S225), the defrost operation of the freezing compartment is completed, and simultaneously, the defrost period is initialized, and then the defrost operation of the freezing compartment is performed (S226). As long as the refrigerator is powered on (S227), the defrost operation algorithm is repeatedly performed from the normal cooling operation process (S210).

If "the defrost operation of the storage compartment A" and "the defrost operation of the storage compartment B" are performed so as not to overlap each other in at least partial section, instead of determining whether the defrost period of the storage compartment A elapses, whether the defrost period of the storage compartment B elapses may be determined.

On the other hand, in the case of the refrigerant circulation system or structure in which "the defrost operation of the storage compartment A" and "the defrost operation of the storage compartment B" are independently performed, the defrost period of the first freezing compartment of operation S230 in FIG. 17 is replaced with the defrost period of the storage compartment A, the operation of the freezing compartment is deleted in operations S270, S290, S300, and S310, the operation after defrosting the freezing compartment is deleted in operation S310, and the operations S221 to S226 may be deleted. FIG. 16, the freezer compartment fan and the freezer compartment defrost heater may be removed.

Hereinafter, a specific method of defrosting the refrigerating compartment and the deep freezing compartment will be described.

The defrosting of the deep freezing compartment may be defined as an operation for removing frost or ice formed in a thermoelectric module provided to cool the deep freezing compartment, and the defrosting of the freezing compartment defrost may be defined as an operation for removing frost or ice formed in a freezing compartment evaporator provided for freezing the freezing compartment.

Figure 19:
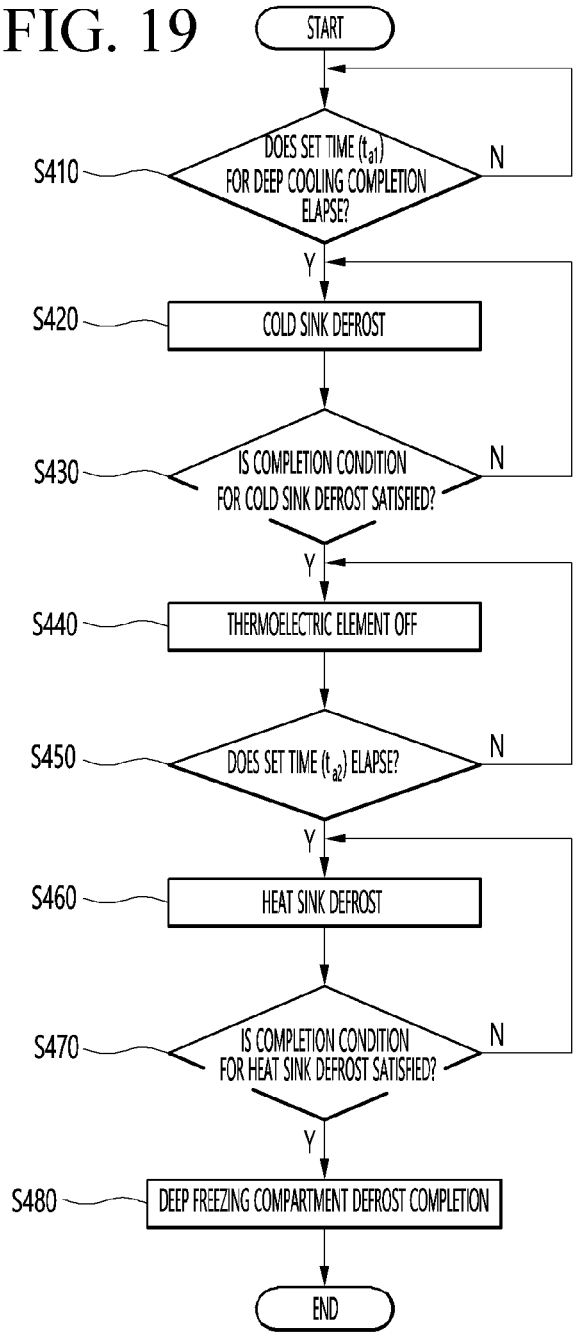
FIG. 19 is a flowchart illustrating a method for controlling the defrost operation of the deep freezing compartment according to an embodiment of the present invention.

Referring to FIG. 19 to be described later, as described above, "the defrost operation of the storage compartment A" according to the present invention includes a cold sink defrost operation and a heat sink defrost operation of the thermoelectric module provided for cooling of the storage compartment A.

In detail, in a "sub-zero system or structure", in order to reduce the formation of vapor around the heat sink of the storage compartment A on the heat sink of the storage compartment A, "the defrost operation of the storage compartment A" includes a cold sink defrost operation and a heat sink defrost operation.

The "sub-zero system or structure" may be defined as a refrigerant circulation system or structure in which the heat sink of storage compartment A is also maintained to a sub-zero temperature together with the cold sink of storage compartment A to maintain the temperature of storage compartment A to the sub-zero temperature.

In addition, in the "heat sink communication type structure" or "heat sink non-communication type structure", in order to reduce the formation of vapor around the heat sink of the storage compartment A on the heat sink of the storage compartment A, "the defrost operation of the storage compartment A" includes a cold sink defrost operation and a heat sink defrost operation.

The "heat sink communicating structure" may be defined as a structure in which the heat sink of the storage compartment A is exposed to or communicates with the cooling device chamber of the storage compartment B.

The "heat sink non-communicative structure" may be defined as a structure in which the heat sink of the storage compartment A is adjacent to a wall forming the cooling device chamber of the storage compartment B and is not sufficiently insulated from the wall of the cooling device chamber.

The "structure that is not sufficiently insulated" means a structure having lower thermal insulation performance than that of a thermal insulation wall (the deep freezing case) partitioning the inside of the storage compartment A from the storage compartment B.

In at least one of the refrigerant circulation system or the refrigerator structure in which "the defrost operation of the storage compartment A" and "the defrost operation of the storage compartment B" overlap each other in at least partial section, the heat sink defrost operation may be performed to reduce the formation of the vapor generated during "the defrost operation of the storage compartment B" on the heat sink of the storage compartment A.

Regardless of the order of the cold sink defrost operation time and the heat sink defrost operation time, the operation may be alternately performed.

The present invention may be applied to at least one of the "sub-zero system or structure", the "heat sink communicating structure", and the "heat sink non-communicating structure".

The heat sink has to be interpreted as including a heat conductor including a heat conduction plate and a heat exchange fin, or a heat transfer member including a heat conductor and a housing for accommodating the heat conductor.

Hereinafter, the description will be limited to the case in which the storage compartment A is the deep freezing compartment.

Figure 18:
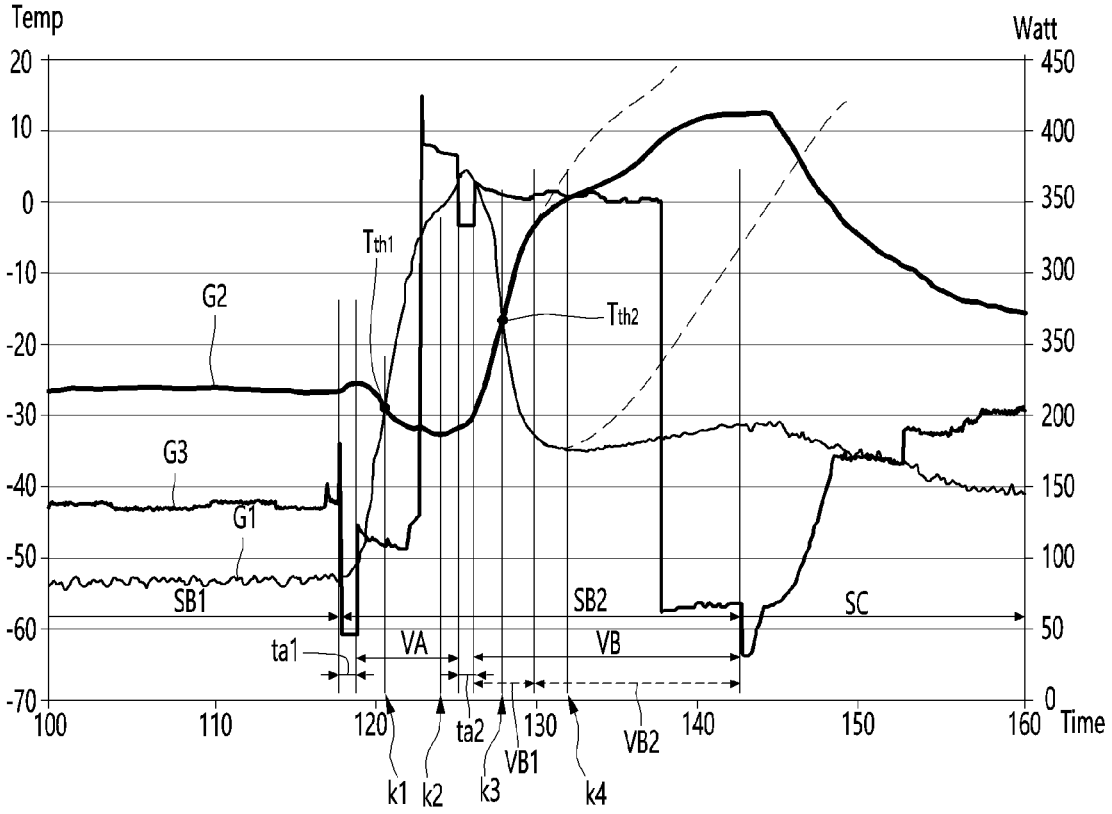
FIG. 18 is a graph illustrating a variation in temperature of a thermoelectric module as time elapses while the defrost operation of the deep freezing compartment is performed.

FIG. 18 is a graph illustrating a variation in temperature of the thermoelectric module as time elapses while the defrost operation of the deep freezing compartment is performed, and FIG. 19 is a flowchart illustrating a method for controlling the defrost operation of the deep freezing compartment according to an embodiment of the present invention.

Referring first to FIG. 19, a first embodiment for the defrost operation of the deep freezing compartment is characterized in that the cold sink defrost operation is first performed, and then the heat sink defrost operation is performed.

In detail, as described in FIG. 17, when the deep cooling operation is performed after the freezing compartment defrost period elapses when the deep freezing compartment mode is in the on state, and the temperatures of the freezing compartment and the deep freezing compartment are sufficiently cooled (supercooled) to a temperature lower than the satisfactory temperature, the deep cooling operation is completed.

The controller determines whether a set time $t_{a1}$ elapses after the deep cooling operation is completed before the cold sink defrost operation starts. The set time $t_{a1}$ may be 2 minutes, but is not limited thereto.

Here, the reason for determining whether the set time $t_{a1}$ elapses after the completion of the deep cooling operation is that a direction of the voltage supplied to the thermoelectric element has to be changed for the cold sink defrost operation. That is, it has to be switched from a constant voltage supply for the deep cooling to a reverse voltage supply for the cold sink defrosting.

When the direction of the voltage supplied to the thermoelectric element is changed, a rest period in which the voltage is not supplied for a set time is required. If the polarity of the voltage supplied to both ends of the thermoelectric element is abruptly changed, a thermal shock may occur due to a change in temperature to cause a problem in that the thermoelectric element is damaged, or its lifespan is shortened.

In addition, even when supplying current (or power) to the thermoelectric element, it is preferable to increase in amount of supply current stepwise or gradually, rather than supplying the set current at once.

Specifically, when supplying the power to the thermoelectric element, rather than supplying the maximum current at once, the amount of supply current increases gradually or stepwise so that the maximum voltage is applied to both ends of the thermoelectric element after a predetermined time elapses to minimize the thermal shock that may occur in the thermoelectric element. This is equally applied not only when supplying the constant voltage but also when supplying the reverse voltage.

In addition, as soon as the power supplied to the thermoelectric element is cut off, the voltage applied to the thermoelectric element does not drop to 0 V, but gradually drops. Therefore, when the supply of the constant voltage is stopped, and the reverse voltage is immediately supplied, the residual current remaining in the thermoelectric element and the reverse current supplied may conflict with each other, and the circuit in the thermoelectric element may be damaged.

For this reason, when switching the polarity (or direction) of the current supplied to the thermoelectric element, it is preferable to leave the rest period for a certain time.

When the set time $t_{a1}$ elapses, the reverse voltage is applied to the thermoelectric element to perform the cold sink defrost operation (S420). When the reverse voltage is applied to the thermoelectric element 21, the cold sink 22 becomes a heat generation surface, and the heat sink 24 becomes a heat absorption surface.

Referring to FIG. 18, as described with reference to FIG. 16, a refrigerator operation section includes a normal cooling operation section SA, a section SB in which the defrost operation is performed after the defrost operation period elapses, and a defrost operation section SC after the defrosting performed after the defrost operation is completed.

In addition, the defrost operation section SB may be more specifically divided into a deep cooling section SB1 in which deep cooling is performed and a defrosting section SB2 in which a full-scale defrost operation is performed.

Here, a graph G1 is a graph of a change in temperature of the cold sink (temperature of the heat absorption surface of the thermoelectric element when the constant voltage is supplied), a graph G2 is a temperature of the heat sink (temperature of the heat generation surface of the thermoelectric element when the constant voltage is supplied), and a graph G3 is a graph of a change in power consumption of the refrigerator.

In the deep cooling operation section SB1, the cold sink 22 has a temperature within a range of approximately −50° C. to −55° C., and the heat sink 24 has a temperature within a range of approximately −25° C. to −30° C. In the deep cooling operation section SB1, the highest constant voltage is applied to the thermoelectric element.

When the deep cooling operation is ended, the constant voltage supply to the thermoelectric element is stopped. After a rest period for the set time $t_{a1}$ elapses, the reverse voltage is applied to the thermoelectric element.

As the reverse voltage applied to the thermoelectric element 21 increases, the temperature of the cold sink increases and the temperature of the heat sink decrease. That is, when the reverse voltage is applied to the thermoelectric element, the temperature of the cold sink increases from −50° C. to a zero temperature, for example, about 5° C., and the heat sink increases from a temperature of about −30° C. and then drops to a temperature about −35° C. As shown in the graph, it is seen that a temperature increase rate of the cold sink is higher than a temperature decrease rate of the heat sink.

It is seen that the temperatures of the cold sink and the heat sink become the same at a time point tk1 when a predetermined time elapses from a time point at which the reverse voltage is applied, and then the temperatures of the cold sink and the heat sink are reversed. It is seen that an inversion critical temperature $T_{th1}$ of the cold sink and the heat sink, that is, a temperature at which the temperatures of the cold sink and the heat sink become the same, is about −30° C. The inversion critical temperature $T_{th1}$ in the cold sink defrost operation section may be defined as a first inversion critical temperature.

As shown in the graph, when the reverse voltage is applied to the thermoelectric element, the temperature of the cold sink steeply increases to the zero temperature, while the temperature of the heat sink decreases relatively gently.

A temperature difference ΔT between the heat absorption surface and the heat generation surface of the thermoelectric element decreases until the inversion critical temperature is reached k1, and after the inversion critical temperature is reached k1, and then, the temperature difference ΔT between the heat absorption surface and the heat generation surface of the thermoelectric element gradually increases again until the temperature difference ΔT reaches the maximum value ΔT of the corresponding thermoelectric element.

In detail, the heat absorption surface of the thermoelectric element in contact with the cold sink functions as the heat absorption surface, and the heat absorption surface of the thermoelectric element in contact with the heat sink functions as the heat absorption surface from the moment when the reverse voltage is applied. However, a phenomenon in which the temperature of the cold sink becomes higher than the temperature of the heat sink occurs after a predetermined time elapses from the time point at which the reverse voltage is applied.

It is seen that the temperature of the heat sink also increases after a time point k2 at which the ΔT value becomes the maximum value. This is due to the characteristic of the thermoelectric element that, when the ΔT value reaches the maximum value, the temperature difference between the heat generation surface and the heat absorption surface does not increase any more even when the supply voltage increases. That is, when the temperature of the heat generation surface increases at the time point at which ΔT is the maximum, this is due to the characteristic of the thermoelectric element, in which the temperature of the heat absorption surface also increases due to a thermal backflow phenomenon, which has already been described above.

As a result, from the time point k2 at which ΔT becomes the maximum, the temperature of the cold sink as well as the heat sink increases together, and this phenomenon continues until the reverse voltage supply is stopped. In the graph, the section VA is defined as a reverse voltage supply section, and in this section, the section VA is defined as a cold sink defrost operation section.

Returning to FIG. 19, when the cold sink defrost operation is performed, in addition to applying the reverse voltage to the thermoelectric module, the deep freezing compartment fan is driven so that the vapor generated during the cold sink defrost operation is discharged into the freezing evaporation compartment.

Here, in order to prevent or reduce the discharged vapor from being frozen in the defrost water passage, which is formed by the defrost water guide 30, and on the partition wall 103, the controller controls the back heater 43 to be turned on.

While the cold sink defrost is being performed, the controller continuously determines whether the completion condition for the cold sink defrost is satisfied (S430).

For example, when the surface temperature of the cold sink is equal to or higher than a set temperature $T_{ss}$, or when a defrost operation time, specifically, a reverse voltage supply time elapses a set time $t_{ss}$, the completion condition for the cold sink defrost may be set to be satisfied. Here, the set temperature $T_{ss}$ is 5° C., the set time $t_{ss}$ may be 60 minutes, but is not limited thereto.

If it is determined that the completion condition for the cold sink defrost is satisfied, the thermoelectric element is turned off (S440). That is, the supply of the reverse voltage to the thermoelectric element is stopped.

When the set time $t_{a2}$ elapses (S450), the heat sink defrost operation is performed (S460).

Referring back to the graph of FIG. 18, when the cold sink defrost (section VA) is ended, there is the rest period, in which the power supply to the thermoelectric element is stopped, for a set time $t_{a2}$. The set time $t_{a2}$ may be 2 minutes, but is not limited thereto. The reason for having the rest period is the same as described above.

When the set time $t_{a2}$ elapses, the constant voltage is supplied to the thermoelectric element so that the heat sink functions as the heat generation surface again to be heated.

The heat sink 24 is accommodated in a heat sink accommodation portion 271 (see FIG. 9) formed in the housing 27, and a space between the heat sink 24 and the heat sink accommodation portion 271 is sealed completely by a sealing agent. Thus, frost or ice is not generated between the heat sink 24 and the heat sink accommodating portion 271.

However, since the defrost operation of the deep freezing compartment and the defrost operation of the freezing compartment are performed together, in the cold sink defrost section VA, vapor generated by melting ice attached to the surface of the freezing compartment evaporator floats in the freezing evaporation compartment.

During the cold sink defrost operation, the surface temperature of the heat sink 24 is maintained at an ultrafrezing temperature of about −30° C. This temperature is about 10 degrees lower than the freezing evaporation compartment temperature.

In detail, since the surface temperature of the heat sink, specifically, the surface temperature of the housing 27 accommodating the heat sink is lower than the freezing evaporation compartment temperature, frost may form on the surface of the housing 27. This may be said to be the same as the principle that dew forms on a surface of a kettle filled with cold water in midsummer. Since the surface temperature of the housing 27 is significantly lower than the freezing temperature, the dew formed on the surface of the housing 27 is immediately frozen and converted into ice.

The surface of the housing 27 means a surface of the housing 27 exposed to the freezing evaporation compartment. The surface of the housing 27 that is in contact with the heat sink 24 may be defined as a front surface.

Therefore, during the cold sink defrost operation, a defrost operation for removing the frost or ice formed on the rear surface of the housing 27 needs to be performed, which is defined as a heat sink defrost operation.

In order to defrost the heat sink for removing ice attached to the rear surface of the housing 27, if the constant voltage is applied to the thermoelectric element, the temperature 24 of the heat sink increases, and the temperature of the cold sink 22 decreases. At a time point k3, an inversion critical temperature $T_{th2}$ at which the temperatures of the cold sink and the heat sink are the same is reached. The inversion critical temperature $T_{th2}$ in the heat sink defrost section may be defined as a second inversion critical temperature.

The second inversion critical temperature is higher than the first inversion critical temperature.

This is because the temperature section of the cold sink and the heat sink at the start time of the defrosting of the heat sink is higher than the temperature section of the cold sink and the heat sink at the time of the defrosting of the cold sink.

In other words, the cold sink temperature starts to increase from −55° C. at a time point at which the cold sink defrost operation starts. However, the heat sink temperature starts to increase from about −30° C. at a time point at which the heat sink defrost operation starts.

The heat sink temperature decreases from about −30° C. at a time point at which the cold sink defrost operation starts. However, the cold sink temperature starts to decrease from about 5° C. at a time point at which the heat sink defrost operation starts.

For this reason, the second inversion critical temperature is higher than the first inversion critical temperature.

After the second inversion critical temperature is reached k3, the temperature of the cold sink becomes higher again than the temperature of the heat sink.

Here, when the constant voltage is applied to the thermoelectric element, and the highest constant voltage is supplied from beginning to end, as expressed by a dotted line in FIG. 18, the temperature of the cold sink also rapidly increases from a time point k4.

This may be explained as being due to the characteristic of the thermoelectric element that the ΔT value does not increase beyond the maximum value, as described above.

In other words, since the ΔT value is maintained at the maximum value from the time point at which the ΔT value of the heat generation surface and the heat absorption surface is maximum, as the temperature of the heat generation surface increase, the temperature of the heat absorption surface may increase also.

In this case, when the temperature of the heat sink attached to the heat generation surface of the thermoelectric element increases, a defrosting effect of removing the ice attached to the housing 27 may be improved. However, as the temperature of the cold sink increases, the heat absorption ability of the cold sink may be deteriorated to cause an adverse effect of deteriorating the cooling capacity and efficiency of the thermoelectric module.

In order to prevent the cooling capacity and efficiency of the thermoelectric element from being deteriorated due to this phenomenon, it is preferable to supply the highest constant voltage for a predetermined time and then supply the medium constant voltage thereafter. That is, the heat sink defrost section VB may be divided into a highest constant voltage section VB1 and a medium constant voltage section VB2.

In this way, the maximum constant voltage is applied to the thermoelectric element for a predetermined time, and then, the medium constant voltage is applied to minimize the increase in temperature of the cold sink, thereby minimizing the increase in load of the deep freezing compartment. It should be noted that the highest constant voltage section may be set shorter than the medium constant voltage section, but may be appropriately changed according to design conditions.

Returning to FIG. 19, while the heat sink defrost operation is performed (S460), the controller determines whether the completion condition for the heat sink defrosting is satisfied (S470).

For example, when the defrost operation of the freezing compartment is completed, the completion condition for the heat sink defrost operation may be set to be satisfied. In other words, when the defrost operation of the freezing compartment is completed, the heat sink defrost operation may also be completed.

If it is determined that the completion condition for the heat sink defrost is satisfied, the defrost operation of the deep freezing compartment is completely completed (S480), and the process proceeds to the operation process after the defrost.

During the heat sink defrost operation section, that is, during the defrosting of the rear surface of the housing 27, vapor generated in the cold sink defrost process exists in the deep freezing compartment. During the cold sink defrost operation, the surface temperature of the cold sink rises to the freezing point temperature to melt the ice attached to the surface of the cold sink.

However, although the surface temperature of the cold sink is a temperature of above zero, the temperature inside the deep freezing compartment is higher than a temperature of −50° C., which corresponds to a temperature before the defrost operation, but still below about −30° C., which is a cryogenic temperature, specifically is maintained to a temperature of about −38° C.

Thus, the vapor generated in the cold sink defrosting process may be attached to form frost on the inner wall of the deep freezing compartment while the heat sink defrost operation is performed and then may be grown over time.

When frost or ice is formed and grown on the inner wall of the deep freezing compartment, it is not easy to remove the frost or ice. In order to prevent the frost or ice from forming on the inner wall of the deep freezing compartment, a separate defrost heater has to be installed on the inner wall of the deep freezing compartment. This may cause various unpredictable problems, including an increase in manufacturing cost of the refrigerator, as well as an increase in power consumption due to the operation of the defrost heater.

In addition, since the deep freezing compartment drawer is frozen by the frost or ice growing on the inner wall of the deep freezing compartment, it may be impossible or difficult to withdraw a deep freezing compartment drawer. Furthermore, if excessive pulling force is applied to take out the deep freezing compartment drawer, it may result in the deep freezing compartment drawer being damaged.

Therefore, during the heat sink defrost operation, it is necessary to prevent in advance the phenomenon that the vapor generated during the cold sink defrosting process is formed on the inner wall of the deep freezing compartment.

According to FIG. 20 to be described later, in the present invention, the control is required to reduce the re-attachment of vapor generated during "the defrost operation of the storage compartment A" on the inner wall surface of the storage compartment A. For this, the controller may drive the fan of the storage compartment A or apply the constant voltage to the thermoelectric module.

For example, in the "vapor communication type structure", in order to reduce the re-attachment of the vapor generated during "the defrost operation of the storage compartment A" on the inner wall surface of the storage compartment A, and to discharge the vapor to the external space, the fan of the storage compartment A may be controlled to be driven.

The "vapor communication type structure" may be defined as a structure in which the heat absorption-side of the thermoelectric module of the storage compartment A is exposed to or communicates with an external space except for the space of the storage compartment A.

In addition, it may be controlled so that the constant voltage is applied to the thermoelectric module of the storage compartment A together with the driving of the fan in the storage compartment A. Then, the amount of vapor re-attachment on the heat absorption-side of the thermoelectric module of the storage compartment A increases, so that the phenomenon of re-attachment on the inner wall of the storage compartment A may be minimized.

Second, in the "vapor non-communicable structure", in order to reduce the re-attachment of the vapor generated during the defrost operation of the storage compartment A on the inner wall surface of the storage compartment A, and to induce re-attachment on the heat absorption-side of the thermoelectric module of the storage compartment A, the constant voltage may be applied to the thermoelectric module to drive the fan of the storage compartment A.

The "vapor non-communicable structure" may be defined as a structure in which the heat absorption-side of the thermoelectric module of the storage compartment A is not exposed to and does not communicate with an external space other than the space of the storage compartment A.

The external space may include a cooling device chamber outside the refrigerator or storage compartment B.

Here, the time point at which the constant voltage is applied to the thermoelectric module and the time point at which the fan of the storage compartment A is driven do not have to be the same. However, it may be advantageous to drive the fan of the storage compartment A after the constant voltage is applied to the thermoelectric module. In other words, if the fan of the storage compartment A is driven after the heat absorption-side of the thermoelectric module is sufficiently cooled, the vapor may be re-attached more effectively on the heat absorption-side of the thermoelectric module.

The present invention may be applied to at least one of the "vapor communication type structure" and the "vapor communication type structure".

Hereinafter, the description will be limited to the case in which the storage compartment A is the deep freezing compartment.

Hereinafter, in order to reduce the re-attachment of the vapor generated during the defrost operation of the storage compartment A on the inner wall surface of the storage compartment A, a constant voltage is applied to the storage compartment A thermoelectric module and the fan of the storage compartment A is controlled to be driven as an example.

Figure 20:
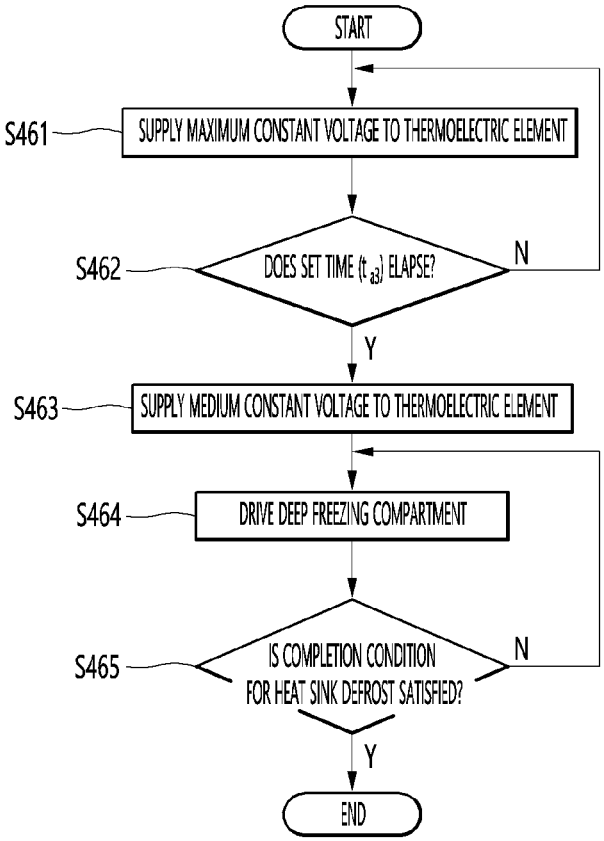
FIG. 20 is a flowchart illustrating a method for controlling the refrigerator to prevent frost from being generated on an inner wall of the deep freezing compartment during the defrost operation of the deep freezing compartment.

FIG. 20 is a flowchart illustrating a method for controlling the refrigerator to prevent frost from being generated on the inner wall of the deep freezing compartment during the defrost operation of the deep freezing compartment.

Referring to FIGS. 18 to 20, as described in FIG. 19, when the heat sink defrost operation starts, the controller supplies the highest constant voltage to the thermoelectric element for a set time ta3 (S461). When the set time ta3 elapses (S462), a medium constant voltage is supplied to the thermoelectric element (S463).

When the medium constant voltage is supplied to the thermoelectric element, the deep freezing compartment fan is driven (S464). The deep freezing compartment fan may be controlled to be driven at the same time as a medium constant voltage is supplied to the thermoelectric element, or may be controlled to be driven with a slight time difference.

If the deep freezing compartment fan is driven while the medium constant voltage is supplied to the thermoelectric element, as illustrated in FIG. 10, the cold air inside the deep freezing compartment is suctioned toward the deep freezing compartment fan 25 to conflict with the cold sink 22, and thus, a flow direction of the cold air is switched in the vertical direction. A circulation of the cold air discharged again into the deep freezing compartment 202 through the deep freezing compartment side discharge grills 533 and 534 occurs.

In this process, the vapor contained in the cold air of the deep freezing compartment is attached on the cold sink 22 that quickly drops to a low temperature.

Here, the reason why the deep freezing compartment fan is controlled to be driven when the medium constant voltage is supplied to the thermoelectric element is as follows.

In detail, since the temperature of the cold sink is raised to an above zero temperature during the cold sink defrost, it takes time for the temperature of the cold sink to drop to a sub-zero temperature even when the constant voltage is applied to the thermoelectric element.

Therefore, when the temperature of the cold sink is sufficiently lowered by applying the highest constant voltage to the thermoelectric element, the deep freezing compartment fan has to be driven, and thus the vapor inside the deep freezing compartment may be effectively attached on the surface of the cold sink.

As illustrated in FIG. 18, the cold sink is cooled to the lowest temperature when the voltage applied to the thermoelectric element is switched from the highest constant voltage to the medium constant voltage. Therefore, if the deep freezing compartment fan is driven at this time, the amount of vapor in the deep freezing compartment that is attached on the surface of the cold sink per unit time increases, and thus the vapor attachment effect may be maximized.

The controller determines whether the completion condition for the defrost of the heat sink is satisfied, that is, whether the defrost operation of the freezing compartment is completed (S465), and when it is determined that the completion condition for the heat sink defrost is satisfied, the power supply to the thermoelectric element is cut off to stop the driving of the fan of the deep freezing compartment.

So far, the first embodiment of the defrost operation of the deep freezing compartment according to the present invention, that is, a method in which the cold sink defrost is performed first, and then the heat sink defrost operation is performed has been described.

A method of a defrost operation of a deep freezing compartment according to a second embodiment of the present invention is characterized in that a defrost operation of a heat sink is performed first, and a defrost operation of a cold sink is performed thereafter.

In detail, according to the second embodiment in which the heat sink defrost operation is performed first, there is no need to have a rest period for stopping power supply to a thermoelectric element before the heat sink defrost operation starts.

This is because, since a constant voltage is supplied to the thermoelectric element in both the deep cooling operation and the heat sink defrost operation, electrode conversion is not required.

Thus, unlike in the first embodiment, the heat sink defrost operation may be performed immediately after the deep cooling operation is completed without a rest time $t_{a1}$. In addition, there is no need to cut off the power supply to the thermoelectric element after the deep cooling is ended.

When the heat sink operation starts, a freezing compartment valve is closed so that the refrigerant does not flow to the heat sink and a freezing compartment evaporator, and the defrost operation of the freezing compartment is performed together.

During the heat sink operation, unlike the first embodiment, it may be controlled so that the highest constant voltage is supplied to the thermoelectric element from beginning to end. When the highest constant voltage is supplied to the thermoelectric element in a situation in which the refrigerant inside the heat sink does not flow, since heat dissipation does not occur in the heat sink, a temperature of the heat sink gradually increases. As a result, frost or ice attached on a rear surface of a housing 27 accommodating the heat sink is melted to fall into a drain pan placed on the floor of the freezing evaporation compartment.

The completion condition of the heat sink defrost operation may be set to a set time or a heat sink surface temperature. For example, it may be determined that the completion condition for the heat sink defrost operation is satisfied when a set time (e.g., 60 minutes) elapses after the start of the heat sink defrost operation, or when the surface temperature of the heat sink reaches the set temperature (e.g., 5° C.). Here, in order to set a surface temperature of the heat sink as the completion condition for the heat sink defrost operation, a defrost sensor for detecting the surface temperature of the heat sink should be separately provided.

When the heat sink defrost operation is completed, a reverse voltage is supplied to the thermoelectric element to perform the cold sink defrost operation. Of course, that a rest period is provided before switching from a constant voltage to a reverse voltage is the same as described above.

When the cold sink defrost operation starts, since the temperature of the heat sink drops to a temperature significantly lower than the freezing evaporation compartment temperature, frost may be formed on the rear surface of the housing 27 during the cold sink defrost operation. Here, a portion of the generated ice may be melted to fall into a drain pan while the defrost operation is ended, and a normal cooling operation of the deep freezing compartment is performed. Then, the remaining portion may be removed during the heat sink defrost operation for the next period.

The present invention includes a method for controlling a back heater.

Moisture contained in air in a cooling device chamber is attached on a cooling device and wall surfaces constituting the cooling device chamber and then is grown to be changed into ice.

In the case of a refrigerator including a storage compartment A and a storage compartment B, as described above, in order to remove frost or ice that has formed on or around the cold sink of storage compartment A, a reverse voltage may be applied to the thermoelectric module of the storage compartment A in at least partial section during the defrost operation of the storage compartment A, or a voltage may be applied to a defrost heater of the cold sink disposed under the cold sink.

Alternatively, in order to minimize re-freezing or re-attachment in a process of discharging the melted defrost water or vapor from or around the cold sink, the controller may control the voltage to be applied to a cold sink heater disposed under the cold sink in the at least partial section during the defrost operation of the storage compartment A.

Alternatively, in order to remove the frost or ice formed on or around the cooling device of storage compartment B, a voltage may be controlled to be applied to the cooling device defrost heater disposed below the cooling device.

In the refrigerant circulation system or structure that requires the heat sink defrost operation of storage compartment A, which includes the above-mentioned "sub-zero system or structure", "heat sink communication type structure", and "heat sink non-communication type structure", in order to remove frost or ice attached to the heat sink of the storage compartment A or around the heat sink, the constant voltage may be applied to the thermoelectric module of the storage compartment A, and a voltage may be applied to the defrost heater of the heat sink in the at least partial section during the defrost operation of the storage compartment A.

The heat sink defrost heater may be disposed under the heat sink at a position closer to the heat sink than the cold sink of the thermoelectric module of the storage compartment A.

In order to minimize re-freezing or re-attachment in a process of discharging the melted defrost water or vapor from or around the heat sink to the outside, a voltage may be applied to a heat sink drain heater disposed under the heat sink in the at least partial section during the defrost operation of the storage compartment A.

The vapor generated during the defrost operation of the cold sink of the above-described storage compartment A or the defrost operation of the heat sink of the storage compartment A may be attached to a wall forming a cooling device chamber of the storage compartment B while floating in a cooling device chamber of the storage compartment B.

In order to remove the frost generated at this time, in at least partial section of the defrost operation of the storage compartment A, a voltage may be controlled to be applied to the "cooling device chamber defrost heater" disposed on at least one of the wall defining the storage compartment B or the wall forming the cooling device chamber of the storage compartment B.

More specifically, the "cooling device chamber defrost heater" may be disposed near a passage through which vapor generated during the defrost operation of the cold sink of the storage compartment A or the heat sink of the storage compartment A flows into the cooling device chamber of the storage compartment B.

In the above-mentioned "vapor communication type structure", the vapor discharged to the outside of the storage compartment A and flowing into the cooling device chamber of the storage compartment B may be attached on or around the wall surface forming the cooling device chamber of the storage compartment B.

In order to remove the frost generated at this time, a voltage may be controlled to be applied to the "cooling device chamber defrost heater" disposed on at least one of the wall defining the storage compartment B or the wall forming the cooling device chamber of the storage compartment B.

More specifically, the "cooling device chamber defrost heater" may be disposed in the vicinity of a passage through which the vapor discharged to the outside of the storage compartment A flows into the cooling device chamber of the storage compartment B.

At least one of the heat sink defrost heater, the heat sink drain heater, and the cooling device chamber defrost heater may be disposed above the cooling device of the storage compartment B. The reason is that the "cooling device defrost heater" for defrosting the cooling device of the storage compartment B, such as a freezing compartment defrost heater, may be disposed under the cooling device of the storage compartment B.

At least one of the heat sink defrost heater, the heat sink drain heater, and the cooling device chamber defrost heater may be disposed on a partition wall forming at least a portion of a wall surface defining the cooling device chamber.

More specifically, at least one of a heat sink defrost heater, a heat sink drain heater, and a cooling device chamber defrost heater may be disposed in a shroud constituting the partition wall. This is because at least one of the cold sink defrost heater and the cold sink drain heater may be disposed on the grille pan constituting the partition wall.

The "back heater" of the present invention may be defined as a heater that performs at least one of the functions of the heat sink defrost heater, the heat sink drain heater, and the cooling device chamber defrost heater.

In the heat sink defrosting process, when the deep freezing compartment fan is driven so that wet vapor floating inside the deep freezing compartment is attached on the cold sink, a pressure of the freezing evaporation compartment is lower than that of the deep freezing compartment.

As a result, in the process in which air inside the deep freezing compartment is forcibly circulated by the deep freezing compartment fan, the air in the deep freezing compartment may be introduced into the freezing evaporation compartment 104 through a defrost water guide 30.

Since an internal temperature of the deep freezing compartment is significantly lower than the temperature of the freezing evaporation compartment, a temperature of the cold air of the freezing evaporation compartment is lowered by the cold air flowing into the freezing evaporation compartment.

In addition, as cold air of the deep freezing compartment is introduced into the freezing evaporation compartment 104 along the defrosting water guide 30, a temperature of the back heater seating portion 525 may be cooled to a temperature lower than that of the freezing evaporation compartment. Then, dew is formed on the back heater seating portion 525 and immediately changed into ice.

In addition, when the cold air in the freezing evaporation compartment staying near an outlet of the defrost water guide 30 drops to a low temperature due to the cold air discharged from the deep freezing compartment, moisture contained in the cold air in the freezing and evaporation compartment is condensed and then attached to an outlet of the defrost water guide 30. As time passes, a size of the ice attached to the defrost water guide 30 increases to block the outlet of the defrost water guide 30.

Alternatively, when the vapor generated during the defrosting process of the deep freezing compartment is discharged to the outlet of the defrost water guide 30, it may be cooled by the cold air of the freezing evaporation compartment and frozen at the outlet of the defrost water guide 30.

In order to prevent this phenomenon, the back heater 43 may be turned on when the defrost operations of the deep freezing compartment and the freezing compartment start.

In detail, the cold sink heater 40 and the back heater 43 are turned on at the same time when the defrost operation of the deep freezing compartment and the freezing compartment starts, and thus, a portion at which the cold sink heater 40 and the back heater 43 are mounted is not frozen.

If the back heater 43 is provided as a heater independent of the cold sink heater 40, the back heater 43 may be turned on together when the heat sink defrosting starts. In other words, when a constant voltage is supplied to the thermoelectric element, the back heater 43 may also be turned on.

Hereinafter, a method for controlling the defrost operation in the freezing compartment will be described.

Figure 21:
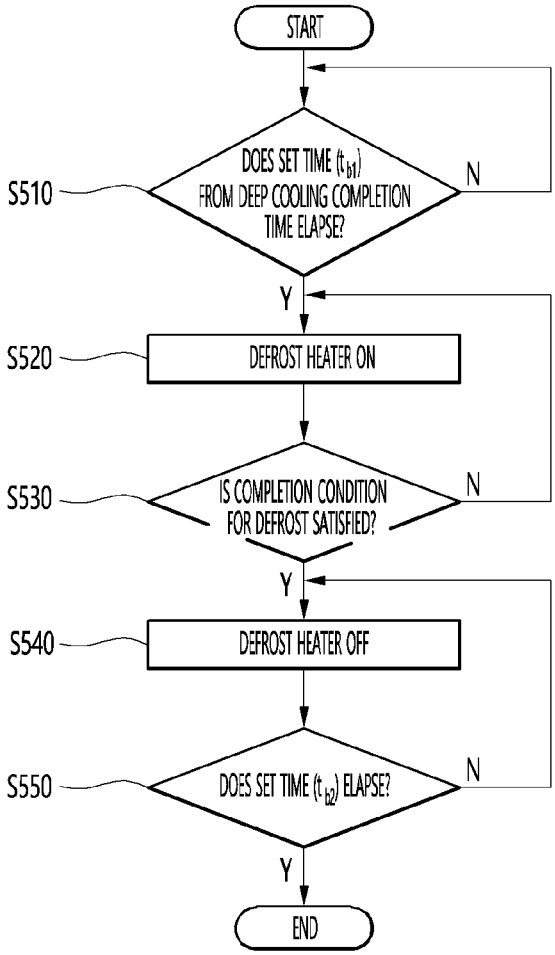
FIG. 21 is a flowchart illustrating a method for controlling a defrost operation of the freezing compartment according to an embodiment of the present invention.

FIG. 21 is a flowchart illustrating a method for controlling the defrost operation of the freezing compartment according to an embodiment of the present invention.

Referring to FIGS. 18 and 21, the defrost operation of the freezing compartment according to the embodiment of the present invention may be performed when a set time tb1 elapses from a deep cooling completion time, regardless of whether the defrost operation of the deep freezing compartment starts (S510). The set time tb1 may be 5 minutes, but is not limited thereto.

Alternatively, the defrost operation of the freezing compartment may be performed immediately when the deep cooling is completed. That is, the defrost operation may be performed immediately without waiting until the set time tb1 elapses.

When the defrost operation of the freezing compartment starts, a defrost heater (not shown) connected to the freezing compartment evaporator is turned on to melt frost and ice attached on a surface of the freezing compartment evaporator (S520). This is the same as the conventional freezing compartment defrost operation.

While the defrost operation of the freezing compartment is performed, the controller determines whether the completion condition for the freezing compartment defrost operation is satisfied (S530).

The completion condition for the freezing compartment defrost, like the completion condition for the cold sink defrost, may be set to be satisfied when a temperature sensed by a defrost sensor is equal to or greater than a set temperature $T_{sp}$, or a set time $t_{sp}$ elapses after the start of the defrost operation. The set temperature $T_{sp}$ may be 5° C., and the set time $t_{sp}$ may be 60 minutes, but is not limited thereto.

When it is determined that the defrost completion condition is satisfied, the defrost heater is turned off (S540), and when a set time tb2 elapses from a time point at which the defrost heater is turned off, the defrost operation of the freezing compartment is ended.

The set time tb2 may be 5 minutes, but is not limited thereto.

The reason for waiting for the set time tb2 to elapse from the time point at which the defrost heater is turned off is for collecting defrost water, which is generated during the defrost operation of the freezing compartment process and the defrost operation of the deep freezing compartment process for the set time tb2, onto a drain pan installed on the bottom of the freezing evaporation compartment.

Particularly, when the heat sink defrost operation is performed after the cold sink defrost operation, an medium constant voltage is applied to the heat sink until the set time tb2 elapses, thereby maximally reducing the ice attached to a surface of the housing 27.

The defrost water generated by melting ice separated from the surface of the cold sink by the cold sink heater may be allowed to escape through the defrost water guide as much as possible.

When the set time tb2 elapses, as described above, the operation after defrosting the freezing compartment is performed.

The invention claimed is:

1. A refrigerator comprising:

a refrigerating compartment;

a freezing compartment partitioned from the refrigerating compartment;

a cooling compartment accommodated in the freezing compartment and partitioned from the freezing compartment;

a freezing evaporation compartment;

a partition wall comprising a grille pan to partition the freezing evaporation compartment and the freezing compartment from each other, and a shroud disposed at a rear surface of the grille pan to define a passage through which cold air of the freezing evaporation compartment is supplied to the freezing compartment;

a freezing compartment evaporator accommodated in the freezing evaporation compartment to generate the cold air for cooling the freezing compartment;

a freezing compartment fan mounted on the shroud to supply the cold air of the freezing evaporation compartment to the freezing compartment;

a thermoelectric module comprising: a thermoelectric element comprising a heat absorption surface facing the cooling compartment and a heat generation surface that is an opposite surface of the heat absorption surface; a cold sink in communication with the heat absorption surface and disposed behind the cooling compartment; a heat sink in communication with the heat generation surface; and a housing to accommodate the heat sink and having a rear surface exposed to the cold air of the freezing evaporation compartment;

a cooling compartment fan disposed in front of the heat absorption surface to cause air within the cooling compartment to forcibly flow;

a cold sink heater disposed at the cold sink; and a back heater disposed at one side of the shroud, wherein the back heater is disposed at a rear side of the shroud and disposed outside the passage.

2. The refrigerator according to claim 1, wherein the partition wall comprises a module sleeve extending from a front surface of the grille pan to communicate with the cooling compartment, and a thermoelectric module accommodation portion to accommodate the thermoelectric module is defined in the module sleeve, wherein the cold sink heater is mounted on the thermoelectric module accommodation portion.

3. The refrigerator according to claim 2, further comprising a defrost water guide extending downward from a bottom of the thermoelectric module accommodation portion to guide discharge of defrost water formed in the thermoelectric module accommodation portion, and wherein a housing accommodation hole is defined at one side of the shroud, which corresponds to a rear surface of the thermoelectric module accommodation portion, wherein the housing is fitted into the housing accommodation hole and partition the thermoelectric module accommodation portion from the freezing evaporation compartment.

4. The refrigerator according to claim 3, wherein the cold sink heater extends along a bottom of the thermoelectric module accommodation portion and into an inside of the defrost water guide.

5. The refrigerator according to claim 4, wherein the shroud comprises a back heater seating portion that covers a rear surface of the defrost water guide, wherein the back heater is seated on the back heater seating portion.

6. The refrigerator according to claim 5, wherein a guide through-hole through which a lower end of the defrost water guide communicates with the freezing evaporation compartment is defined at one side of the shroud, which corresponds to a lower side of the back heater seating portion so that defrost water formed by the cold sink heater is discharged to the freezing evaporation compartment.

7. The refrigerator according to claim 1, wherein the back heater constitutes a portion of the cold sink heater, and the back heater and the cold sink heater are turned on or off at the same time.

8. The refrigerator according to claim 1, wherein the back heater is provided as a separate heater that is distinguished from the cold sink heater so that the back heater and the cold sink heater are controlled to be turned on or off independently.

9. The refrigerator according to claim 1, wherein the cold sink heater and the back heater are:

turned on when a freezing compartment defrost period has lapsed, and cooling operations of the freezing compartment and the cooling compartment are ended; and turned off when all of freezing compartment defrost and cooling compartment defrost are ended.

10. The refrigerator according to claim 1, wherein the cooling compartment defrost comprises:

a controller configured to initiate a cold sink defrost in which a reverse voltage is applied to the thermoelectric module to remove frost or ice attached to the cold sink; and the controller configured to initiate a heat sink defrost in which a constant voltage is applied to the thermoelectric module to remove frost or ice attached to a rear surface of the housing, wherein the back heater is turned on during at least the heat sink defrost operation.

11. A refrigerator comprising:

a refrigerating compartment;

a freezing compartment partitioned from the refrigerating compartment;

a freezing compartment evaporator to cool the freezing compartment;

a freezing compartment defrost heater disposed at the freezing compartment evaporator;

a cooling compartment accommodated in the freezing compartment and partitioned from the freezing compartment;

a freezing evaporation compartment to accommodate the freezing compartment evaporator;

a partition wall to partition the freezing evaporation compartment and the freezing compartment from each other, the partition wall to constitute at least a portion of a wall defining the freezing evaporation compartment;

a freezing compartment fan disposed at the freezing evaporation compartment to supply cold air of the freezing evaporation compartment to the freezing compartment;

a thermoelectric module to cool the cooling compartment to a temperature lower than that of the freezing compartment and comprising:

a thermoelectric element comprising a heat absorption surface facing the cooling compartment and a heat generation surface that is an opposite surface of the heat absorption surface;

a cold sink in communication with the heat absorption surface and disposed at one side of the cooling compartment; and a heat sink in communication with the heat generation surface;

a cooling compartment fan disposed at one side of the heat absorption surface to cause air within the cooling compartment to forcibly flow;

a cold sink heater disposed at the cold sink;

a back heater disposed at one side of a wall of the freezing evaporation compartment; and a controller configured to control the refrigerator so that, when a cooling operation for cooling the cooling compartment and a cooling compartment defrost operation for removing frost or ice generated on the thermoelectric module conflict with each other, the cooling compartment defrost operation is performed by priority, and the cooling operation is stopped, wherein, when an input condition for the cooling compartment defrost operation is satisfied, the controller is configured to perform the cooling operation, the cooling operation is an operation performed to apply a constant voltage to the thermoelectric element and drive the cooling compartment fan so that a temperature of the cooling compartment drops, and when the cooling compartment defrost operation is performed after the cooling operation is ended, the controller is configured to:

perform a first operation in which a reverse voltage is applied to the thermoelectric element to melt the frost or ice deposited on the cold sink, and apply a voltage to the back heater after the deep-cooling operation is ended, in order to reduce deposition of vapor, which is generated during the first operation.

12. The refrigerator according to claim 11, wherein, while the cooling compartment defrost operation is performed, in order to reduce deposition of vapor, which flows by driving of the deep freezing compartment fan, on the partition wall, the controller is configured to apply a voltage to the back heater in at least a partial section of a section in which the cooling compartment fan is driven.

13. The refrigerator according to claim 11, wherein the cooling compartment defrost operation further comprises the controller configured to perform a second operation in which a constant voltage is applied to the thermoelectric module so as to melt frost or ice generated around the heat sink, while the second operation is performed, in order to reduce deposition of vapor, which is generated around the heat sink, on the partition wall, the controller is configured to apply a voltage to the back heater in at least a partial section where the constant voltage is applied.

14. The refrigerator according to claim 11, wherein the partition wall comprises:

a grille pan to partition the freezing evaporation compartment from the freezing compartment; and a shroud disposed at a rear surface of the grille pan to define a passage through which the cold air of the freezing evaporation compartment is supplied to the freezing compartment.

15. The refrigerator according to claim 14, wherein the back heater is disposed at one side of the shroud.

16. The refrigerator according to claim 14, wherein the back heater is disposed above the freezing compartment evaporator.

17. The refrigerator according to claim 14, wherein the back heater is provided in one body with the cold sink heater, and the back heater and the cold sink are turned on or off at the same time.

18. The refrigerator according to claim 11, wherein the back heater is provided as a separate heater that is distinguished from the cold sink heater so that the back heater and the cold sink heater are controlled to be turned on or off independently.

19. A refrigerator comprising:

a refrigerating compartment;

a freezing compartment partitioned from the refrigerating compartment;

a cooling compartment accommodated in the freezing compartment and partitioned from the freezing compartment;

a freezing evaporation compartment;

a partition wall comprising a grille pan to partition the freezing evaporation compartment and the freezing compartment from each other, and a shroud disposed at a rear surface of the grille pan to define a first passage through which cold air of the freezing evaporation compartment is supplied to the freezing compartment;

a freezing compartment evaporator accommodated in the freezing evaporation compartment to generate the cold air for cooling the freezing compartment;

a freezing compartment fan mounted on the shroud to supply the cold air of the freezing evaporation compartment to the freezing compartment;

a thermoelectric module comprising: a thermoelectric element comprising a heat absorption surface facing the cooling compartment and a heat generation surface that is an opposite surface of the heat absorption surface; a cold sink in communication with the heat absorption surface and disposed behind the cooling compartment; a heat sink in communication with the heat generation surface; and a housing to accommodate the heat sink and having a rear surface exposed to the cold air of the freezing evaporation compartment;

a cooling compartment fan disposed in front of the heat absorption surface to cause air within the cooling compartment to forcibly flow;

a cold sink heater disposed at the cold sink; and a back heater disposed at one side of the shroud, wherein the grill pan is configured to define a second passage through which cold air supplied to the cooling compartment flows, and wherein at least a portion of the cold sink heater is disposed in the second passage and at least a portion of the back heater is disposed outside the second passage.

20. The refrigerator according to claim 19, wherein the shroud comprises:

a housing accommodation hole into which the housing is inserted, and a back heater seating portion disposed at a lower side of the housing accommodation hole and on which the back heater is seated.

* * * * *